US006960111B2

(12) United States Patent
Takegami et al.

(10) Patent No.: US 6,960,111 B2
(45) Date of Patent: Nov. 1, 2005

(54) MANUFACTURING METHODS FOR ELECTRON SOURCE AND IMAGE FORMING APPARATUS

(75) Inventors: Tsuyoshi Takegami, Tokyo (JP); Hironobu Mizuno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 280 days.

(21) Appl. No.: 10/277,921

(22) Filed: Oct. 23, 2002

(65) Prior Publication Data

US 2003/0082981 A1 May 1, 2003

(30) Foreign Application Priority Data

Oct. 26, 2001 (JP) ..... 2001-328995
Oct. 4, 2002 (JP) ..... 2002-291916

(51) Int. Cl.[7] ..... H01J 9/00
(52) U.S. Cl. ..... 445/24; 445/6
(58) Field of Search ..... 445/24, 25, 6

(56) References Cited

U.S. PATENT DOCUMENTS

| | | | | |
|---|---|---|---|---|
| 4,849,674 | A | 7/1989 | Cherry et al. | 313/509 |
| 5,593,335 | A | 1/1997 | Suzuki et al. | 445/50 |
| 5,594,296 | A | 1/1997 | Mitsutake et al. | 313/309 |
| 5,674,100 | A | 10/1997 | Ono et al. | 445/24 |
| 5,749,763 | A | 5/1998 | Yoshioka et al. | 445/51 |
| 5,929,827 | A | 7/1999 | Isono et al. | 345/74 |
| 6,034,478 | A | 3/2000 | Kawade et al. | 315/169.1 |
| 6,053,791 | A | 4/2000 | Fujii et al. | 445/6 |
| 6,063,453 | A | 5/2000 | Tomida et al. | 427/532 |
| 6,123,876 | A | 9/2000 | Kobayashi et al. | 252/519.2 |

(Continued)

FOREIGN PATENT DOCUMENTS

| | | | |
|---|---|---|---|
| EP | 0 620 581 A2 | 10/1994 | H01J/1/30 |
| EP | 0 651 418 A1 | 5/1995 | H01J/1/30 |

(Continued)

OTHER PUBLICATIONS

Akiyoshi Baba et al., "Field Emission from an Ion–Beam–Modified Polyimide Film," Japanese Journal of Appli d Physics, Publication Board Japanese Journal of Applied Physics, Tokyo, JP, vol. 38 (1999), NR. 3A, pp. L261–L2 pp. L261–L263.

(Continued)

*Primary Examiner*—Joseph Williams
(74) *Attorney, Agent, or Firm*—Fitzpatrick, Cella, Harper & Scinto

(57) ABSTRACT

The present invention provides a method of manufacturing an electron source which exhibits improved uniformity of electron emitting devices and electron emission properties, and a method of manufacturing an image forming apparatus which exhibits an excellent display quality for a long time. An electron source having a plurality of electron emitting devices is manufactured by disposing a plurality of units, each comprising a pair of electrodes and a polymer film for connecting the electrodes, on a substrate, disposing a plurality of wirings for connection to the pair of electrodes of the plurality of each unit, and decreasing the resistances of all polymer films respectively of the units. A next step includes applying a voltage to films formed by decreasing the resistances of the polymer films, through the wirings, to form a gap in each of the films formed by decreasing the resistance of the polymer films.

21 Claims, 63 Drawing Sheets

U.S. PATENT DOCUMENTS

| | | | | |
|---|---|---|---|---|
| 6,173,145 | B1 | 1/2001 | Chadani et al. | 399/265 |
| 6,179,678 | B1 | 1/2001 | Kishi et al. | 445/24 |
| 6,221,426 | B1 | 4/2001 | Yamanobe | 427/77 |
| 6,246,168 | B1 | 6/2001 | Kishi et al. | 313/495 |
| 6,288,485 | B1 | 9/2001 | Takegami et al. | 313/495 |
| 6,334,801 | B1 | 1/2002 | Kawade et al. | 445/24 |
| 6,334,803 | B1 | 1/2002 | Shibata | 445/51 |
| 6,336,836 | B1 | 1/2002 | Suzuki et al. | 445/6 |
| 6,346,773 | B1 | 2/2002 | Takegami | 315/169.1 |
| 6,383,047 | B1 | 5/2002 | Minami et al. | 445/6 |
| 6,416,374 | B1 | 7/2002 | Mitome et al. | 445/6 |
| 6,540,575 | B1 | 4/2003 | Suzuki et al. | 445/6 |
| 6,626,719 | B2 | 9/2003 | Ono et al. | 445/24 |
| 2002/0016124 | A1 | 2/2002 | Yamashita et al. | 445/6 |
| 2002/0074947 | A1 | 6/2002 | Tsukamoto | 315/169.3 |
| 2002/0117670 | A1 | 8/2002 | Horiguchi et al. | 257/59 |
| 2003/0124944 | A1 | 7/2003 | Kyogaku et al. | 445/6 |

FOREIGN PATENT DOCUMENTS

| | | | |
|---|---|---|---|
| EP | 0 660 357 A1 | 6/1995 | H01J/1/30 |
| EP | 0 726 591 A1 | 8/1996 | H01J/9/02 |
| EP | 0 729 168 A2 | 8/1996 | H01J/1/30 |
| EP | 0 732 721 A1 | 9/1996 | H01J/1/30 |
| EP | 0 736 890 A1 | 10/1996 | H01J/1/30 |
| EP | 0 769 796 A1 | 4/1997 | H01J/9/02 |
| EP | 0 788 130 A2 | 8/1997 | H01J/9/02 |
| EP | 0 803 890 A1 | 10/1997 | H01J/9/02 |
| EP | 0 986 085 A2 | 3/2000 | H01J/9/02 |
| EP | 1 124 247 A1 | 8/2001 | H01J/1/30 |
| EP | 1 184 886 A1 | 3/2002 | H01J/9/02 |
| EP | 0 660 357 B1 | 4/2003 | H01J/1/30 |
| EP | 03004454 | 4/2003 | |
| JP | 06-012997 | 1/1994 | H01J/29/46 |
| JP | 07-065704 | 3/1995 | H01J/1/30 |
| JP | 07-176265 | 7/1995 | H01J/9/02 |
| JP | 07-320631 | 8/1995 | H01J/1/30 |
| JP | 07-235255 | 9/1995 | H01J/1/30 |
| JP | 08-55563 | 2/1996 | H01J/1/30 |
| JP | 08-273533 | 10/1996 | H01J/9/02 |
| JP | 08-277294 | 10/1996 | C07F/15/00 |
| JP | 08-321254 | 12/1996 | H01J/1/30 |
| JP | 09-073859 | 3/1997 | H01J/9/02 |
| JP | 09-102271 | 4/1997 | H01J/9/02 |
| JP | 09-134666 | 5/1997 | H01J/9/02 |
| JP | 09-161666 | 6/1997 | H01J/9/02 |
| JP | 09-237571 | 9/1997 | H01J/9/02 |
| JP | 09-298029 | 11/1997 | H01J/1/30 |
| JP | 11-120901 | 4/1999 | |
| KR | 96-39062 | 11/1996 | H01J/13/08 |
| KR | 10-0221294 | 6/1999 | H01J/31/10 |
| KR | 2000-0058133 | 9/2000 | H01J/1/30 |

OTHER PUBLICATIONS

C.A. Spindt et al., "Physical Properties of Thin–Film Field Emission Cathodes with Molybdenum Cones", *Journal of Applied Physics*, vol. 47, No. 12 (1976), pp. 5248–5263, no month.

C.A. Mead, "Operation of Tunnel–Emission Devices", *Journal of Applied Physics*, vol. 32, No. 4, (1961), pp. 646–652, no month.

W.P. Dyke et al., "Field Emission", *Advances in Electronics and Electron Physics*, vol. 8, (1956) pp. 89–185, no month.

A-A'

: DECREASED-RESISTANCE FILM TO WHICH $V_2$-$V_1$ IS APPLIED

: DECREASED-RESISTANCE FILM TO WHICH VOLTAGE IS NOT APPLIED

: DECREASED-RESISTANCE FILM TO WHICH $V_2$-$V_1$ IS APPLIED

: DECREASED-RESISTANCE FILM TO WHICH VOLTAGE IS NOT APPLIED

PRIOR ART

PRIOR ART $r_y$ : RESISTANCE OF Y-DIRECTION WIRING
$r_x$ : RESISTANCE OF X-DIRECTION WIRING
$R_d$ : DEVICE RESISTANCE

MANUFACTURING METHODS FOR ELECTRON SOURCE AND IMAGE FORMING APPARATUS

BACKGROUND OF THE INVENTION

1. Field of the Invention

The present invention relates to an electron source comprising plural electron emitting devices arranged in a predetermined shape, and a method of manufacturing the electron source. The present invention also relates to an image forming apparatus such as a display device comprising the electron source, and a method of manufacturing the image forming apparatus.

2. Description of the Related Art

Conventional electron emitting devices are roughly divided into two types, including thermionic electron-emitting devices, and cold-cathode electron emitting devices. Examples of cold-cathode electron emitting devices include a field emission type, a metal/insulator/metal type (MIM type), a surface conduction type, and the like.

The construction and manufacturing method of the surface conduction type of electron emitting devices are disclosed in, for example, Japanese Patent Laid-Open No. 8-321254.

FIGS. 65A and 65B schematically show the general construction of a conventional surface conduction type electron emitting device disclosed in the above publication. FIGS. 65A and 65B are respectively a plan view and a sectional view of the electron emitting device disclosed in the above publication.

In FIGS. 65A and 65B, reference numeral 1 denotes a base (substrate), reference numerals 2 and 3 denote a pair of opposed electrodes (device electrodes), reference numeral 4 denotes a conductive film, reference numeral 5 denotes a second gap, reference numeral 6 denotes a carbon film, and reference numeral 7 denotes a first gap.

FIG. 66, consisting of FIGS. 66A to 66D, schematically shows an example of a process for forming an electron emitting device having the structure shown in FIGS. 65A and 65B.

First, the pair of electrodes 2 and 3 is formed on the substrate 1 (FIG. 66A). Then, the conductive film 4 is formed for connecting the electrodes 2 and 3 (FIG. 66B). Then, in a "forming step" ("Forming"), a current is passed between the electrodes 2 and 3 to form the second gap 5 in the conductive film 4 (FIG. 66C). Furthermore, in an "activation step", a voltage is applied across the electrodes 2 and 3 in a carbon compound atmosphere to form the carbon film 6 within the gap 5 on the substrate 1 to partially overlap with the conductive film 4 near the gap 5, to form the electron emitting device (FIG. 66D).

On the other hand, Japanese Patent Laid-Open No. 9-237571 discloses a method of manufacturing a surface conduction type of electron emitting device. Instead of the "activation step", the method comprises a step of coating an organic material such as a thermosetting resin, an electron beam negative resist, polyacrylonitrile, or the like on a conductive film, and a step of carbonizing the coating.

An electron source comprising a plurality of the electron emitting devices manufactured by the above-described manufacturing method can be combined with an image forming member such as a fluorescent material or the like to obtain an image forming apparatus such as a flat display panel or the like.

In addition to the "forming step", the "activation step" may be performed for the above-described conventional electron emitting device to form the carbon film 6 comprising carbon or a carbon compound, and having the narrower first gap 7 within the second gap 5 formed in the "forming step", in order to obtain good electron emission properties.

SUMMARY OF THE INVENTION

The manufacture of an image forming apparatus using the above-described conventional electron emitting devices has the following problems:

Each of the "forming step" and the "activation step" comprises many additional steps such as repeated current supplying steps, a step of forming a preferred atmosphere in each step, etc., thereby complicating control of each of the "forming" and "activation" steps.

When the electron emitting devices are used for an image forming apparatus such as a display or the like, a further improvement in the electron emission properties is desired for decreasing the power consumption of the apparatus.

It also is desired to more easily manufacture an image forming apparatus using the electron emitting devices at a low cost.

As a simple method for solving these problems, a method of a part of this invention for forming an electron emitting device comprises arranging a polymer film to connect a pair of electrodes, decreasing the resistance of the polymer film, and supplying a current to the film formed by decreasing the resistance of the polymer film to form a gap in the film. The electron emitting device having the gap formed with this invention can be easily produced without a need for the above-described "activation step" conventionally required. Furthermore, the electron emitting device formed according to this method exhibits the excellent electron emission properties, as compared with the conventional electron emitting device formed using both the "forming step" and the "activation step".

In manufacturing an electron source comprising many electron emitting devices provided on a substrate by the above-described method comprising decreasing the resistance of the polymer film, and an image forming apparatus using the electron source, the step of supplying a current to the film (formed by decreasing the resistance of the polymer film) to form a gap has the following problem.

In the image forming apparatus and electron source, a large number of electron emitting devices are required for obtaining a high quality image. Therefore, in the "forming step" of forming the gap in the film (formed by decreasing the resistance of the polymer film), in order to shorten the time required for the "forming step", electric power mat be supplied to each decreased-resistance film from an external power supply through wiring (common wiring) connected to the films in common. However, when the "forming step" is simultaneously performed for the plurality of decreased-resistance films connected to a same wiring in common, through the wiring, current flowing through the wiring is increased, thereby possibly causing the following detriments.

(1) A voltage drop due to a resistance of the common wiring causes a gradient in the voltages effectively applied to the decreased-resistance films, and thus gaps formed in the respective decreased-resistance films have different shapes, thereby causing a non-uniformity in the device's performance characteristics.

(2) Since the "forming step" is performed by supplying current through the common wiring, the electric power of the wiring supplied with current is consumed as heat to cause a temperature distribution on the substrate. This causes a temperature distribution of the decreased-resistance films, and thus the gaps formed in the respective decreased-resistance films have different shapes, thereby easily causing variations in the device performance characteristics.

(3) Since a gap is formed in each decreased-resistance film by supplying the current through the wiring, the electric power of the wiring supplied with current is consumed as heat to cause thermal damage to the substrate, thereby deteriorating impact strength.

Although these problems will be described below with respect to a plurality of decreased-resistance films (conductive films) arranged in a ladder form, the problems also occur in a simple matrix arrangement, as described below.

The above-described problem (1) is described in further detail below with reference to FIGS. 67A to 67C and 68A to 68C. Each of FIGS. 67A and 68A is a diagram of an equivalent circuit comprising a plurality of conductive films (decreased-resistance films), wirings and a power supply. Each of FIGS. 67B and 68B is a graph showing potentials on a high-potential side and a low-potential side of each conductive film (decreased-resistance film), and each of FIGS. 67C and 68C is a graph showing a difference voltage between potentials on a high-potential side and a low-potential side of each conductive film (decreased-resistance film), i.e., the voltage applied to each device. As described above, in the present invention, the conductive film or so-called "decreased-resistance film" is disposed between a pair of electrodes. Therefore, for example, as used herein, the phrase "the state in which the conductive film (decreased-resistance film) is connected to wiring" or similar language means a condition in which the conductive film (decreased-resistance film) is connected to a wiring through the electrodes. However, the wiring can also be used as the pair of electrodes, depending on the shape of wiring. Therefore, in the description below, the term "device", when used in conjunction with a description of the "forming step", represents the pair of electrodes and the decreased-resistance film (conductive film) for connecting the electrodes or the decreased-resistance film (conductive film). It should be noted that, in this invention, the "decreased-resistance film" means the film formed by decreasing the resistance of a polymer film.

FIG. 67A shows a circuit in which N conductive films $D_1$ to $D_N$ arranged in parallel are connected to a power supply $V_E$ through wiring terminals $T_H$ and $T_L$. In the circuit, the positive pole of power supply $V_E$ is connected to the conductive film $D_1$ side, and the negative pole of power supply $V_E$ is connected to the conductive film $D_N$ side. As shown in the drawing, the common wiring for connecting the conductive films in parallel has resistance components r between adjacent conductive films. In an image forming apparatus, pixels as targets of electron beams are generally arrayed with an equal pitch. Therefore, electron emitting devices are also arrayed with equal spatial intervals, and wiring for connecting the devices has substantially the same resistance value between the devices as long as no variation occurs in the width and thickness of the wiring during manufacture. Also, it is assumed that the conductive films $D_1$ to $D_N$ have substantially the same resistance value Rd. As can be seen in FIG. 67C, in the circuit shown in FIG. 67A, a higher voltage is applied to the conductive films $D_1$ and $D_N$ at both ends, and a lower voltage is applied to the conductive films near the center of the circuit.

On the other hand, FIGS. 68A to 68C show a case in which the positive and negative poles of the power supply $V_E$ are connected to one (the $D_1$ side in the drawing) side of the conductive film array in which the conductive films are connected in parallel. As shown in FIG. 68C, the voltage applied to each conductive film increases nearer to $D_1$.

In the above two types of circuits, variations in the voltages applied to the respective conductive films depend upon the total number N of conductive films connected in parallel, the ratio (Rd/r) of conductive film resistance Rd to wiring resistance r, or the connection position of the power supply. The variations can become significant as N increases, and as Rd decreases, and variations in the voltages applied to the respective conductive films connected by the method shown in FIGS. 68A to 68C are larger than the variations in FIGS. 67A to 67C. In the simple matrix wiring shown in FIG. 69 which is different from the above-described two circuits, variations also can occur in the voltages applied to the respective conductive films due to voltage drops in wiring resistances rx and ry.

As described above, when a plurality of devices (conductive films) are connected by a common wiring, variations can occur in the voltages applied to the respective conductive films unless the wiring resistance is sufficiently decreased as compared with the resistance Rd of each conductive film.

As a result of extensive research, the inventors have discovered that when the devices have the same shape, i.e., when the conductive films 4 shown in FIGS. 65A to 65B are formed of the same thickness and same dimensions W and L1 by using a same material, the same voltage or same electric power is applied for forming the gaps in the "forming step". The voltage and electric power peculiar to the devices also are referred to herein as the "forming voltage Vform of the devices" or "forming electric power Pform". When the "forming step" is performed by applying a higher voltage or a higher electric power than Vform or Pform to the devices (conductive films), the gaps formed in the respective conductive films can widely vary and thus cause a deterioration of the electron emission properties. When the voltage or electric power is lower than Vform or Pform, of course, the gaps cannot be formed.

As described above, when the "forming step" is performed by simultaneously supplying a voltage to a plurality of conductive films connected by common wiring from an external power supply through the a common wiring, differences can occur between the voltages applied to the respective devices (conductive films) as a result of a voltage drop in the wiring. As a consequence, a higher voltage or electric power than the "forming" voltage Vform or the "forming" electric power Pform is applied to some of the devices (conductive films) than to others. From a quantitative perspective, it has been found that the shapes of the gaps formed in the conductive films can vary, and thus the electron emission properties of a plurality of electron emitting devices obtained by the "forming step" also can widely vary. The quantitative properties will be described in the "Description of Preferred Embodiments" below.

In order to prevent variations in the device applied voltages (voltages applied to the conductive films) in the "forming step", wiring with low resistance must be used as the common wiring for connecting the plurality of devices (conductive films) and coupling the devices to the power supply. Also, requirements for the wiring become more severe as the number of devices connected to the common wiring increases. Consequently, many limitations are imposed on the degrees of freedom of the structural designs and manufacturing processes for the electron source and image forming apparatus, thereby increasing the cost of the apparatus.

Next, the problems (2) and (3) are described in further detail below.

Although, in the "forming step", a current is supplied to the conductive films to form the gaps in the conductive films, the electric power supplied by the current is consumed and converted to Joule heat in the common wiring and the devices to increase the temperature of the substrate. On the other hand, in forming the gaps, a change in form is easily affected by the temperature. Therefore, variations in the temperature of the substrate affect the electron emission properties of the devices. Particularly, in an electron source and an image forming apparatus each comprising a plurality of devices provided in a predetermined arrangement, as the number of the devices simultaneously subjected to the "forming step" increases, variations due to a voltage drop in the common wiring increase to cause an undesired problem. For example, a distribution occurs in the increased temperature of the substrate, in which the temperature of the central portion is more increased than end portions, thereby causing variations in the electron emission properties. As a result, in the image forming apparatus, variations in the electron emission properties of the devices cause a problem of producing a difference in luminance to deteriorate image quality.

Also, the generated heat causes a thermal impact or strain to the substrate, and particularly in the image forming apparatus under a vacuum, and a container structure resistant to atmospheric pressure can be broken to cause the problem of decreased safety.

The above problems further bring about the following defects:

(1) The number of devices (conductive films) which can be connected by a common wiring is limited.

(2) A relatively expensive material such as Au or Ag must be used for decreasing the wiring resistance, thereby increasing the material cost.

(3) The thickness of a wiring electrode must be increased for decreasing the wiring resistance, thereby increasing the time and equipment cost required for the manufacturing process for forming the electrode and patterning.

The present invention has been achieved as a result of extensive research for solving the above problems, and the methods and construction of devices according to the present invention are as follows.

A method of manufacturing an electron source of the present invention comprises the steps:

(A) forming, on a substrate, a plurality of units each comprising a pair of electrodes and a polymer film for connecting the electrodes;

(B) forming a plurality of wirings so as to connect them with the electrodes constituting the plurality of units;

(C) decreasing the resistances of all polymer films of the plurality of units; and (D) applying a voltage to the decreased-resistance films (formed by decreasing the resistances of the polymer films) through the wirings to form a gap in each of the decreased-resistance films;

wherein the step D is preferably performed after the step C.

In accordance with one embodiment of the method of manufacturing the electron source of the present invention, the step of decreasing the resistances of the polymer films comprises irradiating the polymer films with an electron beam, an ion beam or light.

The plurality of wirings to be connected to the pair of electrodes of each unit preferably comprise matrix wirings comprising row-direction wirings and column-direction wirings.

The present invention is characterized by "forming" means (operations) as the step of forming the gap. Thus, the "forming" means is described in detail below.

A. "Forming" is successively performed for the units which are respectively connected to the row-direction wirings or the column-direction wirings, each of which has the films formed by decreasing the resistance of the polymer films. Namely, a voltage is applied only to those devices (the film formed by decreasing the resistance of the polymer film) of a group in a desired portion, but no voltage is applied to other device groups.

B. In "forming" for the device (the film formed by decreasing the resistance of the polymer film) group in the desired portion, "forming" is performed for the devices with substantially the same voltage or same electric power.

The above condition A will be described in further detail below.

A-1. In the step of forming the gap, a potential V1 is applied to all wirings of either the row-direction wiring group or the column-direction wiring group, a potential V2 different from potential V1 is applied to some of the wirings of the other wiring group, and potential V1 is applied to the remaining wirings. This operation may be repeated.

In this case, the wiring group to which potential V2 is applied is preferably the wiring group causing less variation in the electric power applied to the plurality of films of the devices connected to the wirings.

More specifically, in the step of forming the gap, for example, by supplying electric power from a power supply section connected to one side of the row-direction wirings or the column-direction wirings, assuming that the number of the films (formed by decreasing the resistance of the polymer films) arranged in parallel in the row direction is Nx, the number of the films (formed by decreasing the resistance of the polymer films) arranged in parallel in the column direction is Ny, the wiring resistance per device in the row direction is rx and the wiring resistance per device in the column direction is ry, when $(Nx \times Nx-8Nx) \times rx \leqq (Ny \times Ny-8Ny) \times ry$, the step is performed by supplying electric power from a power supply section connected to one side of the row-direction wirings. When $(Nx \times Nx-8Nx) \times rx > (Ny \times Ny-8Ny) \times ry$, the step is performed by supplying electric power from the power supply section connected to one side of the column-direction wirings.

Specifically, in the step of forming the gap, for example, by supplying electric power from power supply sections connected to both sides of the row-direction wirings or the column-direction wirings, assuming that the number of the films arranged in parallel in the row direction is Nx, the number of the films arranged in parallel in the column direction is Ny, the wiring resistance per device in the row direction is rx and the wiring resistance per device in the column direction is ry, when $(Nx \times Nx-24Nx) \times rx \leqq (Ny \times Ny-24Ny) \times ry$, the step is performed by supplying electric power from the power supply sections connected to both sides of the row-direction wirings. While when $(Nx \times Nx-24Nx) \times rx > (Ny \times Ny-24Ny) \times ry$, the step is performed by supplying electric power from the power supply sections connected to both sides of the column-direction wirings.

A-2. In the step of forming the gap, potential V1 is applied to some of the row-direction wirings, and potential V2 different from potential V1 is applied to the remaining wirings. Similarly, potential V1 is applied to some of the column-direction wirings, and potential V2 different from potential V1 is applied to the remaining wirings. In this case, the step of forming the gap is performed for each of two units in a group of a plurality of films (formed by decreasing the resistance of the polymer films) connected to the row-direction wirings and the column-direction wirings.

The above condition B will be described in further detail below.

B-1. The step of forming the gap is performed by supplying a current from electrical connection means disposed in contact with the wirings. Namely, the "forming" voltage is not supplied from the terminal of the common wiring, but applied through the electrical connection means provided separately from the common wiring.

In this case, the preferred conditions include the following:

The electrical connection means is provided in contact with a plurality of positions of the wirings.

The electrical connection means has a plurality of contact terminals disposed in contact with a plurality of positions of the wirings.

The electrical connection means has contact surfaces which can be put into contact with surfaces of the wirings.

The electrical connection means comprises a member with a lower resistance than the resistance of the wirings.

The temperature of the electrical connection means is controlled.

A low-resistance metal is coated on the surfaces of the wirings in contact with the electrical connection means.

The wirings in contact with the electrical connection means are lower wirings coated with an insulating member, and contact holes are formed in the insulating member so as to permit contact between the electrical connection means and the lower wirings.

The step of forming the gap is performed by supplying electric power from the electrical connection means disposed in contact with the wirings, and supplying electric power from the power supply section in contact with one or both of the sides of the wirings.

B-2. At least either of the row-direction wirings and the column-direction wirings are divided at predetermined intervals or provided with high-impedance portions at predetermined intervals, and the "forming" voltage is applied to a portion of the wirings. After "forming" is completed, the divided portions or the high-impedance portions are connected.

Specifically, for example, at least either of the row-direction wirings and the column-direction wirings are divided at the predetermined intervals to electrically disconnect a plurality of units, and in this state, the step of forming the gap is performed for each unit. Then, the units are electrically connected to each other by a short-circuit step.

In this case, it is preferred that the step of forming the gap is performed for each of the plurality of units of the films (formed by decreasing the resistance of the polymer films), which are obtained by electrically disconnecting, at the predetermined intervals, the wirings connected to the films, and then the short-circuit step is performed, and it also is preferred that the short-circuit step comprises a wire bonding step using a low-resistance metal material, or the step of electrically short-circuiting the units by heat-melting a low-melting-point metal.

Alternatively, for example, the high-impedance portions are provided, at the predetermined intervals, in at least either of the row-direction wirings and the column-direction wirings, and in this state, the step of forming the gap is performed for each unit. Then, the units are electrically connected.

In this case, the preferred conditions include the following:

The step of forming the gap is performed for each of the plurality of units of the films (formed by decreasing the resistance of the polymer films) formed by providing the high-impedance portions, at the predetermined intervals, in the wirings connected to the plurality of films, and then the units are electrically short-circuited. The short-circuit step comprises the wire bonding step or the step of electrically short-circuiting the units by heat-melting the low-melting-point metal.

Each of the high-impedance portions comprises a high-resistivity metal or nickel-chromium alloy thin film.

The high-impedance portions preferably are narrower or thinner than the wirings around the connection portions.

B-3. When the step of forming the gap is performed by supplying electric power to each of the films (formed by the decreasing the resistance of the polymer films) through the wirings, the electric power or voltages applied to the films are controlled to be substantially the same.

In this case, the applied electric power or applied voltage is preferably controlled at any time before the gap is formed in each of the films. More specifically, of the plurality of films connected to the wirings, the position of the film in which the gap is not formed is detected, and the applied electric power or applied voltage required for forming the gap in another film is preferably controlled according to the position.

For example, when the step of forming the gap is performed by supplying electric power from the power supply section connected to one of the sides of the wirings, the applied voltage is preferably controlled so that the voltage applied to the power supply section increases from the films at both sides of the wirings connected to the plurality of films toward the film positioned at the center.

For example, when the step of forming the gap is performed by supplying electric power from the power supply sections connected to both sides of the wirings, the applied voltage is preferably controlled so that the voltage applied to the power supply section increases from the films at one of the sides and the center of the wirings connected to the plurality of films toward the films near the positions at ¼ of the length of the wirings.

In the method of manufacturing the electron source of the present invention, the step of forming the gap preferably comprises forming them in predetermined units so as to minimize variations in the substrate temperature.

Specifically, in the step of forming the gap, where a plurality of films connected to a plurality of row-direction wirings or/and a plurality of column-direction wirings divided into units, the voltage is successively applied to the respective units.

In this case, the preferred conditions include the following:

In the step of forming the gap, the wirings distributed into one unit and the wirings distributed into another unit to which the voltage is next applied are arranged so that the wirings in other units are positioned between the two units.

In the step of forming the gap, when the total number of the row-direction wirings is GN, and the row-direction wirings are numbered 1, 2, 3, 4, . . . , GN from an end, the number of the row-direction wirings distributed into one unit is determined according to a remainder of a division of the number of the row-direction wirings by the total number UN of the units.

In the step of forming the gap, when the total number of the column-direction wirings is RN, and the column-direction wirings are numbered 1, 2, 3, 4, . . . , RN from an end, the number of the column-direction wirings distributed into one unit is determined according to a remainder of a division of the number of the column-direction wirings by the total number UN of the units.

In the step of forming the gap, the voltage is simultaneously applied to the wirings distributed in each of the units.

According to another embodiment of the invention, in the step of forming the gap, the voltage is successively applied to the wirings distributed in each of the units.

Also in the step of forming the gap, after the period for applying the voltage to the one unit, the period for applying the voltage to the other unit is preferably started.

Also in the step of forming the gap, the voltage is applied several times at predetermined intervals.

In the step of forming the gap, during the time the voltage is applied to one unit, the voltage is applied to other remaining units.

The present invention also relates to a method of manufacturing an image forming apparatus comprising an electron source comprising a plurality of electron emitting devices disposed on a substrate, and an image forming member for forming an image by irradiation of electron beams from the electron source, the electron source being manufactured by the above-described method of manufacturing the electron source of the present invention.

In the present invention, the above-described "forming" means A-1, A-2, B-1, B-2 and B-3 may be carried out separately or in an appropriate combination of two means or more.

The manufacturing method of the present invention can be significantly simplified, as compared with the conventional manufacturing method requiring the step of forming a conductive film, the step of forming an atmosphere containing an organic compound (or the step of forming a polymer film on the conductive film), the step of forming a carbon film by supplying a current to the conductive film and forming a gap in the carbon film.

The present invention also can resolve the above-described problems of the step of forming the gap in the conductive film in the process for manufacturing the electron source. Namely, in forming the gap in the device film (the film formed by decreasing the resistance of the polymer film), the voltage or current is prevented from flowing to the decreased-resistance film to decrease a distribution of the "forming" voltage or electric power due to a voltage drop in wirings, thereby suppressing variations in properties of electron emitting devices.

Further objects, features and advantages of the present invention will become apparent from the following description of the preferred embodiments with reference to the attached drawings.

DESCRIPTION OF THE PREFERRED EMBODIMENTS

Various embodiments of the present invention will be described below. However, it should be noted that the present invention is not limited to these embodiments, and the invention also is intended to cover various modifications and equivalents of the embodiments described herein.

First, (1) a method of preparing an electron emitting device will be described, and then (2) a "forming" method and means for an electron source and an image forming apparatus each comprising a plurality of devices will be described in detail below.

(1) Method of Preparing Electron Emitting Device

Figure 1:
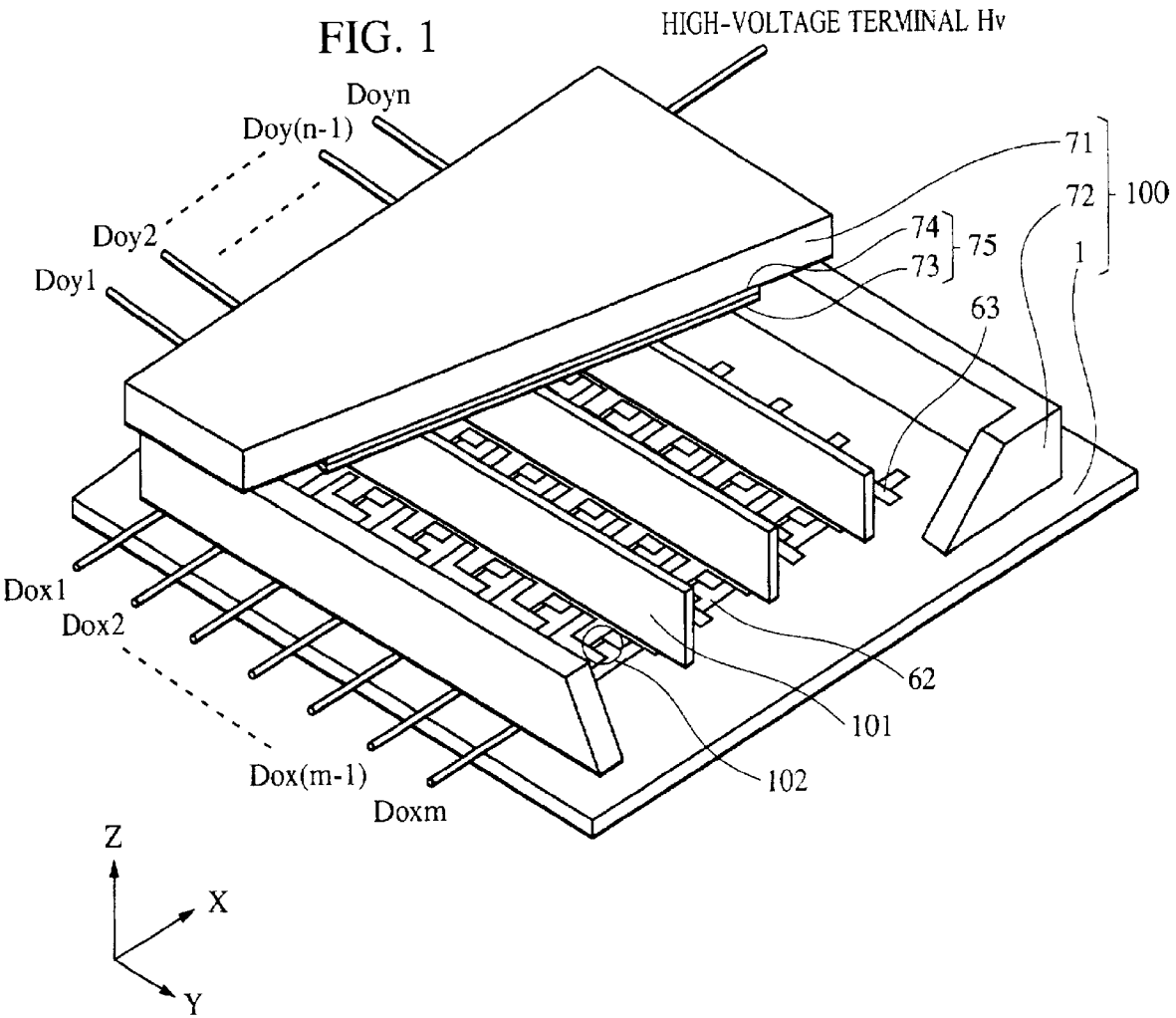
FIG. 1 is a schematic drawing showing an example of an image forming apparatus using an electron source manufactured by a manufacturing method according to the present invention.

FIG. 1 is a schematic drawing showing an example of an image forming apparatus using electron emitting devices 102 manufactured by a manufacturing method of the present invention. In FIG. 1, a support frame 72 and a face plate 71 (described below) are shown as being partially removed, for the purpose of describing an inside of the image forming apparatus (an airtight container (an envelope) 100).

In FIG. 1, reference numeral 1 denotes a substrate (referred to as a "rear plate") on which the electron emitting devices 102 are arranged. Reference numeral 71 denotes the face plate 71 comprising an image forming member 75, and reference numeral 72 denotes the support frame for maintaining a space between the face plate 71 and the rear plate 1 in a vacuum state. Reference numeral 101 denotes a spacer disposed for maintaining a gap between the face plate 71 and the rear plate 1.

When the image forming apparatus 100 serves as a display, the image forming member 75 comprises a fluorescent film 74 and a conductive film 73 (referred to as a "metal back"). Reference numerals 62 and 63 denote wirings connected to the electron emitting devices 102, for applying a voltage thereto. Doy1 to Doyn and Dox1 to Doxm denote lead wirings for connecting ends of the wirings 62 and 63 led out of the vacuum space (the space surrounded by the face pate 71, the rear plate 1 and the support frame) of the image forming apparatus 100 to a driving circuit (not shown) and the like disposed outside the image forming apparatus 100.

Figure 2A:
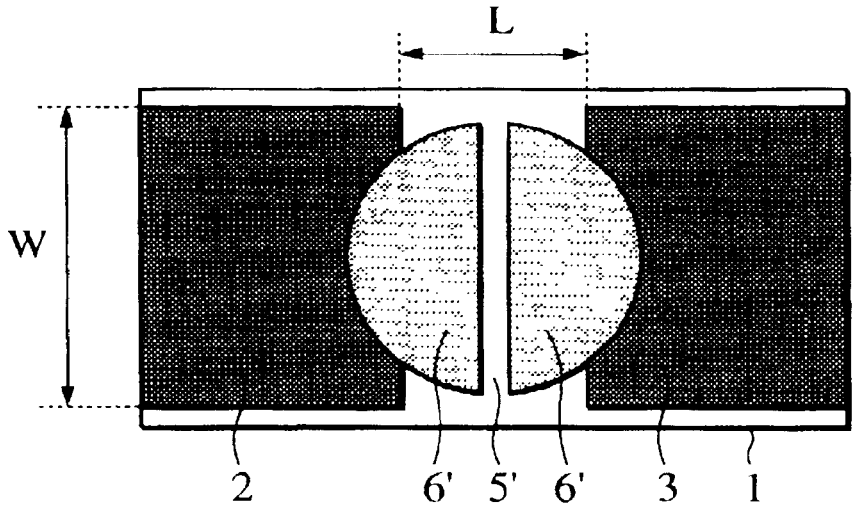
FIGS. 2A and 2B are respectively a plan view and a sectional view schematically showing an example of a surface conduction type electron emitting device preferably used for an electron source of the present invention.
Figure 2B:
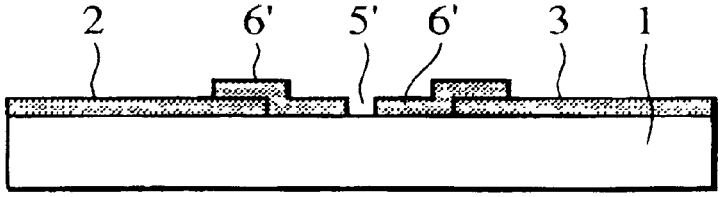

FIG. 2, consisting of FIGS. 2A and 2B, shows the details of one electron emitting device 102. FIGS. 2A is a plan view, and FIG. 2B is a sectional view.

In FIG. 2, reference numeral 1 denotes the substrate (rear plate), reference numerals 2 and 3 each denote an electrode (device electrode), reference numeral 6' denotes a carbon film, and reference numeral 5' denotes a gap. The carbon film 6' is disposed between the electrodes 2 and 3 on the substrate 1. Also, the carbon film 6' partially covers the electrodes 2 and 3 to permit reliable connection between the electrodes 2 and 3.

As the carbon film 6', a conductive film comprising carbon as a main component, a film formed by decreasing the resistance of a polymer film, a conductive film comprising carbon as a main component and having a gap, for electrically connecting a pair of electrodes, or a pair of conductive films each comprising carbon as a main component can be used.

In the electron emitting device 102 having the above construction, when a sufficient electric field is applied to the gap 5', electrons tunnel through the gap 5' to pass a current between the electrodes 2 and 3. The tunnel electrons are partially emitted as emission electrons.

Therefore, the carbon film 6' need not have all conductivity, and at least a portion of the carbon film 6' may have conductivity. With the carbon film 6' comprising an insulator, even when a potential difference is applied between the electrodes 2 and 3, no electric field is applied to the gap 5' to fail to emit electrons. In the carbon film 6', at least the regions between the electrode 2 and 3 and the gap 5' preferably have conductivity. This permits the application of a sufficient electric field to the gap 5'.

FIG. 3, consisting of FIGS. 3A to 3D, shows an example of a method of manufacturing an electron emitting device according to the present invention. An example of the method of manufacturing the electron emitting device according to the present invention is described below with reference to FIGS. 3A to 3D, 4A and 4B, and 5A to 5D.

Figure 3A:
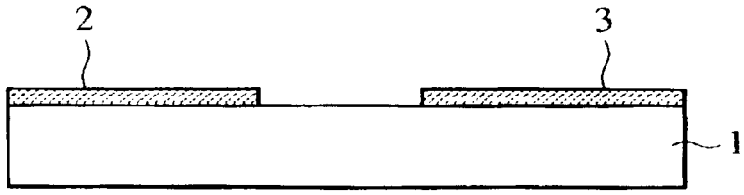
FIG. 3, consisting of FIGS. 3A to 3D, is a drawing showing an example of a method of manufacturing a surface conduction type electron emitting device preferably used for an electron source of the present invention.

(1) The substrate (base material) 1 made of glass is sufficiently cleaned with a detergent, pure water, an organic solvent, etc., and an electrode material is deposited on the substrate 1 by a vacuum deposition process, a sputtering process, or the like. Then, the electrodes 2 and 3 are formed on the substrate 1 by, for example, photolithography (FIG. 3A). When a laser irradiation process to described below is performed, as the electrode material, a transparent conductor such as an oxide conductor, such as for example, tin oxide, indium oxide (ITO), or the like, can be used, depending on applicable design criteria.

Figure 3B:
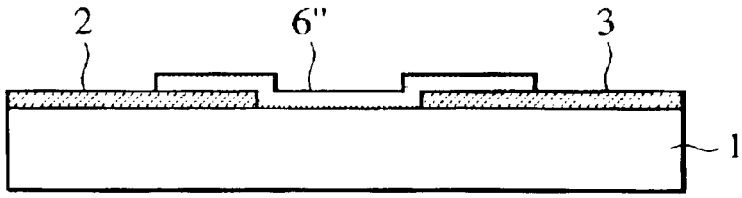

(2) Then, a polymer film 6" is formed to connect the electrodes 2 and 3 provided on the substrate 1 (FIG. 3B). As the polymer film 6", polyimide is preferably used.

The polymer film 6" can be formed by any of various known methods such as a spin coating method, a printing method, a dipping method, and the like. Particularly, the printing method is preferred because the shape of the polymer film 6" can be formed without using patterning means. Particularly, an ink-jet printing method is capable of directly forming a pattern of several hundred $\mu$m or less, and is thus effective in manufacturing an electron source applied for use in a flat panel display and comprising electron emitting devices arranged at a high density.

In forming the polymer film 6" by the ink jet printing system, a polymer material solution may be applied dropwise and then dried. However, a solution of a desired polymer precursor may be applied dropwise and then polymerized by heating, depending on applicable design criteria.

Although, in the present invention, an aromatic polymer is preferably used as the polymer material, the method of coating a solution of a polymer precursor is effective because many aromatic polymers are insoluble in solvents. For example, a solution of polyamic acid, which is a precursor of aromatic polyimide, can be coated (dropwise) by the ink jet system, and then heated to form a polyimide film.

Examples of the solvent which can be used for dissolving the polymer precursor include N-methylpyrrolidone, N,N-dimethylacetamide, N,N-dimethylformamide, dimethylsulfoxide, and the like. These solvents may be combined with n-butyl cellosolve, triethanolamine, or the like. However, the solvent is not limited to these solvents as long as the polymer precursor can be dissolved.

In the present invention, particularly, aromatic polyimide easily exhibits conductivity due to dissociation of carbon bonds and recombination at a relatively low temperature. Namely, aromatic polyimide is a polymer which easily produces double bonds between carbon atoms, and is thus preferably used as the polymer film 6". Also, polyphenylene oxadiazole and polyphenylene vinylene exhibit conductivity by thermal decomposition, and can thus be preferably used as the polymer film 6" in the present invention.

(3) Next, a resistance decreasing step is performed for decreasing the resistance of the polymer film 6". In the resistance decreasing step, conductivity is imparted to the polymer film 6" to form a conductive film (decreased-resistance film) 6' (FIG. 3D) comprising carbon as a main component. In this step, the resistance of the polymer film 6" is decreased to the range of $10^3$ Ω/□ to $10^7$ Ω/□ in view of the gap forming step described below. For example, the resistance of the polymer film 6" can be decreased by heating the polymer film 6". The reason for decreasing the resistance (making conductive) of the polymer film 6" by heating it is that conductivity is exhibited by dissociation of carbon bonds and recombination in the polymer film 6".

The resistance of the polymer film 6" can be decreased by heating at a temperature higher than the decomposition temperature of the polymer constituting the polymer film 6". Particularly, the polymer film 6" is preferably heated in an oxidation inhibiting atmosphere such as an inert gas atmosphere or a vacuum.

Although the aromatic polymer, particularly aromatic polyimide, has a high decomposition temperature, heating at a temperature, typically 700° C. to 800° C., higher than the thermal decomposition temperature can impart high conductivity to the polymer.

However, in the present invention, when the polymer film 6" as a component member of the electron emitting device 102 is heated until it is thermally decomposed, the method of heating the whole polymer by using an oven or a hot plate is possibly restricted from the viewpoint of heat resistance of the other component members of the electron emitting device 102. Particularly, the substrate 1 is limited to a material with high heat resistance, such as a quartz glass or ceramic substrate, and thus the substrate 1 becomes very expensive when applied to a large-area display panel or the like.

Figure 3C:
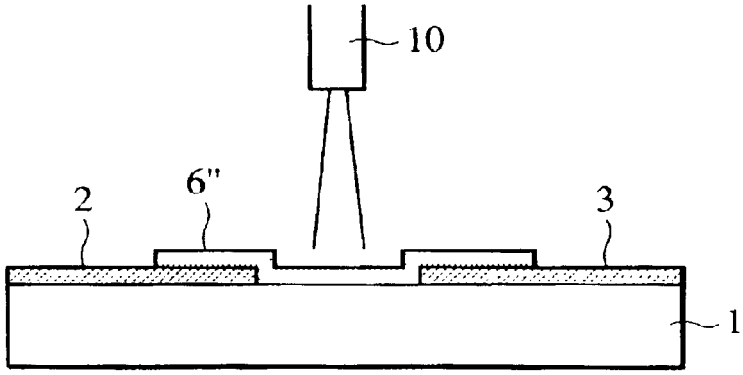

Therefore, in the present invention, as shown in FIG. 3C, the resistance of the polymer film 6" is more preferably decreased by irradiation with an energy beam such as an electron beam, an ion beam, or light. As the irradiation light, a laser beam or halogen light can be used. Particularly, the resistance of the polymer film 6" is preferably decreased by irradiating the polymer film 6" with an electron beam or ion beam from an electron beam or ion beam irradiation means 10. This method can decrease the resistance of the polymer film 6" without using a special substrate. In this case, a preferable result is possibly obtained by factors other than heat, for example, decomposition and recombination due to an electron beam, and decomposition and recombination due to photons, as well as decomposition and recombination due to heat.

The resistance decreasing step will be described below.

(Electron Beam Irradiation)

In electron beam irradiation, the substrate 1 on which the electrodes 2 and 3 and the polymer film 6" are formed is set in a low-pressure atmosphere (vacuum container) provided with an electron gun (not shown). The polymer film 6" is irradiated with an electron beam from the electron gun provided in the container. At this time, preferred conditions for electron beam irradiation include an acceleration voltage Vac of 0.5 kV to 10 kV. During irradiation with the electron beam, the resistance value between the electrodes 2 and 3 is preferably monitored so that electron beam irradiation is stopped when a desired resistance value is obtained.

(Laser Beam Irradiation)

In laser beam irradiation, the substrate 1 on which the electrodes 2 and 3 and the polymer film 6" are formed is set on a stage, and the polymer film 6" is irradiated with a laser beam. At this time, in order to suppress oxidation (combustion) of the polymer film 6", the environment of laser beam irradiation is preferably an inert gas or vacuum environment. However, the irradiation may be performed in the atmosphere according to conditions for laser irradiation.

Laser beam irradiation is preferably performed by, for example, using a second harmonic (wavelength 532 nm) of a pulse YAG laser. During irradiation with the laser beam, the resistance value between the electrodes 2 and 3 is preferably monitored so that laser beam irradiation is stopped when a desired resistance value is obtained.

The electron beam or laser beam irradiation need not be performed over the entire region of the polymer film 6". Even if the resistance of a portion of the polymer film 6" is decreased, the subsequent steps can be carried out.

Figure 3D:
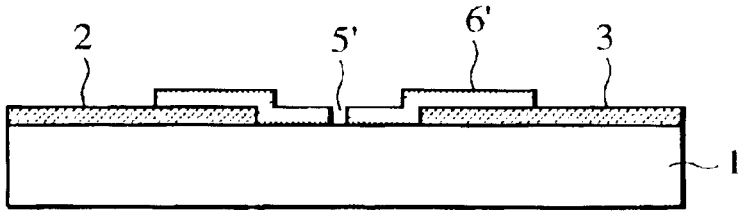

(4) Next, the gap 5' is formed in the conductive film 6' (formed by decreasing the resistance of the polymer film 6") obtained in the step (3) (FIG. 3D). This step is referred to as a "forming", a "forming step" or a "voltage applying step". In this step, a carbon film having a gap can be obtained.

Herein, the step is described with respect to a single device, not a plurality of devices. The step for many devices is described in detail below with reference to the appropriate embodiments.

The gap 5' is formed by applying a voltage (passing a current) between the electrodes 2 and 3. The applied voltage is preferably a pulse voltage, and the gap 5' is formed in the conductive film 6' (formed by decreasing the resistance) in the voltage applying step.

Figure 16:
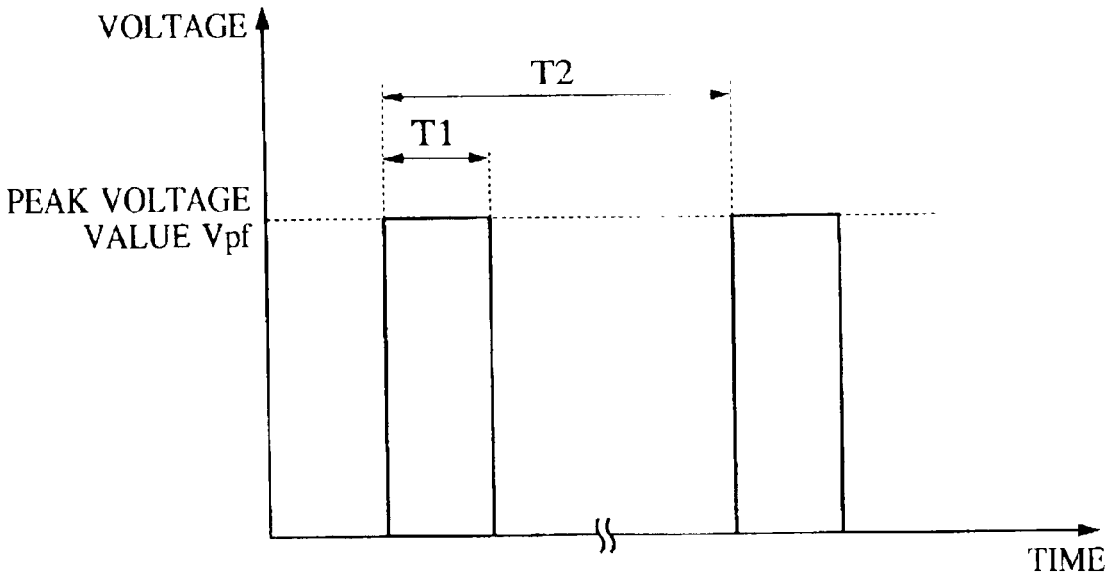
FIG. 16 is a diagram showing an example of a pulse voltage used for "forming".

FIG. 16 shows an example of the pulse voltage. In FIG. 16, T1 and T2 respectively denote the pulse width of the voltage waveform and the pulse interval. The pulse voltage is applied for, for example, about several tens of seconds to several tens of minutes with pulse width T1 of 1 microsecond to 10 milliseconds, and intervals T2 of 10 microseconds to 100 milliseconds, the peak value (peak voltage in "forming") of a rectangular wave being appropriately selected.

Although the above-described "forming step" comprises applying the rectangular wave pulse between the device electrodes 2 an 3 to form the gap 5' (electron emission region), the waveform applied between the electrodes of the device is not limited to the rectangular waveform, and other desired waveforms such as a triangular wave may be used. The peak value, the pulse width and the pulse interval also are not limited to the above values, and other desired values may be selected instead as long as the electron emission section can be satisfactorily formed.

The voltage applying step also can be performed at the same time as the resistance decreasing step. Namely, the voltage pulse can be applied continuously between the electrodes 2 and 3 during irradiation with the electron beam or the laser beam. In any case, the voltage applying step preferably is performed in a low-pressure atmosphere, and more preferably in an atmosphere of a pressure of $1.3\times10^{-3}$ Pa or less.

In the voltage applying step, a current flows according to the resistance value of the conductive film 6' (obtained by decreasing the resistance of the polymer film). When the resistance of the conductive film 6' is excessively low, i.e., when the resistance of the conductive film 6' is excessively decreased, much electric power is required for forming the gap 5'. The gap 5' can be formed with a relatively small amount of energy by controlling the degree of decrease in resistance. Therefore, the resistance decreasing step is most preferably uniformly performed over the entire region of the polymer film 6", but the step also may be performed for only a portion of the polymer film 6".

In consideration of the fact that the electron emitting device of the present invention is driven in a vacuum atmosphere, it is undesirable to expose an insulator to the vacuum atmosphere. Therefore, substantially the entire surface of the polymer film 6" preferably is transformed (decreased in resistance) by irradiation with the electron beam or the laser beam.

Figure 4A:
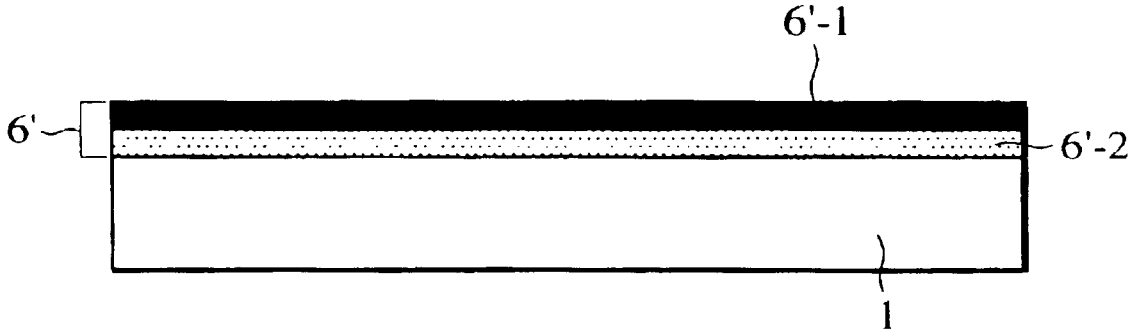
FIG. 4, consisting of FIGS. 4A and 4B, is a drawing showing an example of a resistance reducing step in a method of manufacturing a surface conduction type electron emitting device preferably used for an electron source of the present invention.
Figure 4B:
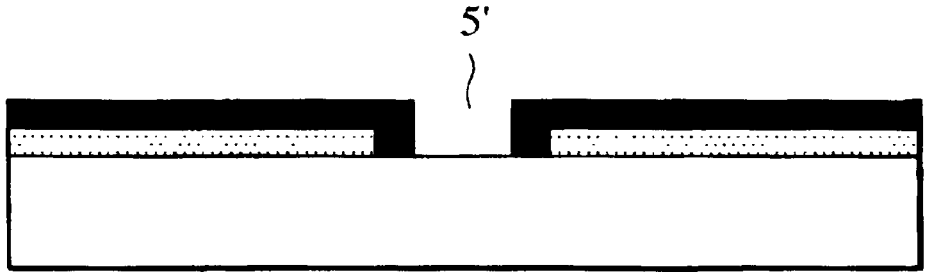

FIG. 4, consisting of FIGS. 4A and 4B, is a schematic drawing (sectional view) showing the process for forming the gap 5' in the film 6' in which the resistance of the surface is decreased in the resistance decreasing step. FIG. 4A shows the state before the voltage applying step (after the resistance decreasing step), and FIG. 4B shows the state at the end of the voltage applying step.

In FIG. 4A, reference numeral 1 denotes the substrate, reference numeral 6'-1 denotes the region in which the resistance is decreased in the resistance decreasing step, and reference numeral 6'-2 denotes the region in which the resistance is not decreased. In FIG. 4B, reference numeral 5' denotes the gap.

First, in the voltage applying step, a current flows through the surface region 6'-1 decreased in resistance to form a starting point of the gap 5' in the surface region 6'-1. Then, the voltage applying step is continuously performed to gradually thermally decompose the lower polymer region 6'-2, which is not thermally decomposed by applying the voltage, because the current flows to the periphery of the formed starting point of the gap 5', avoiding the starting point to produce heat. Therefore, the gap grows from the starting point of the gap 5' in the thickness direction of the conductive film 6' to form the gap 5' (FIG. 4B).

Even when the decreased-resistance region 6'-1 is positioned on the substrate side or at an intermediate position in the thickness direction, the gap 5' can be finally formed over the conductive film 6' in the thickness direction.

Figure 5A:
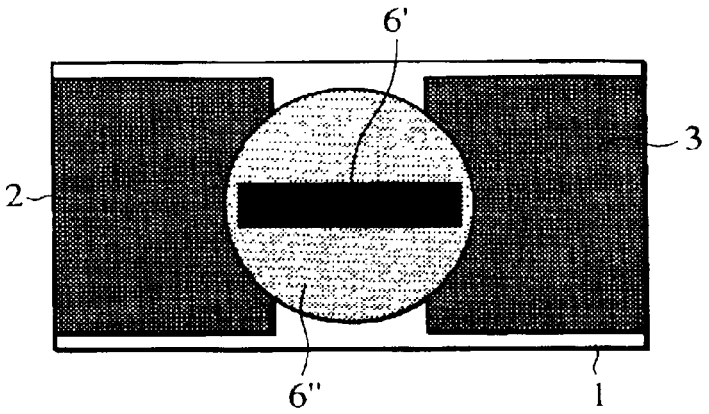
FIG. 5, consisting of FIGS. 5A to 5C, is a drawing showing another example of a resistance reducing step in a method of manufacturing a surface conduction type electron emitting device preferably used for an electron source of the present invention.
Figure 5B:
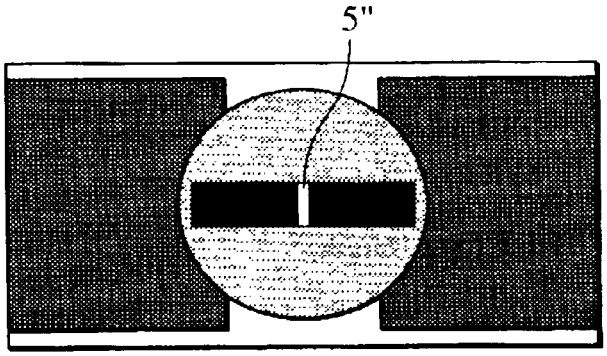
Figure 5C:
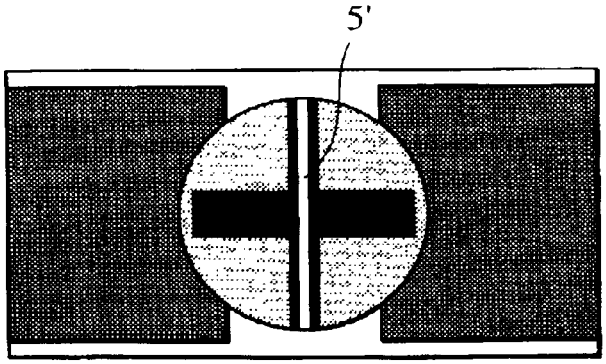

FIG. 5, consisting of FIGS. 5A to 5C, is a schematic drawing (plan view) showing the polymer film 6" in parallel with the substrate surface, in which the resistance is partially decreased. FIG. 5A shows the state before the voltage applying step, FIG. 5B shows the state immediately after the start of the voltage applying step, and FIG. 5C shows the state at the end of the voltage applying step.

First, in the voltage applying step, a current flows through the decreased-resistance region 6' to form a narrow gap 5" serving as a starting point of the gap 5' (FIG. 5B). Since the current flows avoiding the formed narrow gap 5" to heat the periphery of the narrow gap 5", the region which is not thermally decomposed is gradually thermally decomposed, and finally the gap 5' is formed over the entire region of the film 6' in substantially a parallel relationship with the substrate surface (FIG. 5C).

As described above, when the polymer film in a partially thermally decomposed state is used, good electron emission properties are exhibited in many cases. Although the reason for this is not known, the undecomposed polymer easily moves to the vicinity of the gap 5' due to thermal diffusion to form and hold the gap as favorable for electron emission, thereby obtaining a structure causing less deterioration due to driving.

Figure 6:
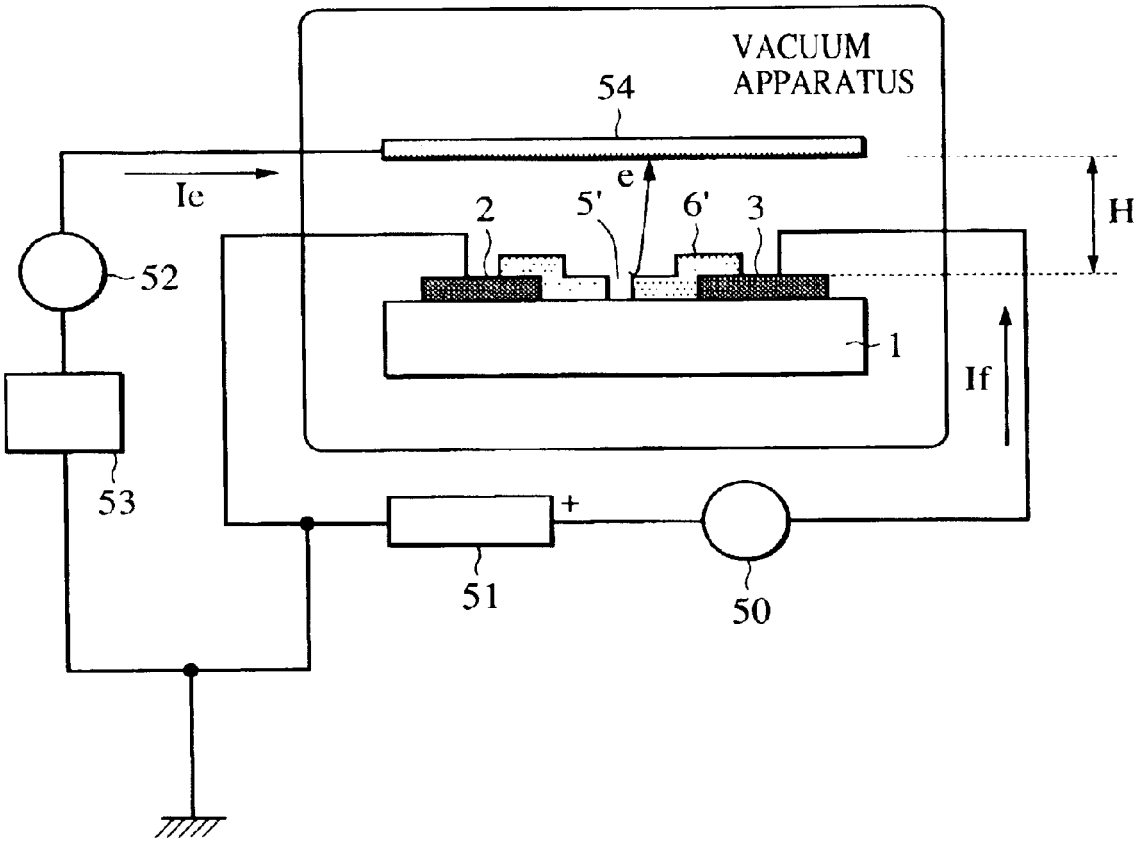
FIG. 6 is a schematic drawing showing an example of a vacuum apparatus having a measurement evaluation function.
Figure 7:
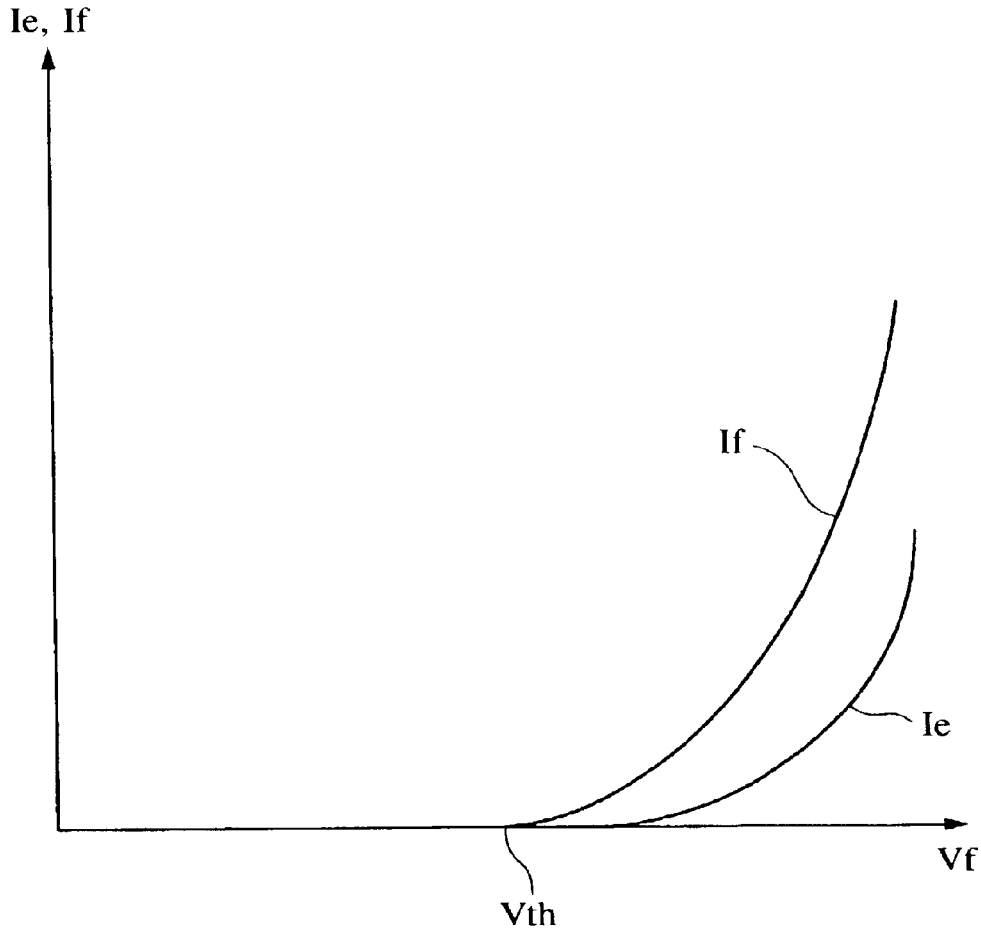
FIG. 7 is a schematic drawing showing the electron emission properties of a surface conduction type electron emitting device preferably used for an electron source of the present invention.

As a result of measurement of the voltage-current characteristics of the electron emitting device obtained through the above steps by the measuring apparatus shown in FIG. 6, the characteristics were as shown in FIG. 7. In FIG. 6, the members denoted by the same reference numerals as in FIG. 2 denote the same members. Reference numeral 54 denotes an anode, reference numeral 53 denotes a high-voltage power supply, reference numeral 52 denotes an ampere meter for measuring the emission current Ie emitted from the electron emitting device, reference numeral 51 denotes a power supply for applying a drive voltage Vf to the electron emitting device, and reference numeral 50 denotes an ampere meter for measuring the device current flowing between the electrodes 2 and 3. The electron emitting device has a threshold voltage Vth, and thus even when a voltage lower than the threshold voltage Vth is applied between the electrodes 2 and 3, substantially no electron is emitted. By applying a voltage higher than the threshold voltage Vth, the emission current (Ie) from the device and the device current (If) flowing between the electrodes 2 and 3 start to flow.

This characteristic enables the construction of an electron source comprising a plurality of the electron emitting devices arranged in a matrix on the same substrate, permitting a simple matrix driving system in which a desired device is selected for driving.

Next, an example of the method of manufacturing the image forming apparatus of the present invention shown in FIG. 1 by using the electron emitting device is described below with reference to FIGS. 8 to 15.

(A) First, the rear plate 1 is prepared. For the rear plate 1, an insulating material, such as glass, is preferably used.

Figure 8:
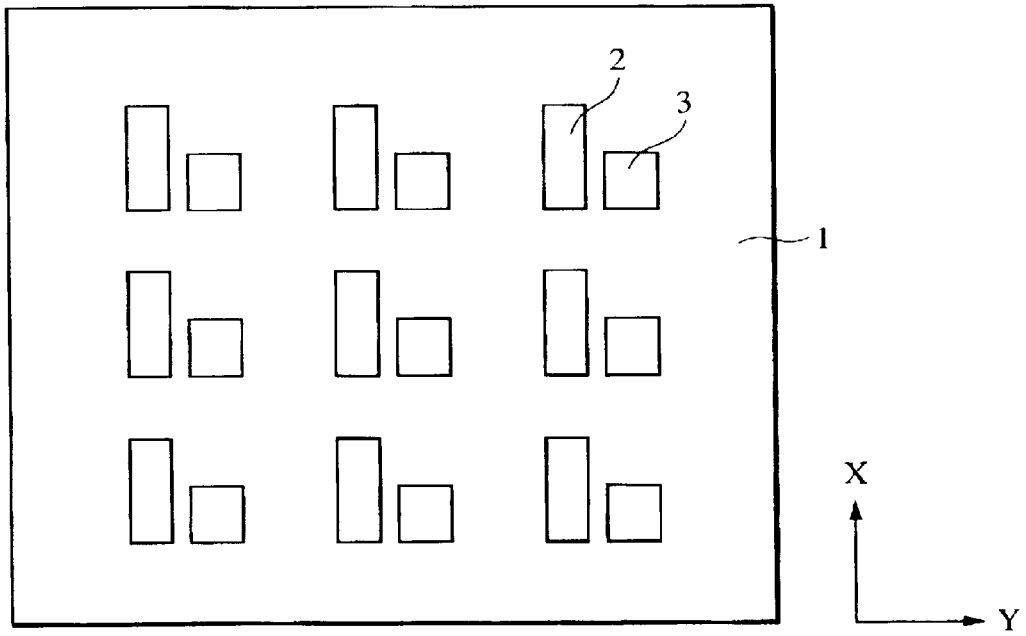
FIG. 8 is a schematic drawing showing a step for manufacturing a simple matrix arrangement electron source of the present invention.

(B) Next, plural pairs of the electrodes 2 and 3 shown in FIG. 2 are formed on the rear plate 1 (FIG. 8). As the electrode material, any one conductive material may be used. The electrodes can be formed by any of various production methods such as a sputtering method, a CVD method, a printing method, etc. In order to simplify this description, FIG. 8 shows an example in which a total of 9 pairs of electrodes, including three pairs in the X direction and three pairs in the Y direction, are formed. However, it should be noted that in other embodiments, the number of electrode pairs may be different, depending on the resolution desired to be obtained for the image forming apparatus.

Figure 9:
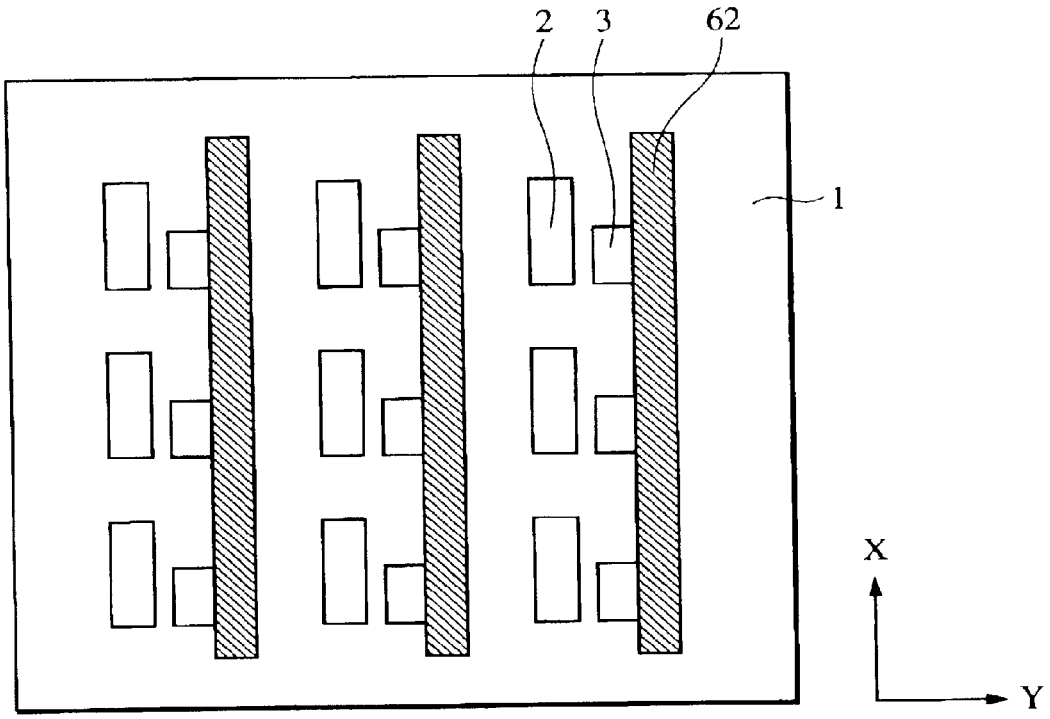
FIG. 9 is a schematic drawing showing a step performed after the step shown in FIG. 8.

(C) Next, lower wiring 62 is formed to partially cover the electrodes 3 (FIG. 9). Although the lower wiring 62 can be formed by any of various methods, the printing method preferably is used. Particularly, a screen printing method is preferred because the wirings 62 can be formed on a large substrate at low cost.

Figure 10:
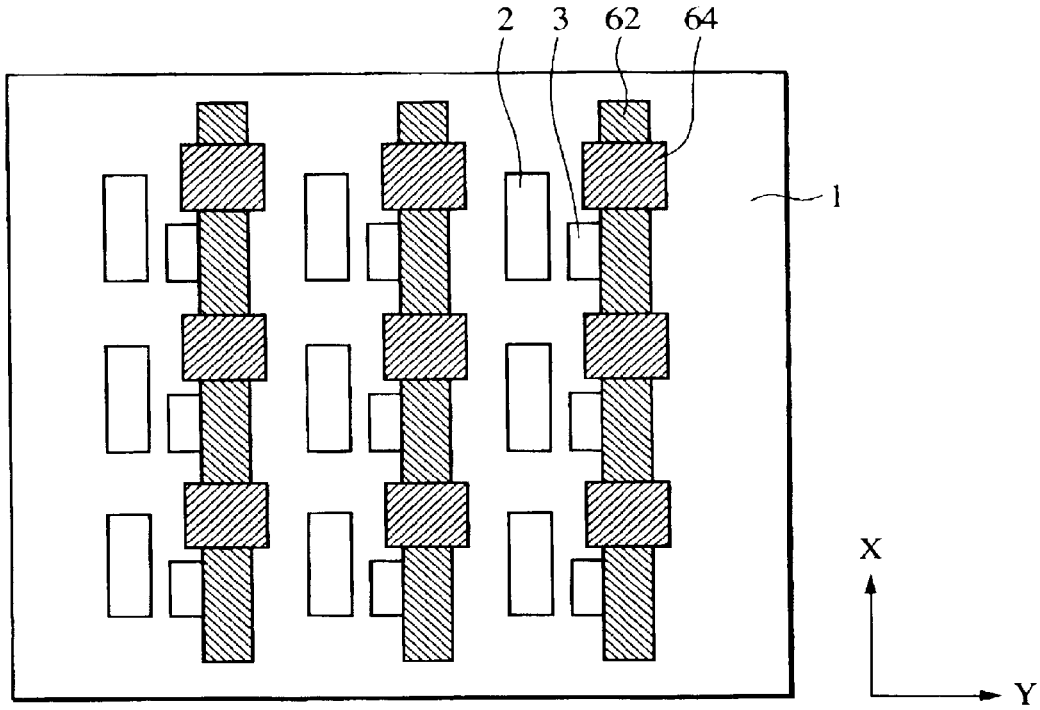
FIG. 10 is a schematic drawing showing a step performed after the step shown in FIG. 9.

(D) An insulating layer 64 (FIG. 10). The insulating layer 64 is formed at each of the intersections between the lower wirings 62 and the upper wirings 63 which are formed in a next step. Although the insulating film 64 also can be formed by any of various methods, the printing method preferably is used. Particularly, the screen printing method is preferred because the insulating film 64 can be formed on a large substrate at a low cost.

Figure 11:
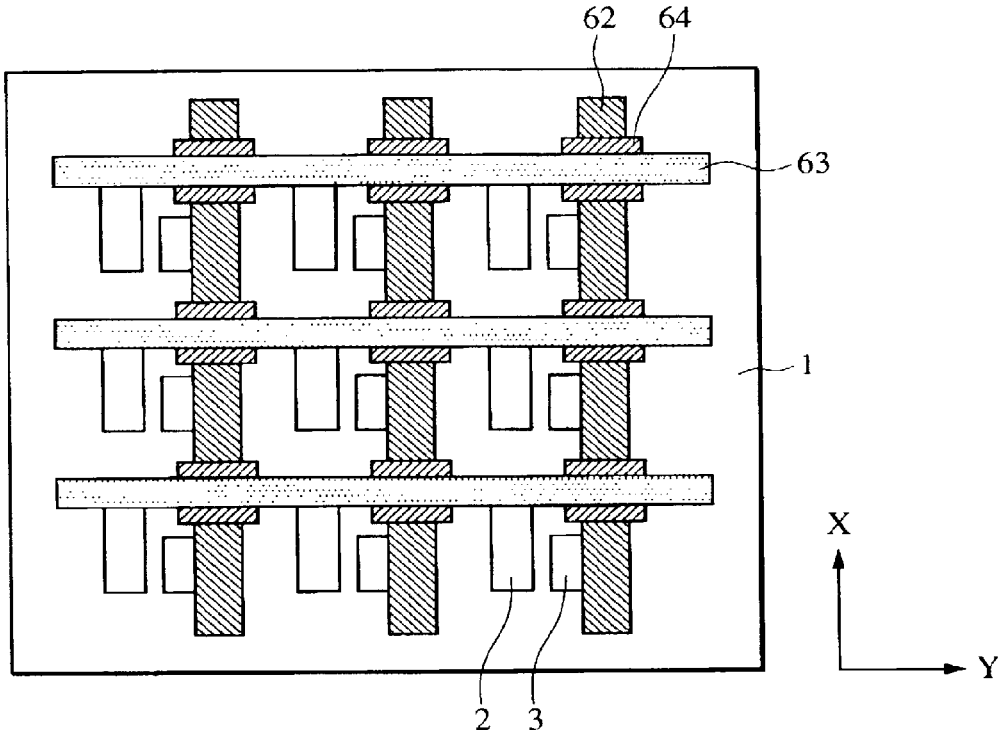
FIG. 11 is a schematic drawing showing a step performed after the step shown in FIG. 10.

(E) Next, the upper wirings 63 are formed to partially cover the electrodes 2 and substantially cross the lower wirings 62 at a right angle (FIG. 11). Although the upper wiring 63 also can be formed by any of various methods, like during the forming of the lower wirings 62, the printing method preferably is used. Particularly, the screen printing method is preferred because the upper wirings 63 can be formed on a large substrate at low cost.

Figure 12:
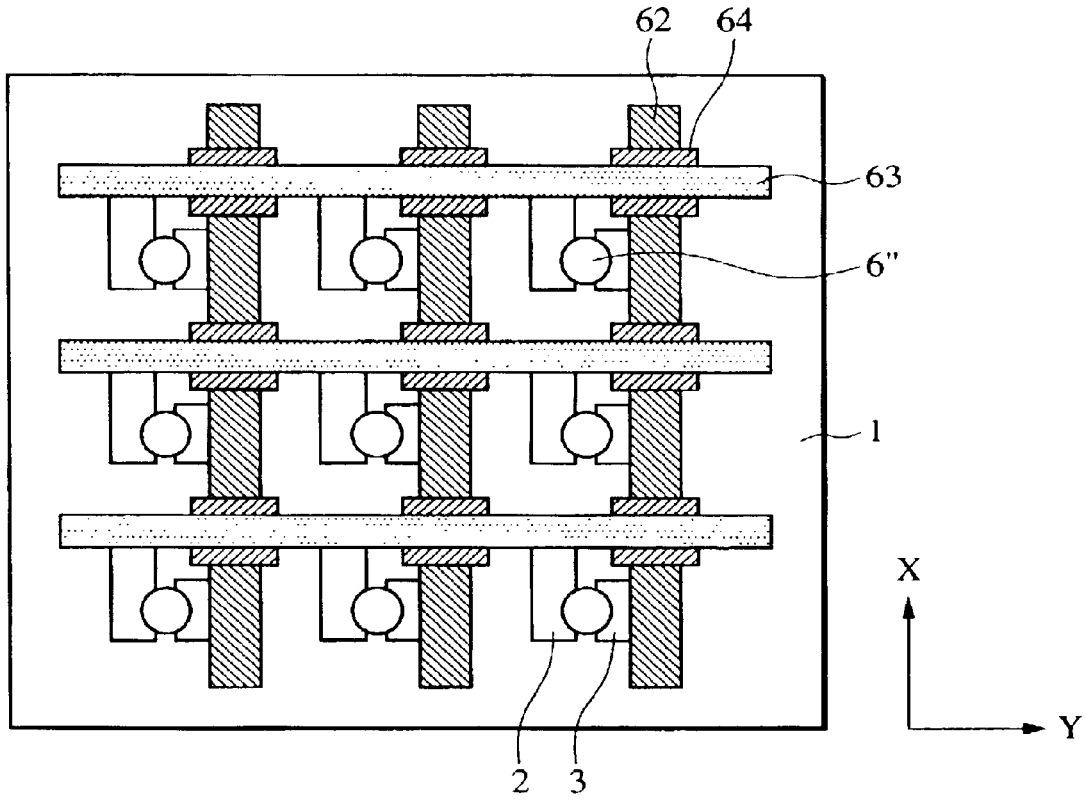
FIG. 12 is a schematic drawing showing a step performed after the step shown in FIG. 11.

(F) Next, the polymer film 6" is formed to connect each pair of the electrodes 2 and 3 (FIG. 12). As described above, the polymer film 6" can be formed by any one of various methods, but the ink jet method preferably is used for simply forming in a large area.

Figure 13:
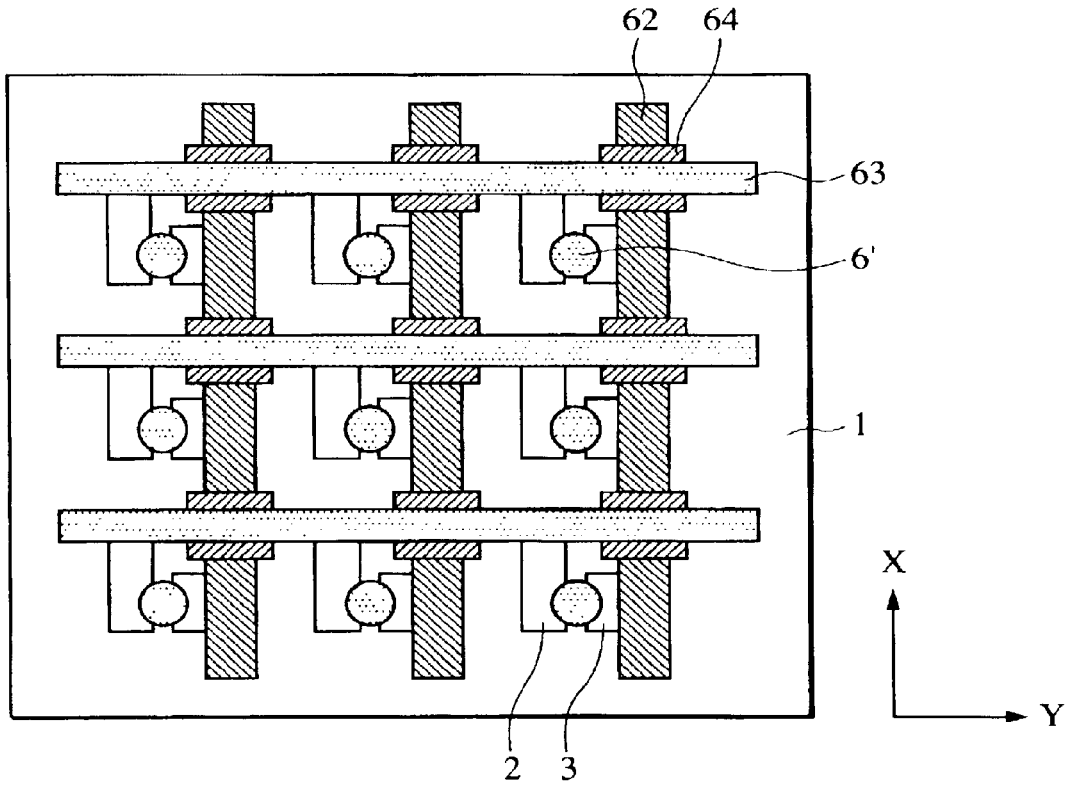
FIG. 13 is a schematic drawing showing a step performed after the step shown in FIG. 12.

(G) Then, as described above, the resistance decreasing step is performed for decreasing the resistance of the polymer film 6". In this step, the resistances the polymer films 6" in all units (each comprising the polymer film 6" and a pair of electrodes) are decreased. The resistance decreasing step is performed by irradiation with an energy beam (a particle beam) such as the electron beam or ion beam, or the laser beam. The resistance decreasing step is preferably performed in a low-pressure atmosphere. In this step, conductivity is imparted to the polymer films 6" to form the conductive films 6' (FIG. 13). Specifically, the resistance values of the conductive films 6' are in the range of $10^3$ Ω/□ to $10^7$ Ω/□.

Figure 14:
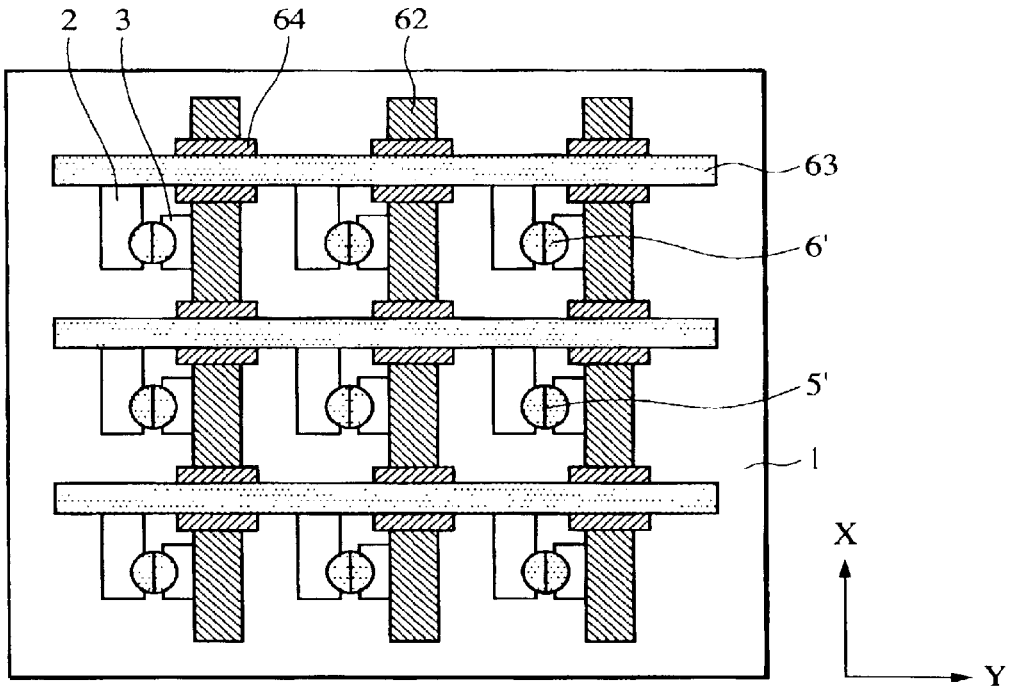
FIG. 14 is a schematic drawing showing a step performed after the step shown in FIG. 13.

(H) Next, the gap 5' is formed in each of the conductive films 6' (the decreased-resistance film) obtained by the step (G). The gaps 5' are formed by applying a voltage to the wirings 62 and 63. By applying the voltage to the wirings 62 and 63, the voltage is applied to each pair of electrodes 2 and 3. As the applied voltage, a pulse voltage is preferred. In the voltage applying step, the gap 5' is formed in each of the conductive films 6' (FIG. 14).

The voltage applying step may be performed at the same time as the resistance decreasing step. Namely, during irradiation with the electron beam or the laser beam, the voltage pulse may be continuously applied between the electrodes 2 and 3. In any event, the voltage applying step preferably is performed in a low-pressure atmosphere.

Figure 15A:
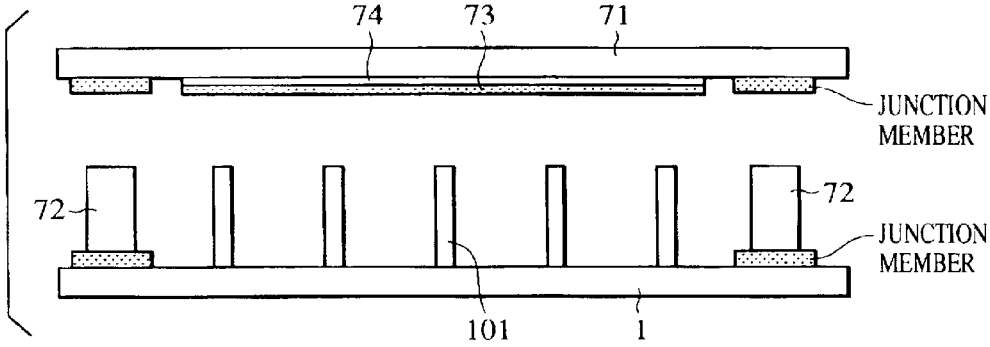
FIGS. 15A and 15B are schematic drawings respectively showing steps for manufacturing an image forming apparatus of the present invention.

(I) Next, the face plate 71 having the metal back 73 comprising an aluminum film and the fluorescent film 74 is aligned with the rear plate 1 passed through the steps (A) to (H) so that the metal back 73 faces the electron emitting devices (FIG. 15A). Furthermore, a bonding member is disposed between the opposing surfaces ("opposing region" or "sealing region") of the support frame 72 and the face plate 71. Similarly, a bonding member is also disposed between the opposing surfaces ("opposing region" or "sealing region") of the rear plate 1 and the support frame 71. As the bonding member, a member having the function to maintain a vacuum and an adhesive function preferably is used. Specifically, frit glass, indium or an indium alloy can be used.

Figure 15B:
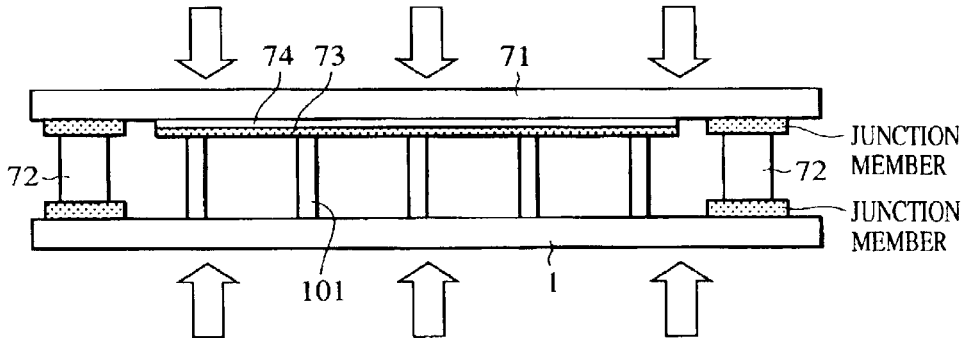

Although FIG. 15 (15A and 15B) shows an example in which the support frame 72 is fixed (bonded), with the bonding member, to the rear plate 1 previously passed through the steps (A) to (H), the support frame 72 is not necessarily joined in the step (I). Similarly, FIG. 15 shows an example in which the spacer 101 is fixed to the rear plate 1, but it also is within the scope of this invention for the spacer 101 to not be fixed to the rear plate in the step (I).

FIG. 15 shows an example in which for the sake of convenience, the rear plate 1 is positioned at a lower position, and the face plate 71 is disposed above the rear plate 1, but in other embodiments, either of both plates may be disposed above the other.

Furthermore, FIG. 15 shows an example in which the support frame 72 and the spacer 101 are previously fixed (bonded) to the rear plate 1, but in other embodiments, they may be mounted on the rear plate or the face plate so that they are fixed (bonded) in the next sealing step.

(J) Next, the sealing step is performed. At least the bonding member is heated while the face plate 71 and the rear plate 1, both of which are opposed to each other in the step (I), are pressed in opposite directions. In order to decrease thermal strain, the entire surfaces of the face plate 71 and rear plate 1 preferably are heated.

In the present invention, the sealing step is preferably performed in a low-pressure (vacuum) atmosphere or a non-oxidizing atmosphere. Specifically, the pressure of the low-pressure (vacuum) atmosphere preferably is $10^{-5}$ Pa or less, and more preferably $10^{-6}$ Pa or less.

In the sealing step, the face plate 71 and rear plate 1 are joined together with airtight butting portions therebetween to obtain an airtight container (image forming apparatus) 100 as shown in FIG. 1 in which a high vacuum is maintained.

Although, in this example, the sealing step is performed in a low-pressure (vacuum) atmosphere or non-oxidizing atmosphere, the sealing step may be performed in the air. In this case, an exhaust tube (not shown) is separately provided on the airtight container 100, for evacuating the space between the face plate 72 and rear plate 1 so that the airtight container 100 is evacuated to $10^{-5}$ Pa or less after the sealing step. Then, the exhaust tube is sealed to obtain the airtight container (image forming apparatus) 100 in which a high vacuum is maintained.

When the sealing step is performed in a vacuum, the step of depositing a getter material (not shown) on the metal back 73 (on the rear plate-side surface of the metal back 73) is preferably performed between the steps (I) and (J), in order to maintain the high vacuum in the image forming apparatus (airtight container) 100. In this case, as the getter material, an evaporation-type getter preferably is used for simplicity of depositing. Therefore, barium preferably is deposited on the metal back 73 to form a getter film. Like the step (J), the step of coating the getter is performed in a low-pressure (vacuum) atmosphere.

In the above-described example of the image forming apparatus, the spacer 101 is disposed between the face plate 71 and the rear plate 1. However, when the image forming apparatus is of a small size, the spacer 101 is not necessarily required. Also, if the gap between the rear plate 1 and face plate 71 is about several hundred $\mu$ms, the rear plate 1 and face plate 71 can be directly bonded together with the bonding member, without using the support frame 72. In this case, the bonding member functions as a substitute member for the support frame 72.

In this embodiment, the step (step (H)) of forming the gap 5' in the electron emitting device 102 is performed, and then the alignment step (step (I)) and the sealing step (step (J)) are performed. However, in other embodiments, the step (H) may be performed after the sealing step (step (J)).

(2) Examples of a "forming" method and means for providing an electron source and an image forming apparatus, each comprising many electron emitting devices, will now be described, according to this invention.

First, the above-described means (A-1) will be described.

Figure 17:
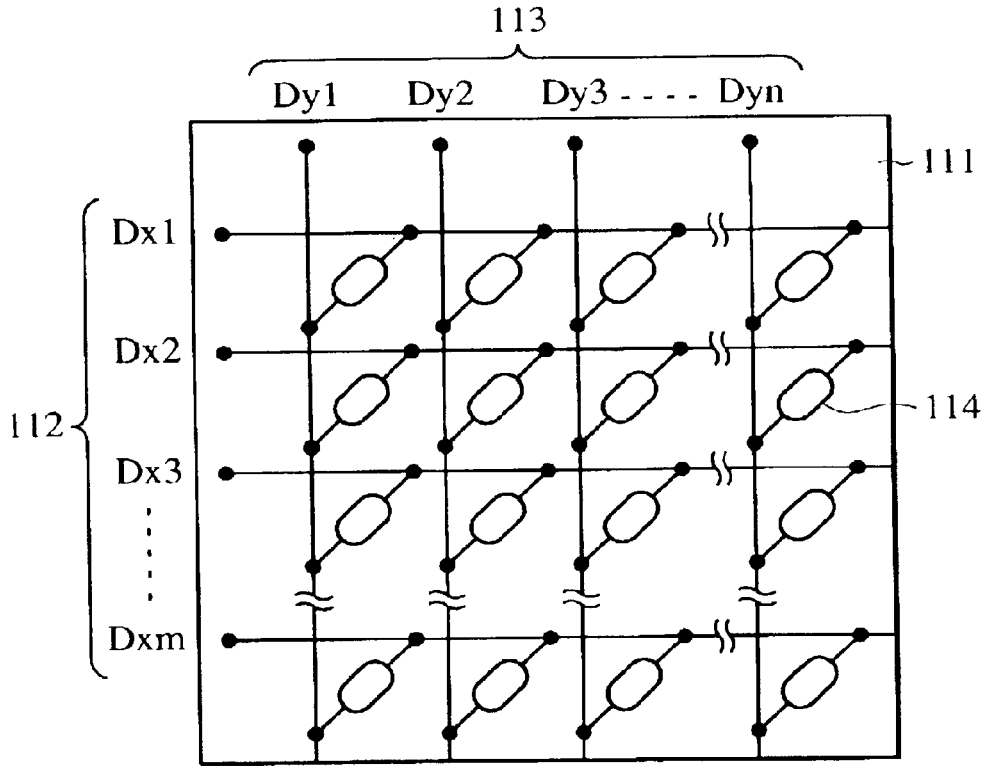
FIG. 17 is a drawing illustrating an example of a "forming" method for a simple matrix electron source of the present invention.

FIG. 17 shows a simple matrix arrangement electron source. In FIG. 17, devices 114 are connected by x-direction wirings 112 and Y-direction wirings 113. In the simple matrix arrangement electron source shown in FIG. 17, potential V2 (not shown in FIG. 17) is applied to all the wiring terminals Dx1 to Dxm in the X direction, a potential V1 (not shown in FIG. 17) different from potential V2 is applied to at least one Y-direction wiring terminal Dy1 to Dyn arbitrarily selected, and potential V2 is applied to all remaining wiring terminals in the Y direction. In this example, the voltage (V1−V2) [V] is applied to only the devices connected to the arbitrarily selected Y-direction wiring, and the voltage (V2−V2=0) [V] is applied to the other unselected devices for "forming". This step is repeated until "forming" is finished (referred to as "line forming").

This "forming" method prevents the electrodes of the unselected devices from being put into a floating (unstable potential) state or the voltage applied to the devices under "forming" from flowing through the matrix arrangement. Therefore, it is possible to prevent electrostatic breakage or damage to the devices other than the devices under "forming", and deterioration in the electron emission sections due to the influence of the voltage applied to the devices under "forming", thereby achieving uniform characteristics of the devices.

The potentials V1 and V2 are not necessarily limited to a constant potential (DC) which does not vary with time, and a pulse waveform such as a triangular or rectangular waveform may be used instead. Both or either of the potentials V1 and V2 may have a DC waveform or a pulse waveform. In this case, the voltage (V1−V2) [V] applied to the devices to be subjected to the "forming step" may have a voltage waveform sufficient to form the gap (electron emission section) by "forming". In the case of the pulse waveform, the voltage (V1−V2) [V] means the peak voltage.

In order to carry out the "forming step", one row or a plurality of rows (Y-direction wirings 113) may be arbitrarily selected. When a plurality of columns (X-direction wirings 112) are simultaneously selected, the temperature distribution of the substrate 111 is preferably made uniform in consideration of the influence of heat generated by "forming". For example, in the (m×n) matrix substrate shown in FIG. 17, when ten rows are simultaneously selected, the rows are preferably selected at intervals of INT(n/10). INT(n/10) is a function indicating a value obtained by rounding off n/10 to one decimal point.

When a plurality of rows are simultaneously selected, the time required for "forming" can be shortened, but a voltage source is required to have a great current capacity. Therefore, in this example, in consideration of the time required for "forming" and the current capacity of a voltage source, a number of columns most effective for economy purposes is preferably selected for parallel "forming".

Whether the X-direction wirings or the Y-direction wirings are selected for "line forming" is preferably determined as follows.

Figure 18:
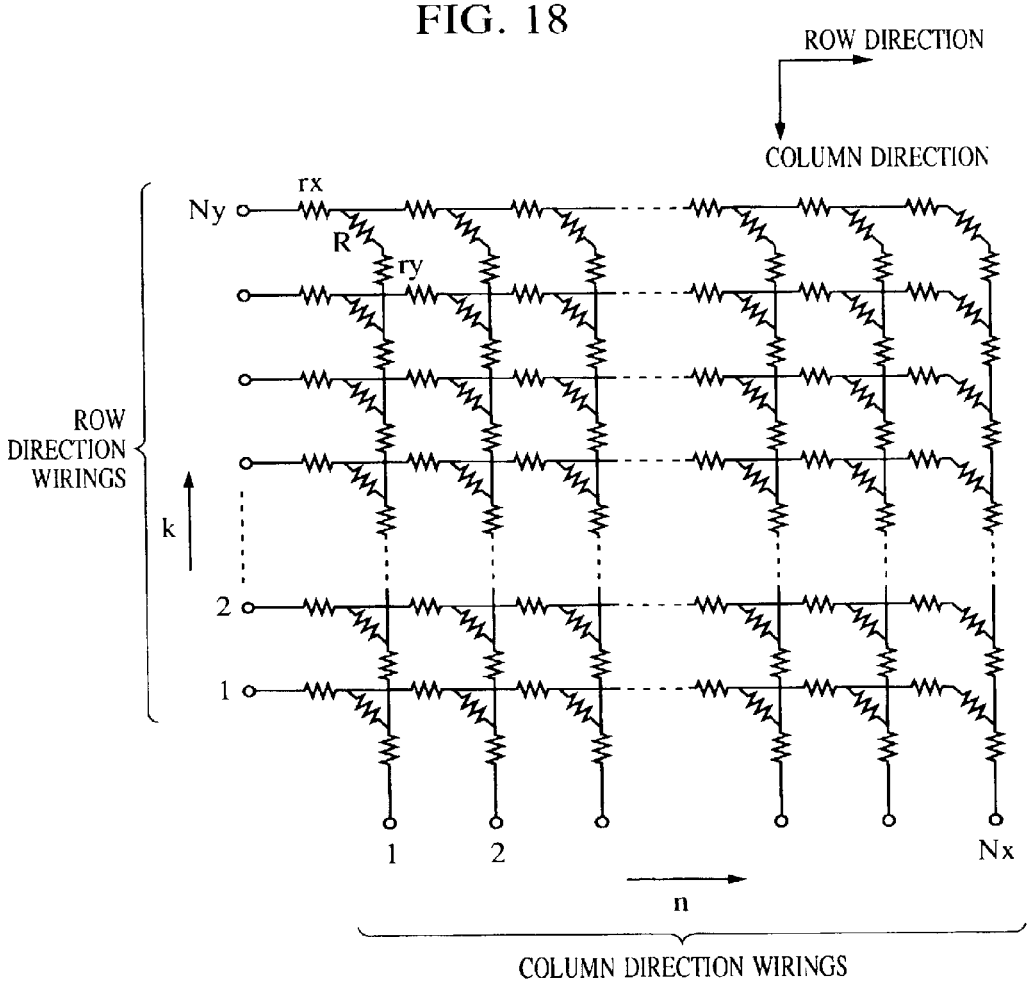
FIG. 18 is a drawing showing equivalent circuits of a display device using the electron source shown in FIG. 17.

FIG. 18 shows the equivalent circuits of a display device using a simple matrix arrangement electron source. In FIG. 18, R represents an electron emitting device resistance, and rx and ry each represent a lateral or longitudinal wiring resistance per pixel. Also, the number of devices in the lateral direction (the row direction) is Nx, and the number of devices in the longitudinal direction (column direction) is Ny. Also, "k" represents an arbitrary number selected from 1 to Ny, and "n" represents an arbitrary number selected from 1 to Nx. In the "forming step" of the electron source, one column direction wiring or one row direction wiring is subjected to batch "forming". Batch "forming" means "forming" in which electric power is supplied to many devices from a predetermined power supply section (one or a plurality of such sections), not necessarily "forming" in which many device are simultaneously subjected to the "forming step".

Figure 19:
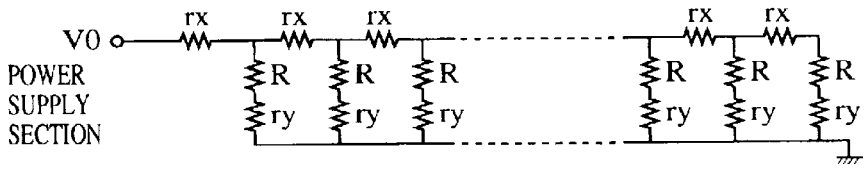
FIG. 19 is a circuit diagram illustrating "line forming" of a simple matrix arrangement electron source.

FIG. 19 is a circuit diagram schematically showing an equivalent circuit in "line forming". In FIG. 19, it is assumed that the impedance of wirings outside of the display device (panel) can be neglected as compared with rx, ry and R. FIG. 19 shows "line forming" in the lateral direction (line (wiring) k in FIG. 18 from the ground portion).

Figure 20:
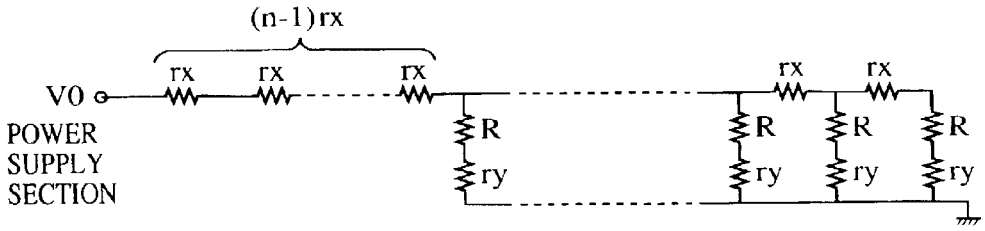
FIG. 20 is a circuit diagram illustrating "line forming" of a simple matrix arrangement electron source.

As seen from FIG. 19, when no variation occurs in the device resistance R and the wiring resistances rx and ry, the voltage applied to a device nearest to a power supply section is always maximum. The resistance of the devices after "forming" is 100 to 1000 times as high as the resistance R before "forming". Therefore, in "line forming", the devices preferably are successively cut (performed the "forming") from a power supply side to successively form gaps in a plurality of decreased-resistance films. FIG. 20 shows an equivalent circuit at the time of "forming" of a device n after devices up to device n−1 are cut (the gap 5' of device n−1 is formed). Namely, in this state, a device n nearest to a power supply section of the circuit is cut to form a ladder equivalent circuit comprising a number of devices that is one smaller than that shown in the circuit shown in FIG. 20. It should be noted that "n" represents an arbitrary number from 1 to Nx (shown in FIG. 18). In the state in which the devices of up to the device n−1 are cut, when a constant voltage $V_0$ is applied to the power supply section, the voltage applied to the device n in line k is represented by the following equation:

$$V(k, n)=\{1-k\times ry/R-n\times(Nx-n+1)\times rx/R\}V_0 \quad (1)$$

The voltage can easily be calculated by a general four-terminal matrix (N−n) step series according to the above equation. In this case, it is assumed that rx and ry are sufficiently smaller than R. The electric power applied to the device n is represented by the following equation:

$$P(k, n)=\{1-2\times k\times ry/R-2\times n\times(Nx-n+1)\times rx/R\}\times V_0\times V_0/R \quad (2)$$

Figure 21:
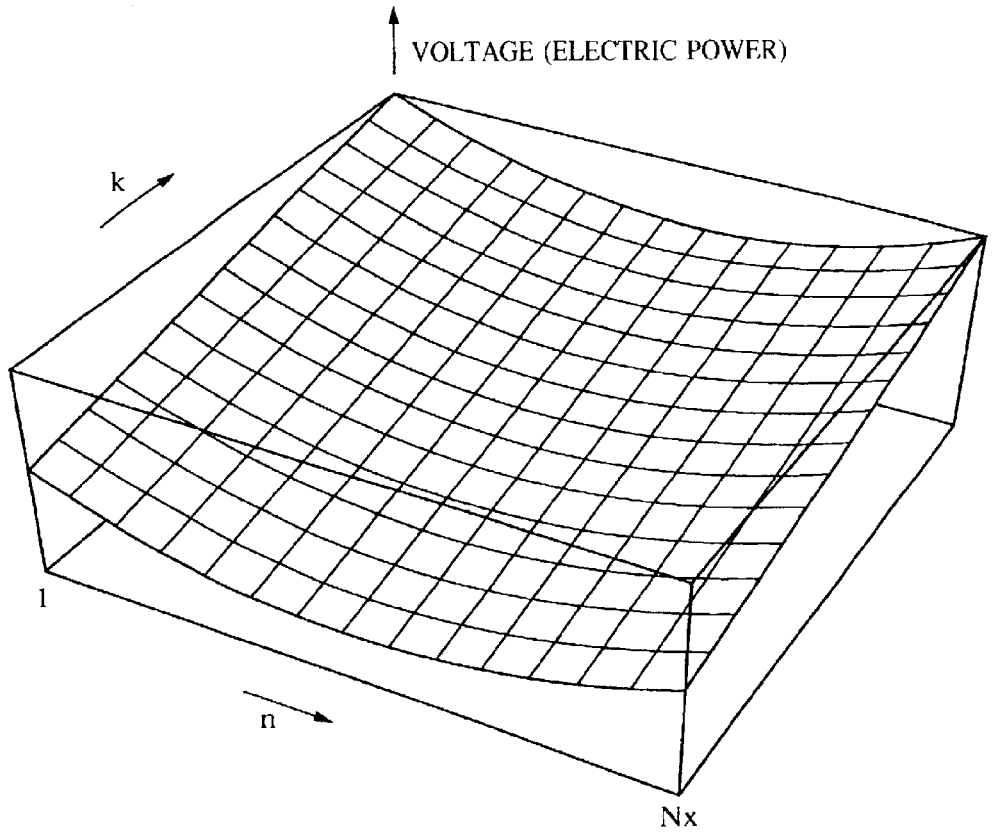
FIG. 21 is a drawing showing a voltage or power distribution in a panel in a "forming step" for a simple matrix arrangement electron source.

Namely, each of V and P is a function of k and n, and quadratically varies with device address n in the "line forming" direction and linearly varies with device address k in the other direction. FIG. 21 is a schematic drawing showing the voltage or power distribution in the panel.

The above-described "line forming" method has the following problems. Even when a constant voltage is applied to the power supply section, the voltage or electric power applied to the device for cutting the device (forming the gap in the carbon film) varies according to the address, as shown in FIG. 21. This phenomenon has a significant effect when the number of pixels increases or the wiring resistance is higher than the device resistance.

The difference between the maximum and minimum electric powers applied to the devices in the n direction immediately before the devices are cut is represented by the equation (3) below. Namely, the electric power is maximum at an end (n=1) nearest to a power supply, and minimum at the center (n=Nx/2). Assuming that $P_0=V_0\times V_0/R$, the following equation is established:

$$P(k, 1)-P(k, Nx/2)\sim Nx\times Nx/2\times(rx/R)\times P_0 \quad (3)$$

(wherein $Nx\geqq 1$)

Also, with respect to the difference between the maximum and minimum electric powers in the k wiring, the electric power is maximum at the end (k=1) nearest to a power supply, and minimum at the ground end (k=Ny). Therefore, the following equation is established:

$$P(1, n)-P(Ny, n)\sim 2\times Ny\times(ry/R)\times P_0 \quad (4)$$

(wherein $Ny\geqq 1$)

As seen from the above two equations, the differences between the "forming" conditions of the pixels rapidly increase as the number of the pixels in a "line forming" direction increases. Therefore, a significant adverse effect occurs in increasing the size of the screen.

In the example shown in FIG. 21, the power supply section is provided at an end in the row direction (or the column direction). However, when power supply sections are provided at both ends, the electric power applied immediately before each device is cut is maximum at both ends and the center in the row (or column) under batch "forming", and is minimum near the positions at a ¼ line length from both ends, thereby causing variations with the device address. Therefore, in order to generalize the power supply system, N' is newly introduced. In this case, in the case of one-side power supply, N'=N, and in the case of the both-side power supply, N'=N/2.

As a result, in "line forming" of the simple matrix, when a constant voltage $V_0$ is applied to the power supply section, the electric power applied to device n in wiring k is represented by the following equation:

$$P(k, n)=\{1-2\times k\times ry/R-2\times n\times(N'-n+1)\times rx/R\}P_0 \quad (5)$$

Therefore, the difference between the maximum power and the minimum power in the n direction is represented by the following equation:

$$\Delta P=N'\times(N'\times 2)(rx/R)\times P_0 \quad (6)$$

Also, the difference between the maximum and the minimum in the k direction is represented by the following equation:

$$\Delta P=2\times Ny\times(ry/R)\times P_0 \quad (7)$$

Figure 22A:
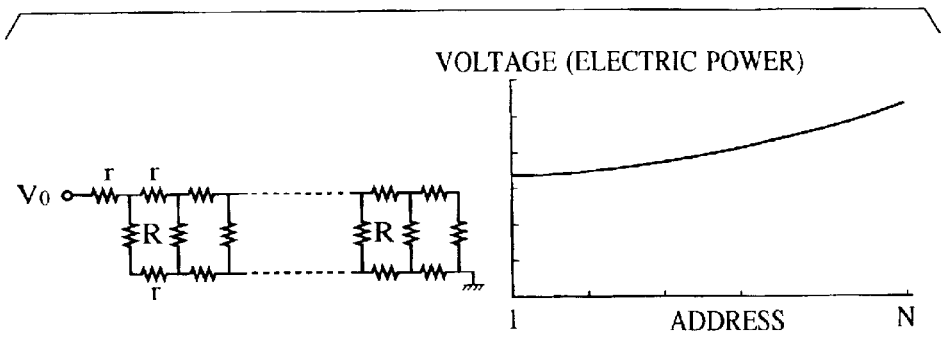
FIG. 22, consisting of FIGS. 22A to 22C, is a circuit diagram illustrating an example of a "forming" method for a ladder arrangement electron source.
Figure 22B:
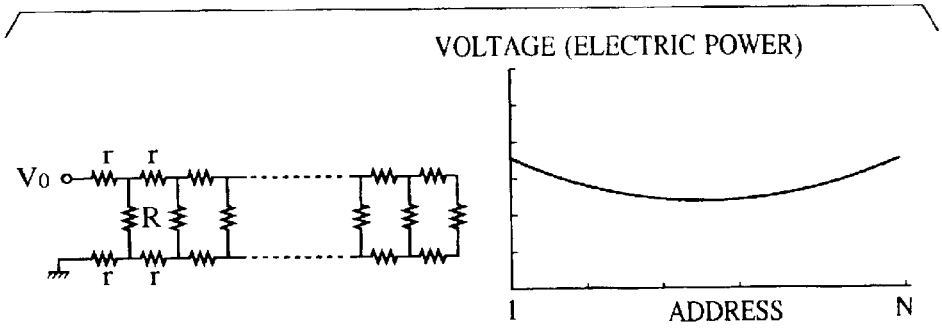
Figure 22C:
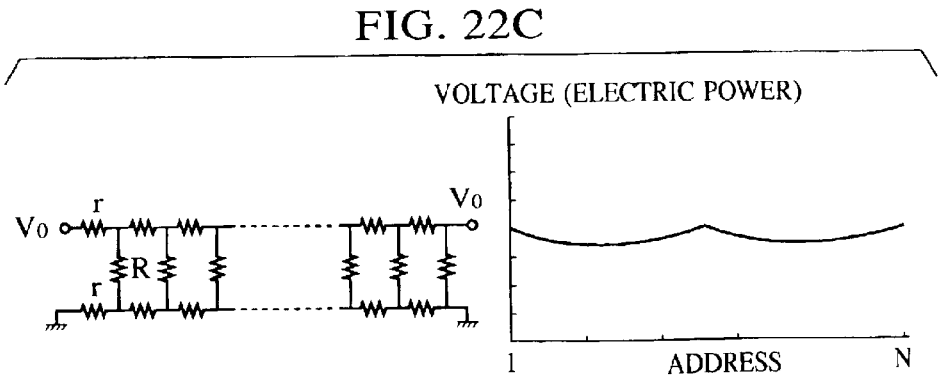

In the case of a both-side power supply, the condition for $n\leqq Nx/2$ can be applied to $n>Nx/2$. Furthermore, when the devices are arranged in a one-dimensional ladder shape, not in the simple matrix, the same problem as described above occurs. FIGS. 22A to 22C show examples, wherein the applied voltage immediately before each device is cut varies with the device address when a constant voltage is applied to the equivalent circuits and the power supply section. In each of the examples, the number of devices is n, the wiring resistance per device is r, and the device resistance is R.

FIG. 22A shows an example in which a power supply section is disposed at an end of a ladder-like line, and the ground portion is disposed at the other end. In this example, when voltage $V_0$ is applied to the power supply section, the electric power, applied at the time device n is cut after the devices of up to device n−1 are cut, is represented by the following function of n:

$$P(n)=\{1+(n\times n+n-N\times N-3\times N-2)\times(r/R)\}\times P_0 \quad (8)$$

(wherein $P_0=V_0\times V_0/R$)

Therefore, the difference between the maximum and minimum is represented by the following equation:

$$\Delta P=P(N)-P(1)=(N+2)\times(N-1)\times(r/R)\times P_0 \quad (9)$$

FIG. 22B shows an example in which the power supply section and the ground portion are disposed at a same side end of the ladder line, and FIG. 22C shows an example in which the power supply section and the ground portion are disposed at either end or both ends of the ladder line.

Like in the example shown in FIG. 22A, P(n) and ΔP are represented by the following equations:

$$P(n)=\{1-4\times n\times(N'-n+1)\times(r/R)\}\times P_0 \quad (10)$$

(wherein $P_0=V_0\times V_0/R$)

$$\Delta P=P(1)-P(N'/2)=N'\times N'\times(r/R)\times P_0 \quad (11)$$

In the case shown in FIG. 22B, N'=N, while in the case shown in FIG. 22C, N'=N/2 (n is considered symmetric with respect to N/2). As seen from these figures, even in the one-dimensional arrangement, even when the constant voltage is applied to the power supply section, the electric power applied immediately before each device is cut varies with the device address.

Therefore, in the "line forming" apparatus comprising the devices arranged in a two-dimensional form (matrix wiring form), the direction (row or column) in which variations in the electric powers applied to the devices can be decreased is preferably selected to perform "forming" for each line.

More specifically, assuming that the two-dimensional directions are x and y directions, the numbers of the devices in the respective directions are Nx and Ny, the wiring resistances per device in the respective directions are rx and ry, a=8 when the power supply section is disposed at one end of the x direction wiring or the y direction wiring, and a=24 when the power supply sections are disposed at both ends of the x direction wiring or the y direction wiring, "line forming" is preferably performed in the x direction and the y direction under the conditions represented by the following equations (12) and (13), respectively.

$$(Nx\times Nx-a\times Nx)\times rx\leqq(Ny\times Ny-a\times Ny)\times ry \quad (12)$$

$$(Nx\times Nx-a\times Nx)\times rx>(Ny\times Ny-a\times Ny)\times ry \quad (13)$$

In this way, the "forming" direction is determined by the electric power at the time each device is cut (the gap is formed).

The above equations of the conditions will be briefly described below.

"Forming" is considered as a thermal phenomenon, and thus the electric power applied to each device is a problem. First, equation (5) is described. Assuming that in "forming" in the x direction, r=rx, r'=ry, and Nx, and in "forming" in the y direction, r=ry, r'=rx and N=Ny, equation (5) is rearranged as follows:

$$P(k, n)=\{1-2\times k\times r'/R-2\times n\times(N-n+1)\times r/R\}P_0 \quad (14)$$

Therefore, when the power supply section is disposed at only one end in the x or y direction, the following equations are established by using the numbers Nx and Ny of the devices in the x and y directions, the device address (x, y)=(n, k), the device resistance R, and the wiring resistances rx and ry:

(1) Batch "forming" in the x direction

In the following equation (15), p is maximum when n=k=1, and minimum when n=Nx/2 and k=Ny.

$$P(k, n)=\{1-2\times n\times(Nx-n+1)\times(rx/R)-2\times k\times(ry/R)\}\times P_0 \quad (15)$$

In-plane maximum:

$$P(1, 1)/P_0=1-2\times Nx\times(rx/R)-2\times(ry/R) \quad (16)$$

In-plane minimum:

$$P(Nx/2, Ny)/P_0\sim 1-N\times Nx/2\times(rx/R)-2\times(ry/R) \quad (17)$$

In-plane variation:

$$Px=\{P(1, 1)-P(Nx/2, Ny)\}/P_0\sim(Nx\times Nx/2-2\times Nx)\times(rx/R)+2\times Ny\times(ry/R) \quad (18)$$

(2) Batch "forming" in the y direction

In the following equation (19), p is maximum when n=k=1, and minimum when n=N and k=Ny/2.

$$P(n, k)=\{1-2\times n\times(rx/R)-2\times k\times(Ny-k+1)\times(ry/R)\}\times P_0 \quad (19)$$

In-plane maximum:

$$P(1, 1)/P_0=1-2\times(rx/R)-2\times Ny\times(ry/R) \quad (20)$$

In-plate minimum:

$$P(Nx, Ny/2)/P_0_1-2\times Nx\times(rx/R)-Ny\times Ny/2\times(ry/R) \quad (21)$$

In-plane variation:

$$Py=\{P(1, 1)-P(Nx, Ny/2)\}/P_0_2\times Nx\times(rx/R)+(Ny\times Ny/2-2\times Ny)\times(ry/R) \quad (22)$$

Therefore, "forming" is preferably performed under the following conditions:

When $Px\leqq Py$, i.e., $(Nx\times Nx-8\times Nx)\times rx\leqq(Ny\times Ny-8\times Ny)\times ry$, batch "forming" is performed in the x direction, while when $Px>Py$, i.e., $(Nx\times Nx-8\times Nx)\times rx>(Ny\times Ny-8\times Ny)\times ry$, batch "forming" is performed in the y direction.

As shown in FIG. 22C, when the power supply sections are disposed at both ends in the x or y direction, in consideration of symmetry with respect to the center of the batch "forming" line, the conditional equations are set according to the relation between (Nx×Nx−24×Nx)×rx and (Ny×Ny−24×Ny)×ry.

As described above, the direction suitable for "forming" is determined by the relation between the wiring resistances and the numbers of the devices in the two directions. The waveform of the voltage applied for "forming" is the same as that in FIG. 16, and is appropriately set.

Next, the means (A-2) will be described.

Figure 23:
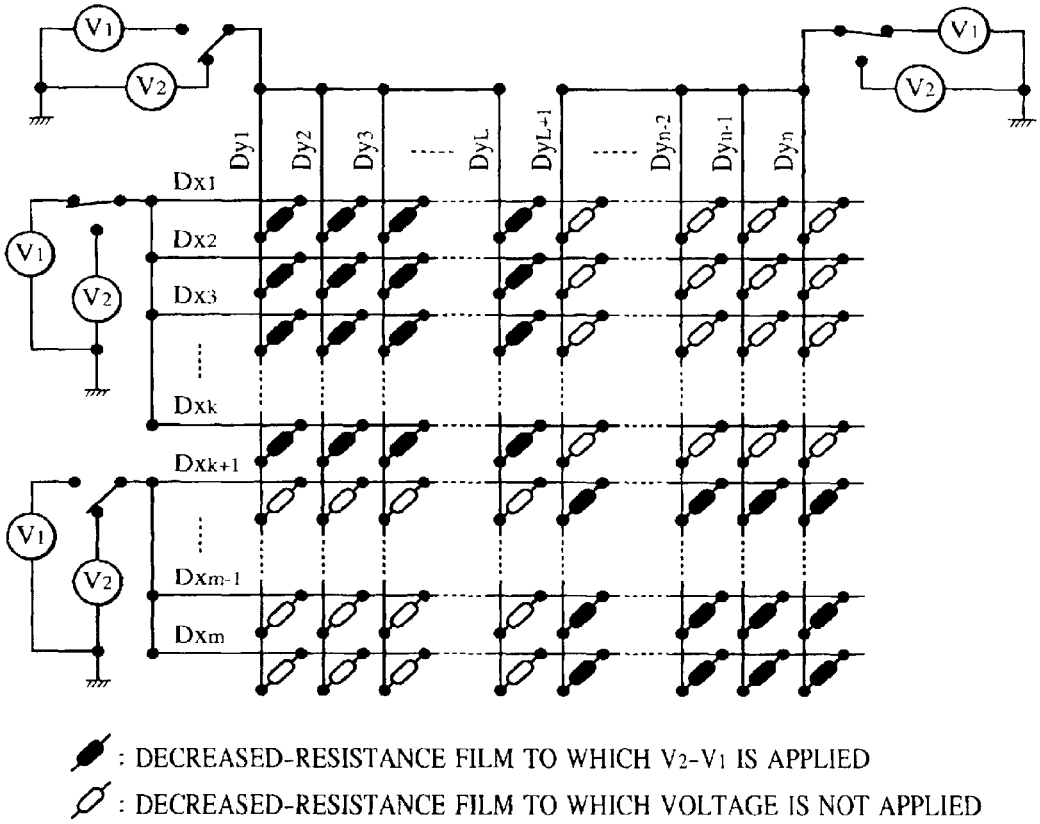
FIG. 23 is a drawing illustrating another example of a "forming" method for a simple matrix arrangement electron source of the present invention.

In the configuration shown in FIG. 23, "forming" power supplies (potential V1 or V2) are connected to row wirings (Dx1 to Dxm) and column wirings (Dy1 to Dyn) for "forming". In this case, potential V1 is applied to k wirings of all row wirings, and potential V2 is applied to the remaining (m−k) row wirings. Similarly, potential V2 is applied to L wirings of all column wirings, and potential V1 is applied to the remaining (n−L) column wirings. As a result, k×L+(m−k)×(n−L) devices of all devices are selected, and the voltage V2−V1 is applied between the device electrodes 2 and 3 shown in FIG. 2 to form the gap 5' in the film formed by decreasing the resistance of the polymer film.

Next, potentials V1 and V2 connected to the column-direction wirings (or the row-direction wirings) are reversed so that the devices remaining unselected are selected, and at the same time, "forming" is performed. The waveform of the voltage used for "forming" is the same as that in FIG. 16.

The means (A-2) is different from the means (A-1) in that "forming" in the means (A-1) is performed by the line unit (per line units), while "forming" in the means (A-2) is performed by the block unit (per block units). Like the means (A-1), the means (A-2) has the effect of preventing a flow of the voltage into devices which are not subjected to "forming", and halving the number of devices to which the "forming" voltage is simultaneously applied to decrease the current flowing through the wirings, thereby suppressing variations in the electron emitting properties due to a potential drop in the wirings.

Next, the means (B-1) will be described.

Figure 24A:
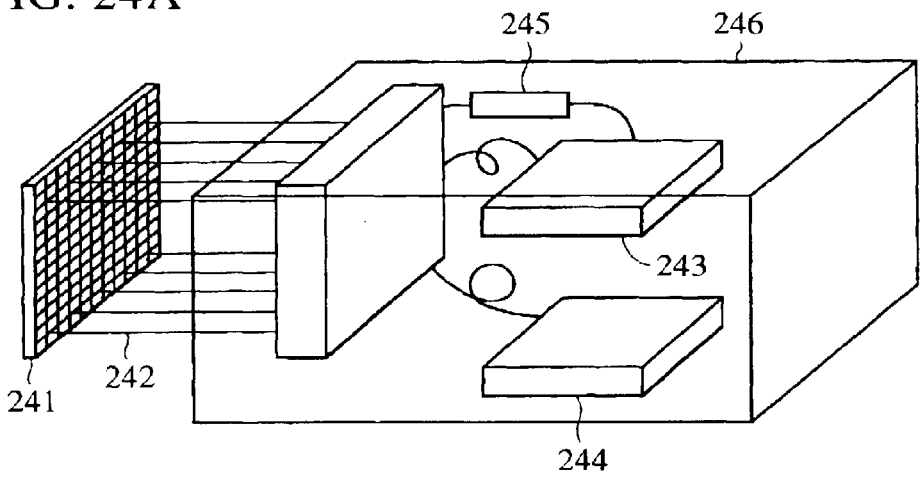
FIG. 24, consisting of FIGS. 24A to 24C, is a drawing illustrating still another example of a "forming" method for an electron source of the present invention.
Figure 24B:
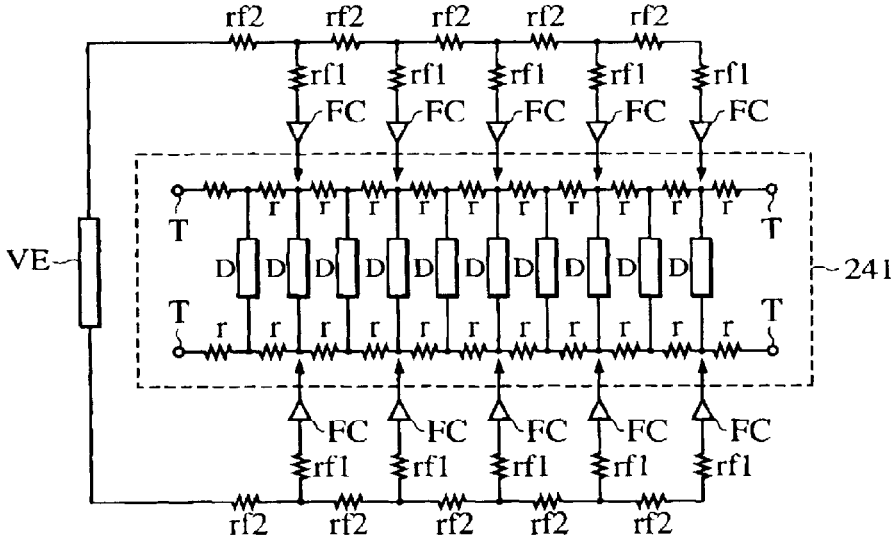
Figure 24C:
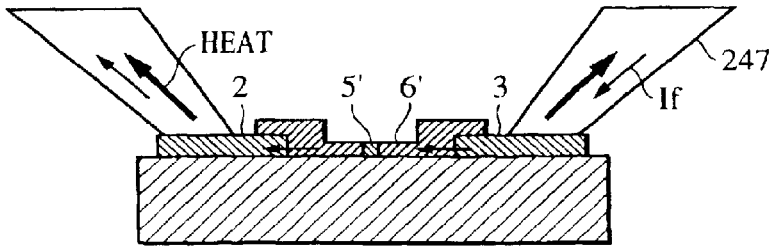

The manufacturing method is described with reference to a block diagram of FIG. 24A, a circuit diagram of FIG. 24B, and a sectional view of FIG. 24C showing one device.

In FIG. 24A, reference numeral 241 denotes a multi-electron source; reference numeral 242, an electrical connection means; reference numeral 243, a temperature controller; reference numeral 244, a "forming" power supply; reference numeral 245, a temperature detector; and reference numeral 246, an electrification device shown by solid lines. The multi-electron source 241 comprises a device comprising a plurality of the devices, the devices being connected by common wiring. The electrical connection means 242 comprises mechanisms FC for electrical connection at a plurality of positions of the devices arranged in parallel in the multi-electron source 241. As shown in FIG. 24B, the electrical connection means 242 is connected to each of the positions of the multi-electron source 241 through resistances rf1 and rf2. Unlike the common wiring of the devices (a thin film shape and a size limited to be contained in one pixel in an image forming apparatus), the shape of the electrical connection means 242 is not limited, the resistances rf1 and rf2 are sufficiently lower than the resistance r of the common wiring.

As shown in FIG. 24B, when a voltage is applied to the devices arranged in a line from the power supply VE through a plurality of connection portions, a potential drop due to resistance rf2 is significantly small because the small number of the parallel wirings, and the low resistance value, and thus the voltages applied to the connection portions of the common wiring are substantially the same. Also, the devices connected to each of the connection points are the same in number, and thus all parallel resistances are an equal value. As a result, variations in the voltages directly applied to the devices are significantly decreased as compared with the case of electrification using common wiring.

Furthermore, a material having high thermal conductivity preferably is used for connecting mechanisms FC, and a heating and cooling mechanism and a control mechanism (not shown in FIG. 24B) therefor are provided behind the connection mechanisms FC by using a material with a high heat capacity. Therefore, the connection mechanisms FC not only function to supply electricity to the devices but also function as a heat conducting passage, and thus have a function to change the temperature of the electron emission sections through the device electrodes.

FIG. 24C is a sectional view schematically showing the electrical connection portion of each device. In this figure, reference numerals 2 and 3 each denote the device electrode for achieving electrical connection, reference numeral 5' denotes the gap (electron emission section), reference numeral 6' denotes the film (carbon film) formed by decreasing the resistance of the polymer film, and reference numeral 247 denotes the electrical connection means serving as the heat conducting passage. Although FIG. 24C shows the electrical connection means 247 connected to the device electrodes, in other embodiments, the electrical connection means 247 may be connected to the wirings.

As the material for "forming" the electrical connection means 247, a metal such as copper, aluminum, indium, silver, gold, tungsten, molybdenum, or the like, or an alloy such as brass, stainless steel, or the like can be used. In order to decrease the contact resistance with the wirings to suppress a distribution of the contact resistances in a plurality of connection portions, connection means comprising a high-rigidity metal coated with a low-resistance metal is preferably provided, or each connection means preferably comprises a load-applying mechanism (not shown in the drawing) for applying a load of several tens of grams or more to the wiring in contact with the connection means. The load applying mechanism preferably comprises an elastic member, for example, a coil spring, a leaf spring, or the like.

The electrical connection means 247 is connected to one column or a plurality of columns of the matrix arrangement, for simultaneously performing "forming" for one column or a plurality of columns. Then, the all devices connected to the column which is connected to the connection means 247 is successively performed "forming" for all devices. By increasing the number of electrical connection means 247, "forming" of all devices can be performed at the same time.

Furthermore, in the simple matrix arrangement, when the electrical connection means 247 is provided on wirings below an insulating layer, contact holes are preferably formed at contact portions of the insulating layer, and the portions of the lower wirings in contact with the electrical connection means 247 are preferably coated with a low-resistance metal. By combining with the means (A-1), a plurality of electrical connection means 247 are provided on either the X-direction wirings or the Y-direction wirings (i.e., provided only on the wirings of the column selected for applying the "forming" voltage), and the voltage is applied to the unselected wirings in the same direction and the wirings in the other direction from terminals. In this case, a sufficient effect can be expected.

Although the "forming" means (A-1) is used in the simple matrix arrangement electron source described above, in other embodiments, the means (B-1) also can be applied to the ladder arrangement electron source.

In the above configuration, when the "forming" voltage is applied under cooling of the device electrodes, the film 6' formed by decreasing the resistance of the polymer film is heated by Joule heat of the "forming" current If to form a steep temperature profile, as compared with a conventional method. This is because heat generated from the device escapes more from the metal electrodes than it does from a quartz or glass substrate, and thus the efficiency of conductive escape of heat is significantly improved by cooling the metal electrodes through the connection means 247.

The inventors have discovered that the gap (electron emission section) 5' becomes formed at the peak of the temperature profile of the device due to electric heat.

It was conventionally thought that with an electrode spacing of 10 $\mu$m or more, the temperature profile becomes broad, thereby causing significant variations in the gaps (electron emission sections) 5'. Therefore, in this example, the temperature of the electrodes is controlled to a low temperature to make the temperature profile steep. This possibly decreases the variations in the performance characteristics of electron emission sections even when the electrode spacing is increased.

In fact, in "forming" under temperature control by the electrification method of this example, even when the electrode spacing is increased to 10 $\mu$m or more, the temperature profile of each film 6' obtained by decreasing the resistance of the polymer film is steep, and the peak is narrow. As a result, variations in the gaps (electron emission sections) 5' can be suppressed.

In the above configuration, the plurality of devices may be partially controlled to a predetermined temperature to solve the conventional problem of causing temperature differences between center and ends of a device of a multi-electron source, thereby decreasing the variations in the gaps (electron emission sections) 5' formed by "forming".

The means (B-2) will now be described.

First, a description will be made of a method of realizing a construction in which at least either of the row-direction wirings and column-direction wirings for connecting a plurality of devices in common are divided at predetermined intervals, and/or in which high-impedance portions are provided at predetermined intervals.

Figure 25:
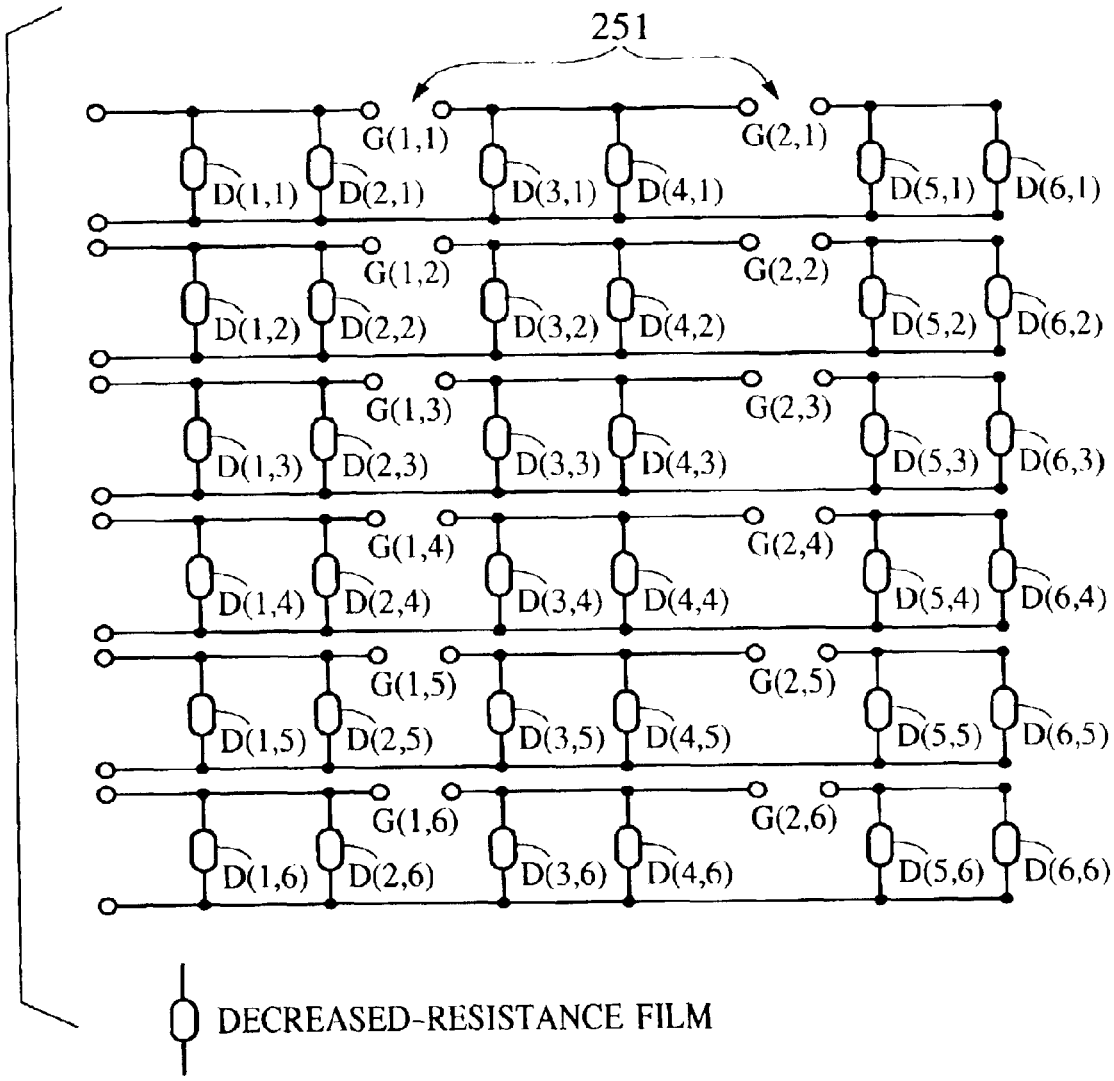
FIG. 25 is a diagram illustrating an example of "forming" of a ladder arrangement electron source of the present invention.
Figure 26:
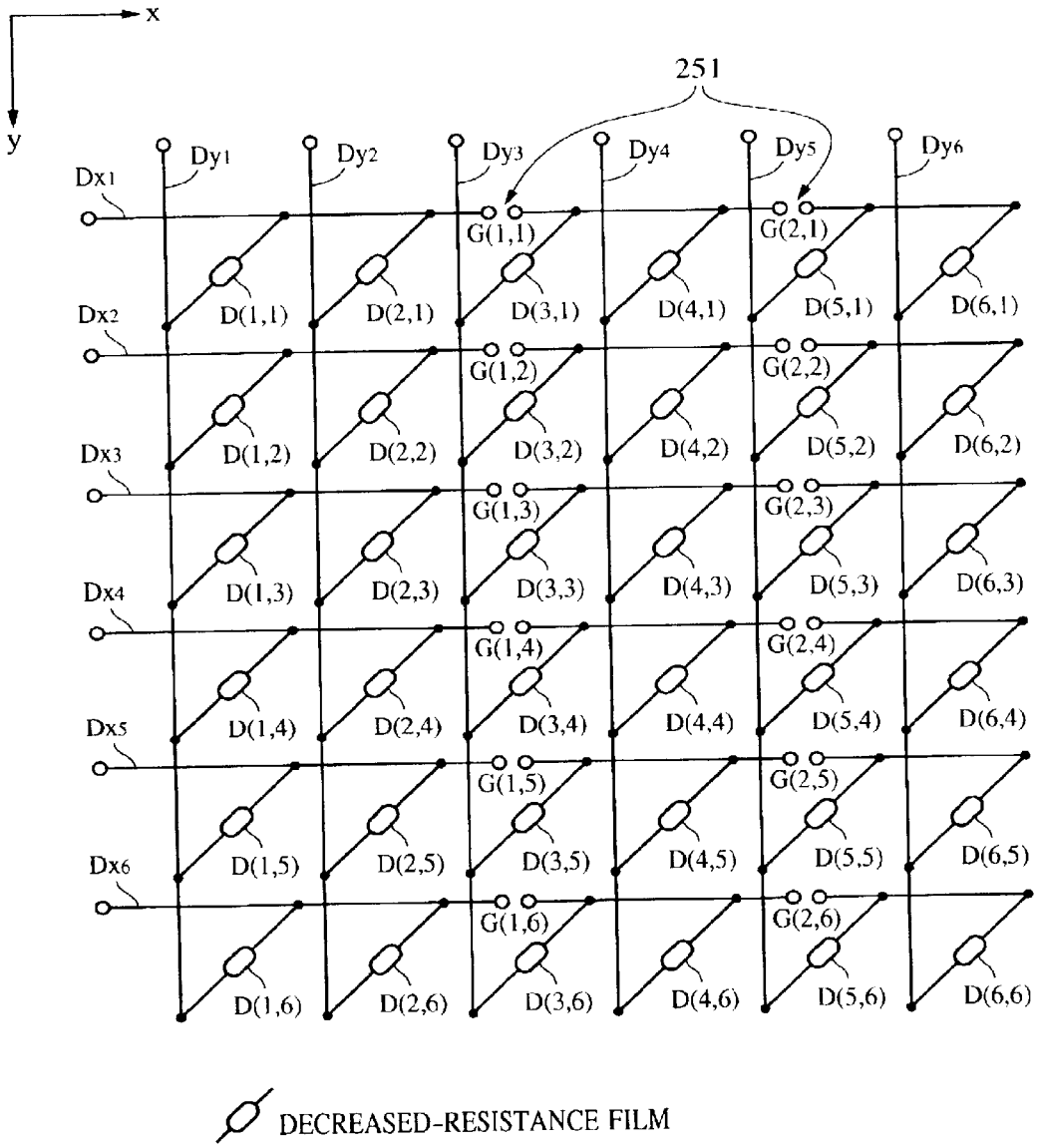
FIG. 26 is a diagram illustrating an example of "forming" of a simple matrix arrangement electron source of the present invention.

FIG. 25 and FIG. 26 show a ladder wiring arrangement and a simple matrix arrangement, respectively, in which wirings are partially divided. In both figures, reference numeral 251 denotes division gaps represented by G(1, 1) to G(2, 6). The wirings are formed by a known photolithography technique or a known printing technique. In any case, the wirings having division gaps at predetermined intervals can be obtained easily by pre-forming division gaps in a mask pattern. Of course, the wirings with the division gaps at predetermined intervals also can be obtained by melt-cutting a continuous wiring with a YAG laser or mechanically cutting a continuous wiring with a dicing saw.

The method of providing high-impedance portions is as follows. A thin film comprised of a high-resistivity metal such as a nickel-chromium alloy or the like is deposited on the division gaps obtained as described above, and then patterned to form the high-impedance portions. Alternatively, the high-impedance portions can be formed by partially narrowing the wiring width of a continuous wiring, or partially thinning a uniform wiring by a photolithography or milling technique.

Next, a current is supplied to a substrate (not shown in FIGS. 25 and 26) in this construction to apply the "forming" voltage to predetermined devices (as described above) to perform "forming". The current is supplied from a wiring end so that "forming" is first performed for a device in the divided region nearest to the wiring end. Also, the same means as the special electrical connection means used in the above-described means (B-1) preferably is used for supplying a current.

Next, a method of short-circuiting division gap portions or high-impedance portions after "forming" is performed for a predetermined portion.

A simple method comprises short-circuiting by wiring bonding or ribbon bonding using an Au or Al material. Other methods include a method in which a gold-lead paste or a low-melting-point metal including In or Bi is coated to form a film on one side of each of the gap portions, near each of the high-impedance portions or in a portion of each of the high-impedance portions by using a micro dispenser or photolithography. Then, the paste or low-melting-point metal is melted by heating by a laser beam or infrared irradiation or through heater heating so that the division gaps or the high-impedance portions are filled with the melted metal (not shown) to short-circuit (connect) these portions. Alternatively, a current is concentrated in the high-impedance portions to increase the temperature of the high-impedance portions, thereby obtaining the same results as the above-described heating method.

Next, the means (B-3) will be described.

A description is made of a batch "forming" method in which in batch "forming" for one row or one column, the voltage applied to the power supply section is controlled so that the applied electric power or applied voltage at the time of "forming" of each device is constant in all devices arranged in the sample matrix or one-dimensional ladder arrangement.

In consideration of the conventional problem of causing variations in the external terminal supplied with a voltage necessary for "forming", batch "forming" is performed by controlling the voltage applied to the power supply section while detecting devices in the row (or the column) under "forming", which have been subjected to "forming". In this case, constant "forming" conditions can be maintained for all devices.

In the two-dimensional matrix arrangement, when the power supply section is disposed at an end of the row (or column), the voltage applied to the power supply section for "forming" of the devices near both ends in the row (or column) under batch "forming" may be decreased, and the voltage applied to the power supply section for "forming" of the devices near the center may be increased. When the power supply sections are disposed at both ends of the row (or column), the voltage applied to the power supply section for "forming" of the devices near both ends and the center in the row (or column) under batch "forming" may be decreased, and the voltage applied to the power supply section for "forming" of the devices near the positions at a ¼ line length from both ends may be increased. When one or both ends of the column (or row) opposite to the row (or column) under batch "forming" are grounded, the voltage applied to the power supply section for batch "forming" of a row (or column) near the ground end may be decreased, and the voltage applied for "forming" of a row (or column) away from the ground end may be increased.

In the one-dimensional ladder arrangement, when the power supply section is disposed at an end of the ladder line, and the ground portion is disposed at the other end, the voltage applied to the power supply section for "forming" of the devices near the power supply section may be decreased, and the voltage applied to the power supply section for "forming" of the devices near the ground portion may be increased. When the power supply section and the ground portion are disposed at a same side end of the ladder line, the voltage applied to the power supply section for "forming" of the devices near both ends may be decreased, and the voltage applied to the power supply section for "forming" of the devices near the center of the line may be increased. When the power supply section and the ground portion are disposed at either end of the ladder line, the voltage applied to the power supply section for "forming" of the devices near the both ends and the center may be decreased, and the voltage applied for "forming" of the devices near the positions at a ¼ line length from both ends may be increased.

More specifically, for example, in "forming" of the devices at the device address (k, n) in the simple matrix, for example, in the x direction, in order to apply a uniform voltage to the devices in view of the voltage distribution represented by equation (1), voltage V0 (k, n) may be applied so as to satisfy the following equation (23):

$$V0(k, n)=C'\times\{1+k\times ry/R+n\times(N-n+1)\times rx/R\} \quad (23)$$

Figure 27:
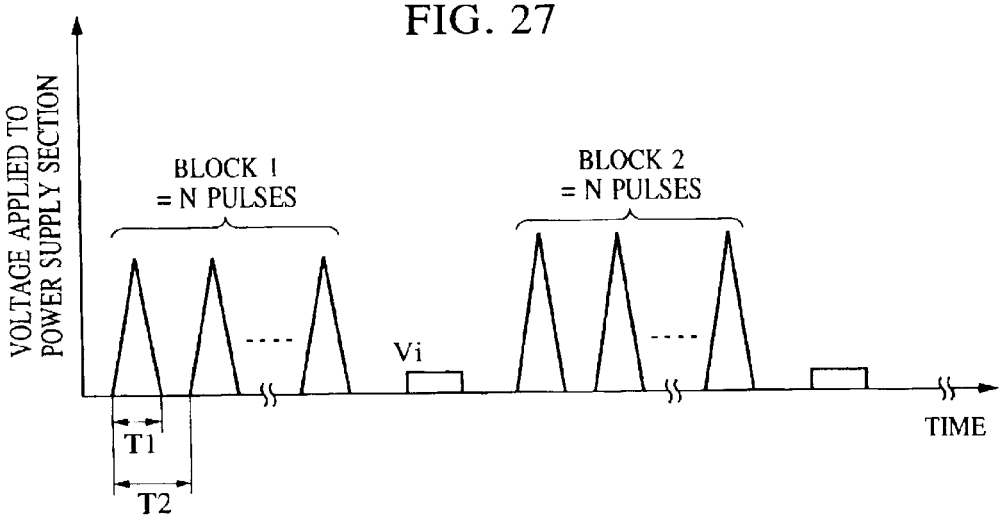
FIG. 27 is a diagram showing an example of applied "forming" pulses of an electron source of the present invention.

In this equation, C' is a constant which is experimentally determined to an optimum value. In order to detect the addresses of devices subjected to "forming", for example, the impedance between the power supply section and the ground portion may be measured. The impedance may be measured by inserting a lower voltage pulse than the "forming" pulses between respective blocks each comprising one or a plurality of "forming" pulses having a predetermined pulse height. FIG. 27 shows an example of an application of pulses. In this diagram, T1 is about 1 microsecond to 10 milliseconds, T2 is about 10 microseconds to 100 milliseconds, N is 1 to 100 pulses, and Vi is a voltage pulse of about 0.1 V for measuring impedance. Although FIG. 27 shows a triangular wave selected as a drive waveform, although the waveform is not limited to this configuration, and a rectangular or other shaped wave may be used instead.

With a small number of blocks (the number of impedance measurements), the algorithm of "forming" control easily can be performed to shorten the time required for "forming" over the entire line. On the other hand, with a large number of blocks, variations in "forming" conditions of devices can be suppressed. The method of applying the "forming" pulses, and the method of detecting device addresses are not limited to the above-described methods, and the detection of the device addresses become unnecessary under predetermined satisfactory conditions.

The method of performing "forming" in an electron source and an image forming apparatus, each comprising many devices, is described above. The "forming" method for more devices will be described below.

A description will first be made of a method in which many row and column wirings are simultaneously driven for films obtained by decreasing the resistance of polymer films connected by matrix wirings to shorten the time required for the "forming step".

As described above, when a voltage is applied to many matrix wirings, the substrate becomes possibly deformed or broken due to the heat generated by application of a voltage. This problem, and embodiments of the present invention, are described in detail below. First, the problem will be described.

Figure 28:
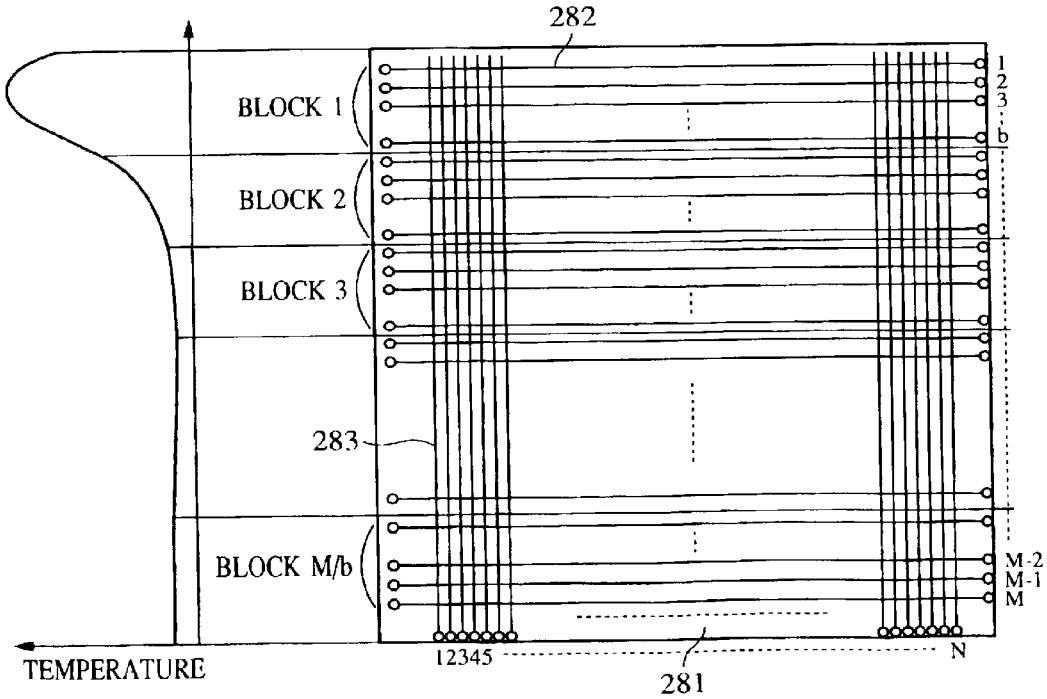
FIG. 28 is a diagram for illustrating a cause of deformation and breakage of a substrate during "forming".

The results of a study performed by the inventors with respect to the causes of deformation and breakage of a substrate are described with reference to FIG. 28. In FIG. 28, reference numeral 281 denotes an electron source substrate made of glass, reference numeral 282 denotes row-direction wirings (X direction wirings), and reference numeral 283 denotes column-direction wirings (Y direction wirings). Also, films formed by decreasing the resistances of polymer films are connected in a matrix by the row-direction wirings and column-direction wirings. In the electron source substrate having this construction, the row-direction wirings are divided into blocks 1 to M/b each consisting of b adjacent wirings so that the voltage is successively applied to the blocks.

In this voltage applying method, heat generated by the current, i.e., the "forming" current flowing through the films formed by decreasing the resistances of the polymer films, is concentrated in a block of wirings to which the "forming" voltage is applied, thereby causing a steep temperature gradient in the substrate. FIG. 28 also shows an example of the steep temperature gradient produced in the substrate when the "forming" voltage is applied to a block 1. Such a steep temperature gradient in the substrate causes the occurrence of thermal stress, thereby causing deformation or breakage of the substrate 281. In the present invention, the row-direction wirings or the column-direction wirings can be selected so as to avoid the occurrence of a heat distribution in the substrate 281.

The inventors have discovered that the substrate 281 can become deformed by simultaneously driving many adjacent wirings, and that the above problem can be solved by limiting the number of the row-direction wirings (or column-direction wirings) which are driven at the same time, or by thinning out the row-direction wirings (or column-direction wirings) that are driven at the same time. Aspects of this invention relating to this discovery will be described in detail below with reference to the embodiments of the present invention.

EMBODIMENTS

The preferred embodiments of the present invention are described in detail below with reference to the attached drawings. The embodiments relate to an electron source and a method of manufacturing the same, and an image forming apparatus using a plurality of the electron sources.

First Embodiment

In this embodiment, a simple matrix arrangement electron source comprises many devices formed by the means (A-1).

Figure 29:
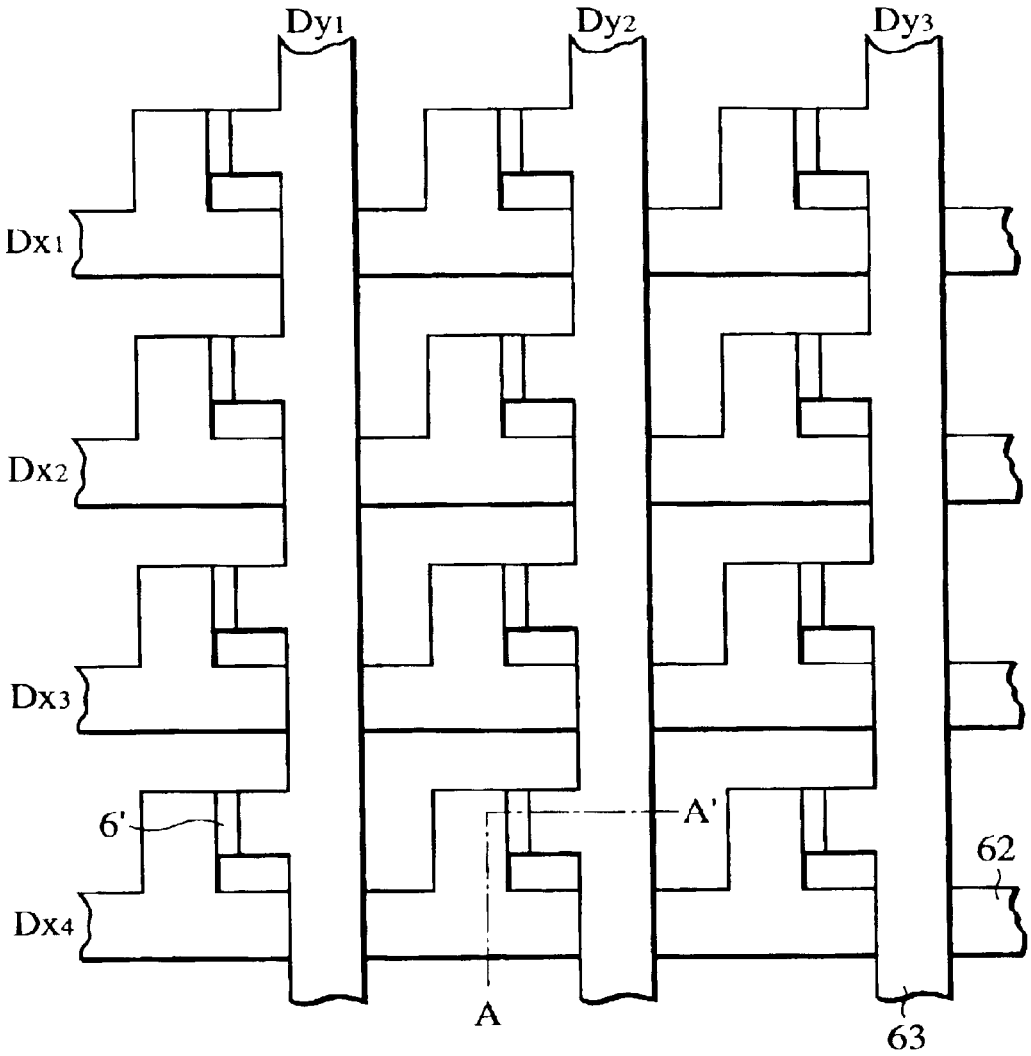
FIG. 29 is a plan view showing a portion of an electron source according to a first embodiment of the present invention.
Figure 30:
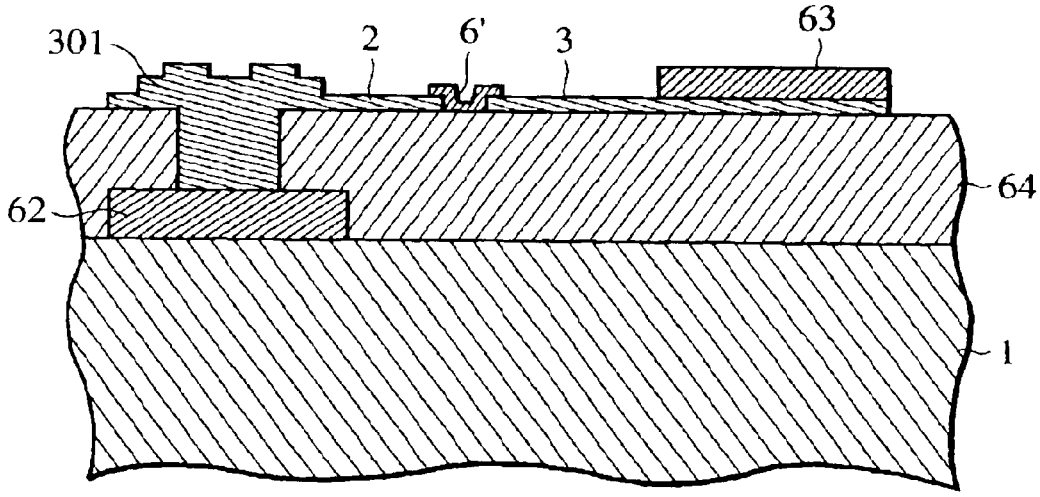
FIG. 30 is a sectional view showing a portion of the electron source according to the first embodiment of the present invention.

FIG. 29 is a plan view showing a portion of an electron source, and FIG. 30 is a sectional view taken along line A–A' in FIG. 29. In FIGS. 29 and 30, the same reference numerals denote the same members. In these figures, reference numeral 1 (FIG. 30) denotes a substrate, reference numerals 2 and 3 (FIG. 30) each denote an device electrode, reference numeral 6' denotes a film (carbon film) having a gap, reference numeral 62 denotes an X-direction wiring (referred to as a "lower wiring"), reference numeral 63 denotes a Y-direction wiring (referred to as an "upper wiring"), reference numeral 63 denotes an interlayer insulating layer, reference numeral 301 a contact hole for electrically connecting the device electrode 2 and the lower X-direction wiring 62.

The method of preparing an electron emitting device is first described in detail below with reference to FIGS. 8 to 14. In these drawings, for the sake of simplification of description, only nine devices are shown. However, in this embodiment, 300×200 devices are actually arranged in a matrix, or some other suitable number of devices also may be provided.

(Step 1)

A Pt film is deposited to a thickness of 100 nm on a glass substrate 1 by sputtering, and then is patterned by photolithography to form the electrodes 2 and 3 each comprising a Pt film (FIG. 8). The spacing between the electrodes 2 and 3 is 10 $\mu$m.

(Step 2)

Next, Ag paste is printed by screen printing, and then burned by heating to form the X-direction wirings 62 (FIG. 9).

(Step 3)

Then, an insulating paste is printed at intersections of the X-direction wirings 62 and the Y-direction wirings 63 by screen printing, and burned by heating to form insulating layers 64 (FIG. 10).

(Step 4)

Furthermore, Ag paste is printed by screen printing, and burned by heating to form the Y-direction wirings 63, thereby forming matrix wirings on the substrate 1 (FIG. 11).

(Step 5)

In the matrix wirings formed on the substrate 1 as described above, a 3% N-methylpyrrolidone/triethanolamine solution of polyamic acid as a polyimide precursor is coated between the electrodes 2 and 3 by an ink jet method to partially overlap with the electrodes 2 and 3 with a center positioned therebetween. The coating is baked at 350° C. in a vacuum to form the films 6", each comprising a circular polyimide film having a diameter of about 100 $\mu$m and a thickness of 300 nm (FIG. 12).

(Step 6)

Next, the substrate 1 on which the Pt electrodes 2 and 3, the matrix wirings 62 and 63 and the polymer films 6" (each comprising a polyimide film) are formed, is set on a stage (in air), and each of the polymer films 6" is irradiated with a second harmonic (SHG) of Q switch pulse Nd: YAG laser (pulse width 100 nm, repetition frequency 10 kHz, a beam diameter 10 $\mu$m). In this step, the stage is moved in a direction from the electrode 2 to the electrode 3 to irradiate a width of 10 $\mu$m of each polymer film 6", to form a conductive region in which thermal decomposition proceeds in each of the polymer films 6", thereby obtaining film 6' formed by decreasing the resistance of each polymer film 6" (FIG. 13).

(Step 7)

Figure 31:
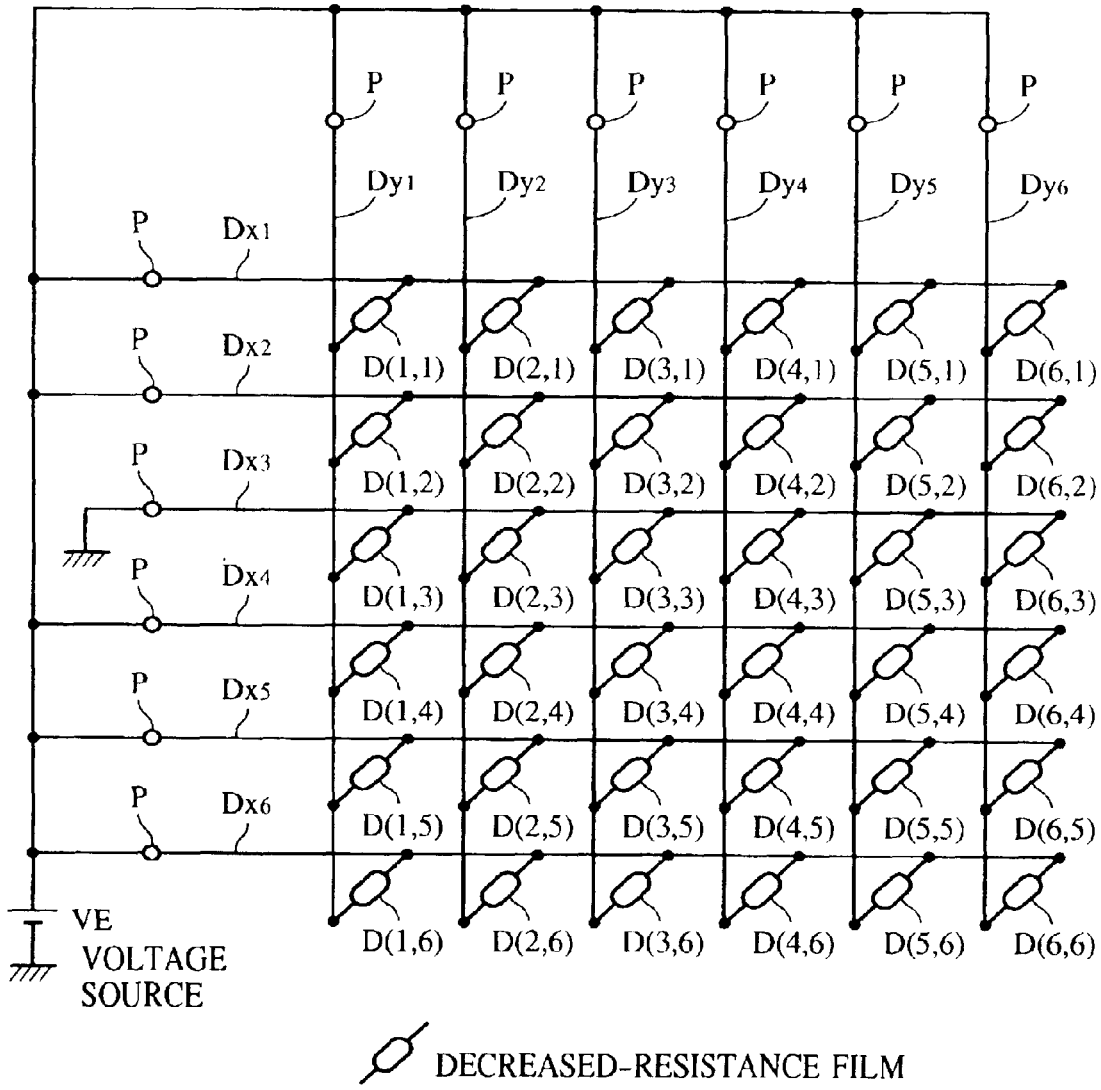
FIG. 31 is a diagram illustrating a "forming" method in the first embodiment of the present invention.

FIG. 31 is a diagram showing electrical connections for "forming" in a portion of a device group, for explaining this embodiment. For the sake of convenience, this diagram shows a simple matrix arrangement of 6×6 devices, although in this embodiment, a matrix of 300×200 devices preferably is formed.

In FIG. 31, for the sake of convenience of description, the devices are represented by (X, Y) coordinates such as D(1, 1), D(1, 2), . . . , D(6, 6) in order to discriminate between the devices. In the diagram, Dx1, Dx2, . . . , Dx6 each denote a wiring of the simple matrix wirings, the wirings being electrically connected to outside through terminals P. In this diagram, VE denotes a voltage source having the ability to produce a voltage necessary for "forming" of conductive films (films formed by decreasing the resistance of the polymer films).

FIG. 31 shows the method of applying a voltage to 300 devices of D(1, 3), D(2, 3), D(3, 3), D(4, 3), D(5, 3), D(6, 3), . . . , D(300, 3), for simultaneous "forming". As shown in the diagram, the ground level, i.e., 0 [V] is applied to wiring Dx3, and for example, a potential of 6 V is applied to the wirings other than wiring Dx3, i.e., wirings Dx1, Dx2, Dx4, Dx5, Dx6, . . . , Dx200 from the voltage source VE. At the same time, a potential is applied to wirings Dy1, Dy2, Dy3, Dy4, Dy5, Dy6, . . . , Dy300 from the voltage source VE.

As a result, the output voltage of the voltage source VE is applied to both ends of each of the selected devices D(1, 3), D(2, 3), D(3, 3), D(4, 3), D(5, 3), D(6, 3), . . . , D(300, 3) of the plurality of devices arranged in a matrix to perform "forming" for these 300 devices in parallel.

On the other hand, in the devices other than the 300 devices (the other devices previously non-selected), an equal potential (output potential of the voltage source VE) is applied to both ends of each of the devices, and the voltage applied across both ends of each device is substantially 0 [V]. Therefore, "forming" is not performed for those devices, and the device films are neither deformed nor broken.

In this embodiment, the resistance of each device is about 1 kilo-ohm, the lower wiring resistance (x direction) per device is about 0.03 ohm, and the upper wiring resistance (y direction) is about 0.1 ohm. As described above, when the power supply section is disposed at one end, the following values are obtained from equation (12).

$$(Nx \times Nx - 8Nx) \times rx = 2628$$

$$(Ny \times Ny - 8Ny) \times ry = 3840$$

Although the number of the x-direction devices is larger than the y-direction devices, batch "forming" is preferably performed for the x-direction devices.

In this embodiment, pulses preferably having the voltage waveform shown in FIG. 16 are applied to the devices selected according to the above procedure to perform "forming". In this embodiment, the pulse width T1 is about 1 millisecond, the pulse interval T2 is about 10 milliseconds, the wave height (peak voltage Vpf for "forming") of the rectangular wave is 5 V, and "forming" is performed in a vacuum of about $1.3 \times 10^{-4}$ Pa for 60 seconds.

In order to understand the characteristics of the many electron emitting devices manufactured by the above steps, the electron emission properties were measured by using the measuring apparatus shown in FIG. 6.

As the measurement conditions, the distance between an anode electrode and the electron emitting device was 4 mm, the potential of the anode electrode was 1 kV, and the degree of vacuum in the vacuum apparatus during measurement of the electron emission properties was $1.3 \times 10^{-4}$ Pa.

In a typical electron emitting device of this embodiment, with an device voltage of about 15 V, an emission current Ie is rapidly increased, and with an device voltage of 20 V, a device current If was 0.1 mA, the emission current Ie was 1 $\mu$A, and the electron emission efficiency Ie/If (%) was 1%.

In this embodiment, variations in the electron emission efficiency of all devices were significantly suppressed to obtain substantially uniform characteristics for those device.

Second Embodiment

This embodiment is described with reference to FIGS. 32 and 33 (consisting of FIGS. 33A and 33B), in which an image forming apparatus comprises an electron source substrate formed in the first embodiment without "forming" treatment.

Figure 32:
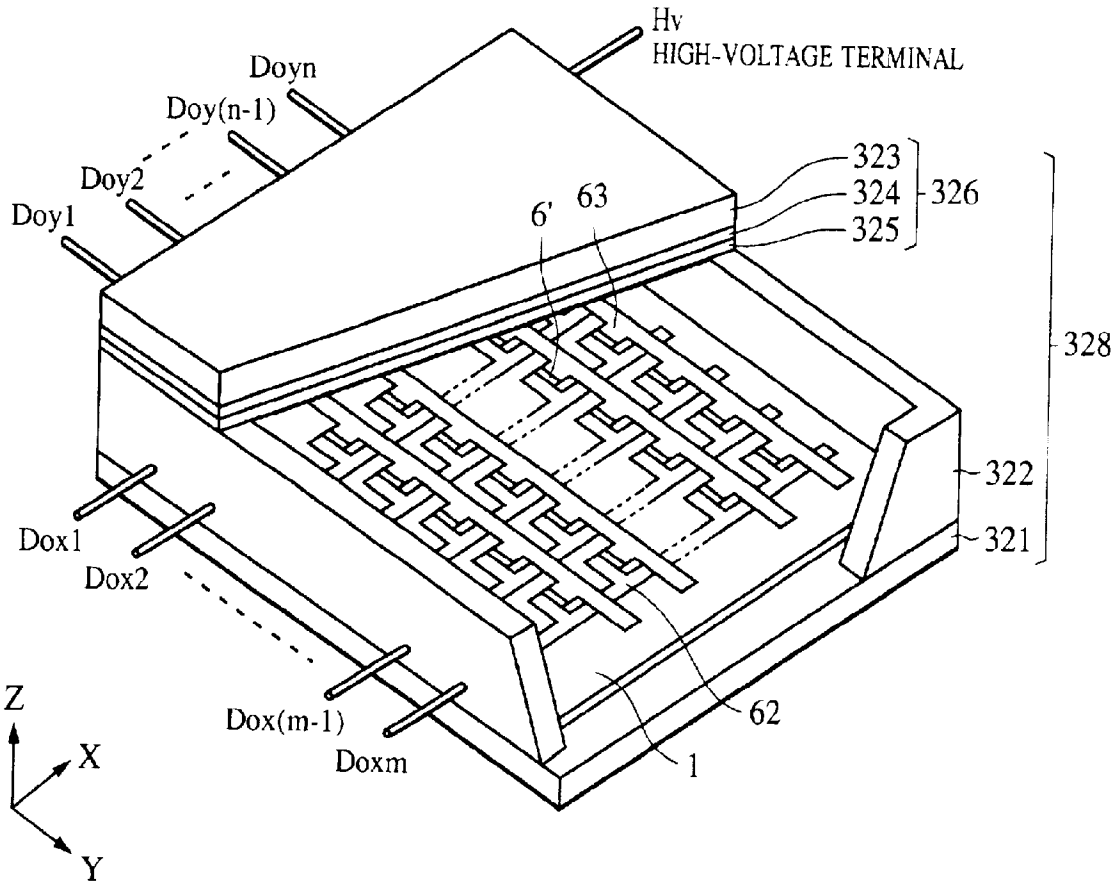
FIG. 32 is a schematic drawing showing a display panel of an image forming apparatus according to a second embodiment of the present invention.
Figure 33A:
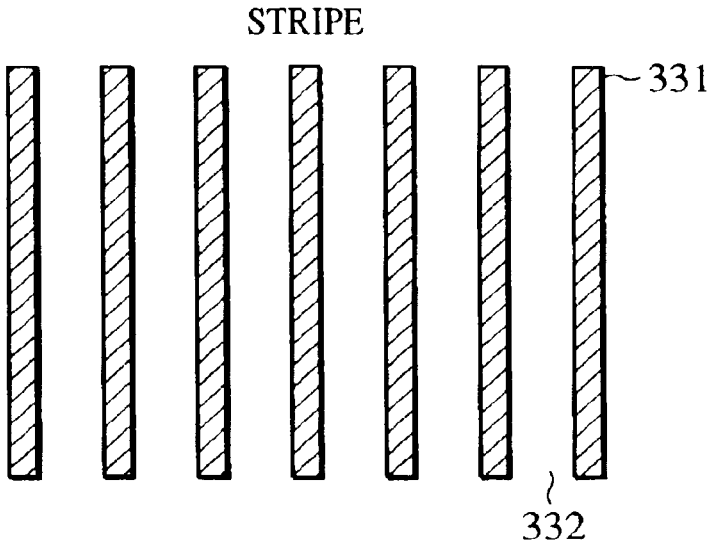
FIG. 33, consisting of FIGS. 33A and 33B, is a schematic drawing showing examples of a fluorescent film used in the display panel of the image forming apparatus according to the second embodiment of the present invention.
Figure 33B:
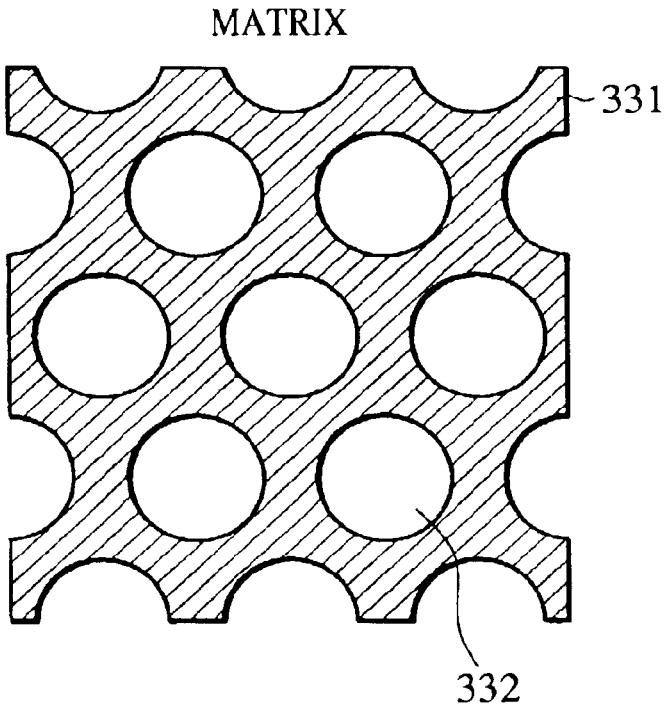

FIG. 32 is a schematic drawing showing a display panel of the image forming apparatus of this embodiment. In FIG. 32, a support frame 322 and face plate 326 (described below) are shown as being partially removed for convenience in describing an inside of the display panel. FIG. 33 is a schematic drawing showing a fluorescent film used in the display panel. In FIG. 32, the same devices as those in FIGS. 29 and 30 are denoted by the same reference numerals.

In this embodiment, an electron source substrate 1 on which 300×200 devices without "forming" treatment are arranged in a simple matrix is fixed on a rear plate 321, and then the face plate 326 (comprising a fluorescent film 324 and a metal back 325, which are formed as image forming members on an inner surface of a glass substrate 323) is disposed 5 mm above the electron source substrate 1 through the support frame 322. Then, frit glass (not shown) is coated in junction portions between the face plate 326, the support frame 322 and the rear plate 321, and sealed by baking in air or a nitrogen atmosphere at 400° C. for ten minutes or more. Also, the rear plate 321 is fixed to the electron source substrate 1 with frit glass.

In a monochrome display, the fluorescent film 324 can be formed by using only one fluorescent material. In a color display, the fluorescent film 324 can be formed by using a black stripe (FIG. 33A) or a black matrix (FIG. 33B) comprising a black conductive material 331 and a fluorescent material 332.

In this embodiment, stripe-shaped fluorescent materials preferably are used. First, black stripes are formed, and then each fluorescent material is coated between the respective stripes to form the fluorescent film 324. As the material for the black stripes, a generally used material comprising graphite as a main component preferably is used. The fluorescent material is coated on the glass substrate 323 by a slurry method.

The metal back 325 provided on the inner surface of the fluorescent film 324 is formed by smoothing (generally referred to as "filming") an inner surface of the fluorescent film 324, and then depositing Al (aluminum) in a vacuum. In some cases, the face plate 326 comprises the film 324 and a transparent electrode (not shown) provided on an outer surface of the fluorescent film 324 in order to improve the conductivity of the fluorescent film 324. However, in the illustrated embodiment, the transparent electrode is not provided because sufficient conductivity can be achieved using only the metal back 325. In a color display, the fluorescent material must be aligned with each of the electron emitting devices during sealing, and thus sufficient alignment is required.

The atmosphere in a glass container (package 328) completed as described above is evacuated by a vacuum pump (not shown) through an exhaust tube (not shown) to reach a degree of vacuum of about $1.3\times10^{-4}$ Pa, and then a voltage is applied between the device electrodes through external terminals Dox1 to Doxm and Doy1 to Doyn by the same method as the first embodiment to perform electrification ("forming"). As a result, gaps 5' are formed in the films 6' formed by decreasing the resistance of the polymer films to form the electron emitting devices.

Next, the exhaust tube (not shown) is fused by heating with a gas burner (not shown) in a vacuum of about $1.3\times10^{-4}$ Pa to seal the package 328.

Finally, in order to maintain the degree of vacuum after sealing, gettering is performed. In a gettering step after sealing, a getter Ba disposed at predetermined positions (not shown) in the image forming apparatus is deposited by heating by a high-frequency heating method.

In the image forming apparatus of this embodiment, completed as described above, a scanning signal and a modulation signal are applied to each of the electron emitting devices from signal generating means (not shown) through the external terminals Dox1 to Doxm and Doy1 to Doyn to emit electrons, and a high voltage is applied to the metal back 325 (FIG. 32) through a high-voltage terminal Hv (FIG. 32) to accelerate the electrons. As a result, the fluorescent material is excited by collision with the electrons to emit light, thereby displaying an image.

In the image forming apparatus of this embodiment, "forming" can be uniformly performed for many electron emitting devices arranged in a simple matrix, and thus uniform device characteristics can be obtained to significantly improve the luminance uniformity of the displayed image.

In the display device of this embodiment, when the power supply section is disposed on one end, and batch "forming" is performed in each of the x direction and y directions, batch "forming" in the y direction exhibits large variations in the luminance measured by applying a constant voltage to each electron emitting device and applying 5 kV to the high-voltage terminal Hv, as compared with batch "forming" in the x direction. Therefore, the direction of "line forming" can be determined.

Third Embodiment

Like in the second embodiment, in the present embodiment of this invention, an image forming apparatus is manufactured by using the "forming" means (A-1). However, this embodiment is different from the second embodiment in the number of devices and the shape and thickness of wirings employed. In an example of an electron source substrate of this embodiment, Nx=50, rx=0.03 ohm, Ny=30, ry=0.1 ohm, and R=1 kilo-ohm. The image forming apparatus of this embodiment preferably has a structure in which electric power can be supplied from both ends of each of X-direction wirings and Y-direction wirings.

As described above, when the power supply sections are disposed at both ends of each wiring, the following values are obtained from equation (13).

$$(Nx\times Nx-24Nx)\times rx=39$$

$$(Ny\times Ny-24Ny)\times ry=18$$

Therefore, batch "forming" in the Y direction is preferably performed.

Like in the second embodiment, in comparison between two panels respectively subjected to "forming" by the two "forming" methods, i.e., batch "forming" in the x direction and batch "forming" in the y direction, batch "forming" in the y direction exhibits small variations in the luminance, as compared with batch "forming" in the x direction. Therefore, the direction of "line forming" can be determined.

Fourth Embodiment

In the description of this embodiment, a "forming" apparatus using the means (A-1) is described. The method of preparing electron emitting devices used in this embodiment is the same as in the first embodiment except for the "forming step", and thus the method will not now be described further.

Figure 34:
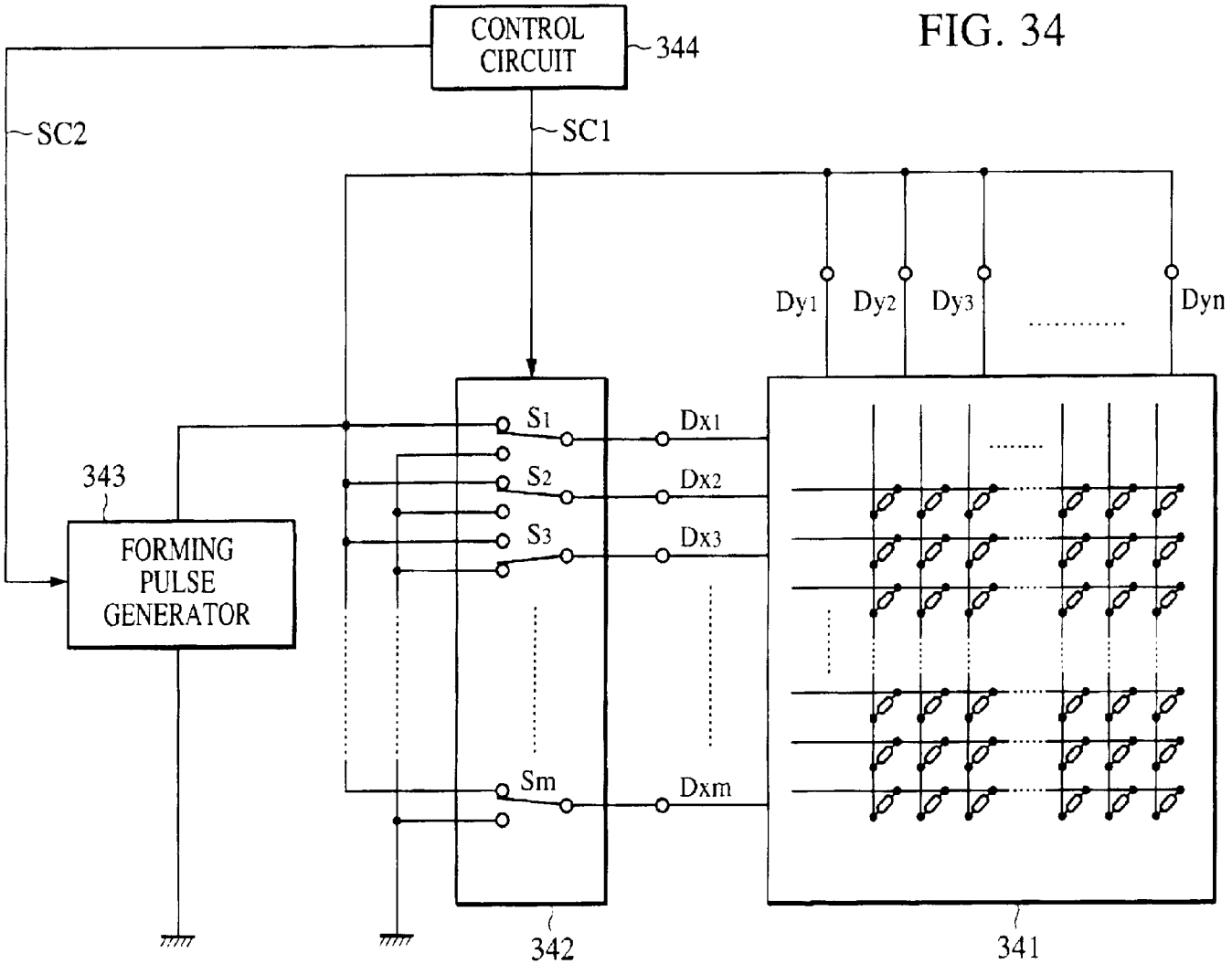
FIG. 34 is a diagram showing the electric circuit configuration of a "forming" apparatus used in a fourth embodiment of the present invention.

FIG. 34 shows the configuration of an electric circuit of the "forming" apparatus used in this embodiment. In FIG. 34, reference numeral 341 denotes an electron source substrate without "forming", on which m×n devices formed by the same method as in the first embodiment are arranged in a simple matrix, reference numeral 342 a switching device array, reference numeral 343 denotes a "forming" pulse generator, and reference numeral 344 denotes a control circuit.

Like in the case shown in FIG. 31, the electrode source substrate 341 may be electrically connected to peripheral electric circuits through terminals Dx1 to Dxm and Dy1 to Dyn. However, in the illustrated embodiment, the terminals Dx1 to Dxm are shown as being connected to the switching device array 342, and the terminals Dy1 to Dyn are connected to an output side of the "forming" pulse generator 343.

The switching device array 342 comprises m switching devices S1 to Sm, each of the switching devices having a function to connect each of the respective terminals Dx1 to Dxm to either the output of the "forming" pulse generator 343 or ground level. Each of the switching devices S1 to Sm is operated according to a control signal SC1 generated from the control circuit 344.

The "forming" pulse generator 343 outputs voltage pulses according to a control signal SC2 generated from the control circuit 344.

As described above, the control circuit 344 is a circuit for controlling the operations of the switching device array 342 and the "forming" pulse generator 343.

The function of each section is described above, and the operation of the entire apparatus will be described.

First, before the start of "forming", each of the switching devices of the switching device array 342 is connected to ground level by control of the control circuit 344, and the output voltage of the "forming" pulse generator 343 is also kept at 0 V, i.e., the ground level.

Next, as described above with reference to FIG. 31, in order to perform "forming" for one column of devices, the control circuit 344 produces the control signal SC1 so that, of the switching devices in the switching device array 342, the switching devices other than the switching devices connected to the column selected for "forming", are connected to the "forming" pulse generator 343. FIG. 34 shows an example in which switching devices other than switching device S3 are connected to the "forming" pulse generator 343.

Next, the control circuit 344 produces the control signal SC2 so that the voltage pulse suitable for "forming" is output from the "forming" pulse generator 343. After "forming" is completed for the devices of the selected one column, the control circuit 344 outputs the control signal SC2 to the "forming" pulse generator 343 so that generation of the pulse is stopped to set the output voltage to 0 V. Furthermore, the control circuit 344 outputs the control signal SC1 so that all switching devices contained in the switching device array 342 are connected to ground level.

In this manner, "forming" is completed for the devices of the arbitrarily selected column by the operations according to the above procedure. Then, "forming" is successively performed for the other device columns individually according to the same procedure to permit uniform "forming" for all m×n devices arranged in the simple matrix on the substrate 1.

In this embodiment, a 100×100 simple matrix substrate is used, although the invention is not limited to this configuration, and "forming" is performed by applying a pulse having the voltage waveform shown in FIG. 16 to the selected devices according to the above-described procedure. In this embodiment, the pulse width T1 is about 1 millisecond, the pulse interval T2 is about 10 milliseconds, the wave height (peak voltage in "forming") of the rectangular waveform is about 5 V, and "forming" is performed in a vacuum of about $1.3\times10^{-4}$ Pa for 60 seconds. As a result of measurement using the measuring apparatus shown in FIG. 6, in the typical electron emitting devices of the electron source, the emission current Ie rapidly increases with en device voltage of about 15 V. While with an device voltage of 20 V, the device current If is 0.2 mA, the emission current is 2 $\mu$A, and the electron emission efficiency $\eta$=Ie/If (%) is 1%.

When the above-described conventional problem of causing variations in cracks (gaps) occurs, uniformity in the electron emission efficiency of devices cannot be obtained. However, in the "forming" method using the "forming" apparatus of this embodiment, variations in the voltages effectively applied to the respective devices at the time of "forming" can be decreased to suppress variations in the electron emission efficiency as an device property to 10% or less.

Fifth Embodiment

In this embodiment, an electron source substrate without "forming" produced by the same method as that used in the first embodiment is used, and "forming" is performed by the means (A-2) to obtain an electron source.

Figure 35:
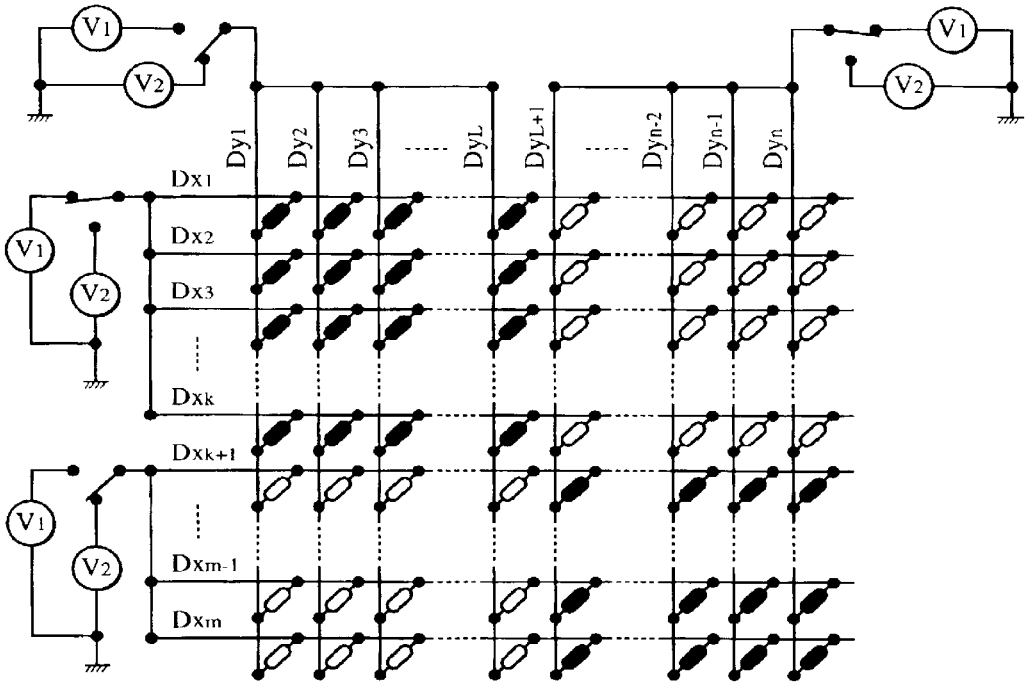
FIG. 35 is a diagram illustrating a "forming" method in a fifth embodiment of the present invention.

FIG. 35 is a drawing showing electrical connection for "forming" in a portion of an device group in a simple matrix, for explaining this embodiment.

In the configuration shown in FIG. 35, a "forming" power supply (potential V1 or V2) is connected to row wirings (Dx1 to Dxm) and column wirings (Dy1 to Dyn) for performing "forming". In this case, potential V1 is applied to k row wirings of all row wirings, and potential V2 is applied to the remaining (m−K) row wirings. At the same time, potential V2 is applied to L column wirings of all column wirings, and potential V1 is applied to the remaining (n−L) column wirings. As a result, of all devices, K×L+(m−K)×(n−L) were selected, and a potential V2−V1 (in this embodiment, 6 V) is applied to substantially all selected devices to perform "forming".

In this embodiment, a pulse having the voltage waveform shown in FIG. 16 is applied to the devices selected according to the above procedure to perform "forming". In this embodiment, the pulse width T1 is about 1 millisecond, the pulse interval T2 is about 10 milliseconds, the wave height (peak voltage in "forming") of the rectangular waveform is about 6 V (V2−V1), and "forming" is performed in a vacuum of about $1.3\times10^{-4}$ Pa for 60 seconds.

On the other hand, a substantially equal potential is applied to the electrodes at both ends of the devices other than the selected devices, and thus the voltage applied between both ends of each device becomes 0 V. Therefore, "forming" is not performed for these devices, and the films obtained by decreasing the resistance of the polymer films are neither deteriorated nor damaged. Next, potentials V1 and V2 connected to the column wirings (or row wirings) are inverted so that the devices remaining unselected are selected, and "forming" is performed by the same method as described above.

In order to further understand the characteristics of the many electron emitting devices manufactured by the above steps in which m and n were 100, and K and L were 50, the electron emission properties were measured by using the measuring apparatus shown in FIG. 6. As the measurement conditions, like in the above embodiments, the distance between an anode electrode and electron emitting devices was 4 mm, the potential of the anode electrode was 1 kV, and the degree of vacuum in the vacuum apparatus during measurement of the electron emission properties was $1.3\times10^{-4}$ Pa. As a result, the electron emission efficiency $\eta$=Ie/If (%) was 1%, and substantially uniform characteristics were obtained in all devices.

Sixth Embodiment

An image forming apparatus prepared by the same "forming" treatment as that shown the sixth embodiment will now be described with reference to FIG. 32.

An image forming apparatus that was not subjected to "forming" treatment was prepared using the same electron source substrate as that prepared in the sixth embodiment. The electron source substrate included 100×100 devices interconnected by simple matrix wiring and had the same configuration as that in the second embodiment.

The completed glass container (package 328) was evacuated by a vacuum pump through an exhaust tube (not shown in the drawing) until the degree of vacuum reached about $1.3\times10^{-3}$ Pa or less. A voltage was applied between device electrodes through external terminals Dox1 to Doxm and Doy1 to Doyn as in the fifth embodiment to form gaps (electron emitting sections) in a film (formed by decreasing the resistance of the polymer film) by the above energizing ("forming") treatment. Electron emitting devices were thereby prepared. Next, envelope 328 was sealed by fusing the exhaust tube (not shown in the drawing) at the degree of vacuum of $1.3\times10^{-4}$ Pa. Finally, the image forming apparatus was subjected to gettering to maintain the degree of vacuum after the sealing.

Scanning signals and modulation signals (not shown) were applied from signal generating means (not shown in the drawing) through the external terminals Dox1 to Doxm and Doy1 to Doyn and a high voltage was applied from a high-voltage terminal Hv to the electron emitting devices to display an image on the resulting image forming apparatus.

Also in the image forming apparatus prepared in this embodiment, uniform "forming" of the many electron emitting devices interconnected by a simple matrix wiring was successfully achieved, and a displayed image had uniform brightness due to uniform luminescence of the devices.

Seventh Embodiment

An electron source prepared by the "forming" treatment A-2 of an electron source substrate that is prepared in accordance with the first embodiment and is not subjected to "forming" will now be described.

Figure 36:
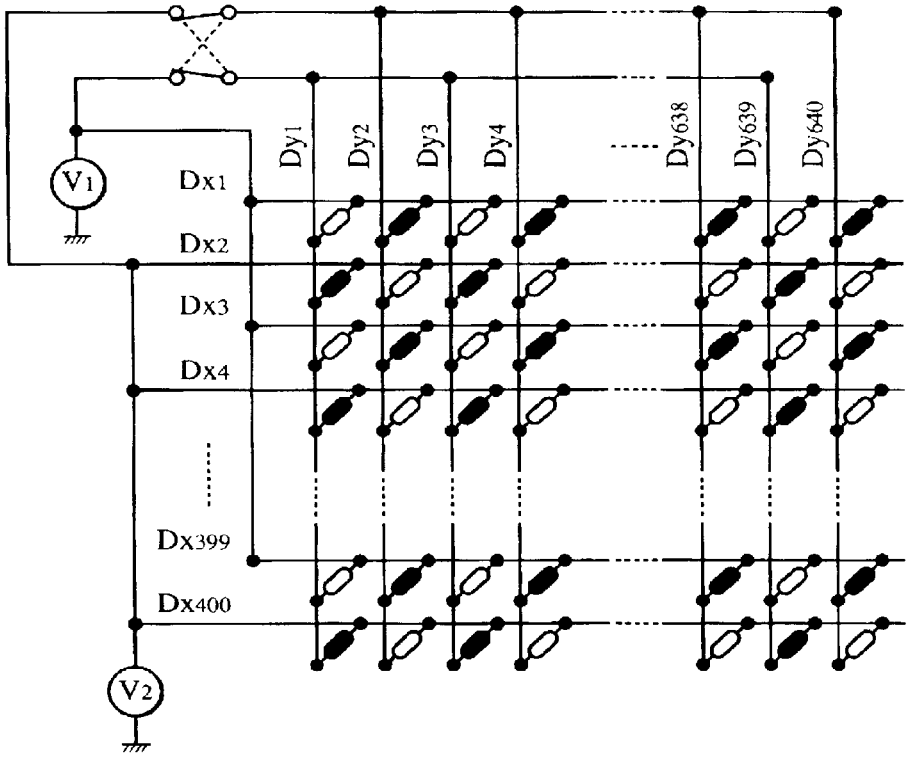
FIG. 36 is a diagram illustrating a "forming" method in a seventh embodiment of the present invention.

FIG. 36 shows electrical connection for performing a "forming" of half of 640×400 devices that are interconnected by simple matrix wirings Dx1, Dx2, . . . , Dx400, and Dy1, Dy2, . . . , Dy640 and are not subjected to the "forming". Power sources V1 and V2 generate "forming" pulses.

FIG. 36 illustrates a method for applying a voltage when devices shown as blackened are selectively subjected to "forming". The potential of the source V1 is set at V1 while that of the source V2 is set at Vform. A voltage Vform (=V2−V1) is applied to the blackened devices while zero volts is applied to devices depicted as white. As a result, the blackened devices are selectively subjected to "forming" whereas the white devices do not change.

Figure 37:
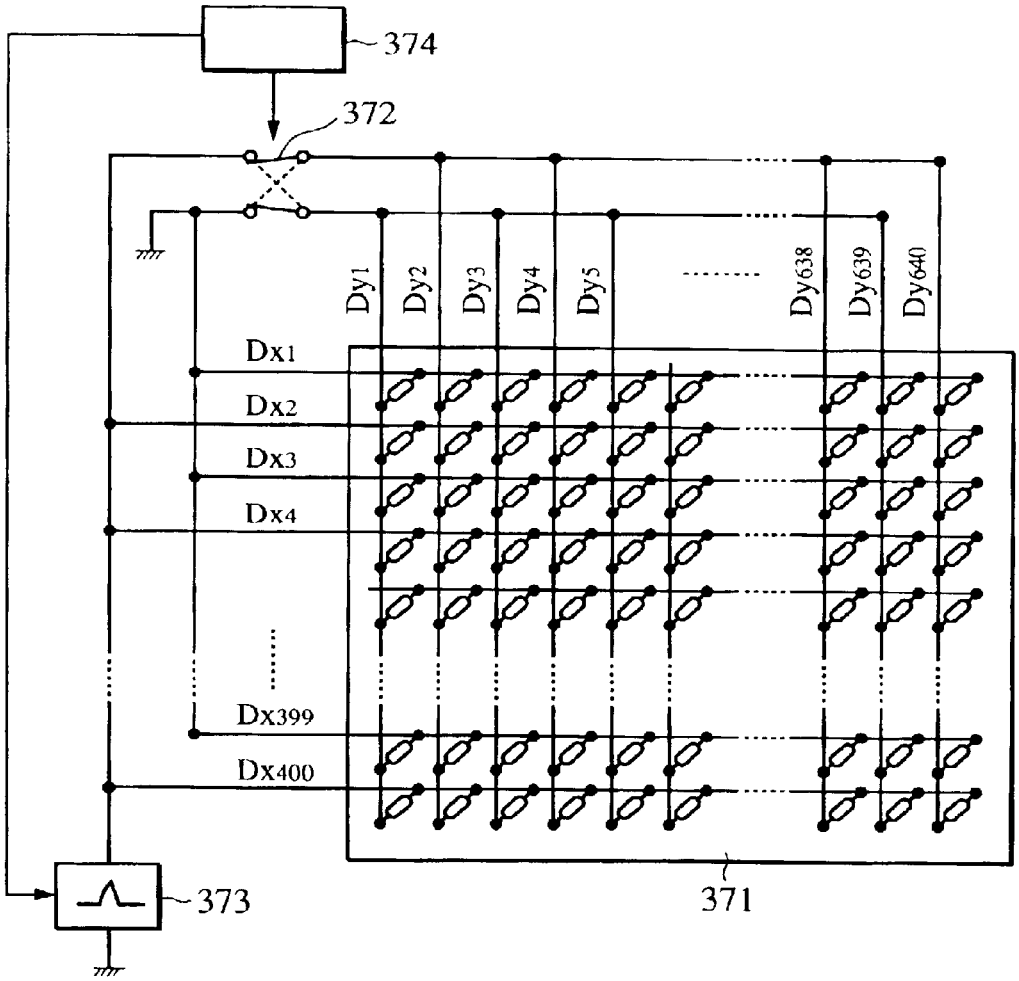
FIG. 37 is a diagram showing an electric circuit configuration for "forming" in the seventh embodiment of the present invention.

FIG. 37 shows an electrical circuit configuration for performing the "forming". In the drawing, the electron source substrate 371 includes 640×400 untreated devices that are interconnected by a simple matrix wiring; a switching device 372; a "forming" pulse generator 373; and a control circuit 374. Among row wirings (Dx1, Dx2, . . . , Dx400) of the electron source substrate 371, odd numbered rows are connected to the ground level while even numbered rows are connected to an output of the "forming" pulse generator 373. Among column wirings (Dy1, Dy2, . . . , Dx640), odd numbered columns are connected to one of the ground level and the "forming" pulse generator 373 while even numbered columns are connected to the other of ground level and generator 373. Both the odd numbered columns and the even numbered columns are not connected to the "forming" pulse generator 373 at the same time.

The control circuit 374 outputs control signals for switching of the connection between the odd numbered columns and the even numbered columns. The "forming" pulse generator 373 outputs the "forming" pulses according to control signals from the control circuit 374.

Before the "forming", all wirings are maintained at the ground level. The control circuit 374 outputs a signal to the switching device 372 such that the odd numbered columns are connected to the output of the "forming" pulse generator 373 while the even numbered columns are connected to ground level. Next, the control circuit 374 outputs a signal to the "forming" pulse generator 373 to generate "forming" pulses. The "forming" pulses are applied to the selected devices. A current for "forming" 320 device (half of 640) flows through rows while a current for "forming" 200 devices flows through columns. After completing the "forming" of the selected devices, the switching device 372 is operated so that the odd numbered columns are connected to the ground level while the even numbered columns are connected to the output from the "forming" pulse generator 373. The remaining devices are thereby subjected to "forming" by "forming" pulses.

In this embodiment, pulses shown in FIG. 16 were applied to the selected devices. The pulse width T1 was about 1 millisecond, the pulse interval T2 was about 10 milliseconds, the height of the rectangular wave (peak voltage in the "forming") was about 5 V, and the "forming" was performed for 60 seconds in a vacuum of $1.3\times10^{-4}$ Pa.

In this embodiment, a temperature rise caused by a current flowing in each wiring during the "forming" was suppressed; the wirings and substrate 1 were not damaged. Since the device are alternately subjected to the "forming", the "forming" was successfully achieved without generation of an irregular temperature distribution.

The electron emitting characteristics were measured as in the fifth embodiment. The electron emitting efficiency $\eta$=Ie/If was 1%. All the devices have substantially the same characteristics.

An image forming apparatus prepared as in the sixth embodiment also was subjected to "forming" according to this embodiment. Uniform "forming" of the entire electron emitting devices interconnected by simple matrix wiring was successfully completed. A displayed image had uniform brightness because of uniform device characteristics.

Eighth Embodiment

In the first to seventh embodiments, parts of electron emitting devices were subjected to "forming". This eighth embodiment relates to a method for applying a voltage for "forming" to the devices using electrically connecting means (B-1) other than wirings. The method according to this embodiment is applicable to, and usable with, both a ladder wiring arrangement and a simple matrix wiring arrangement.

A method for making an electron source including electron emitting devices having a ladder arrangement and the configuration thereof will now be described with reference to FIG. 38, which consists of FIGS. 38A to 38D.

Figure 38A:
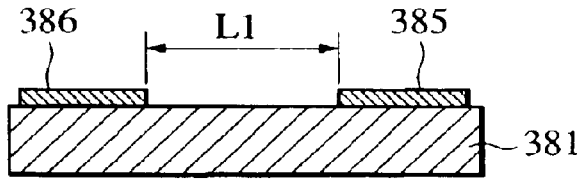
FIG. 38 is, consisting of FIGS. 38A to 38D, a drawing illustrating the manufacturing method and construction of a ladder arrangement electron source according to an eighth embodiment of the present invention.
Figure 38B:
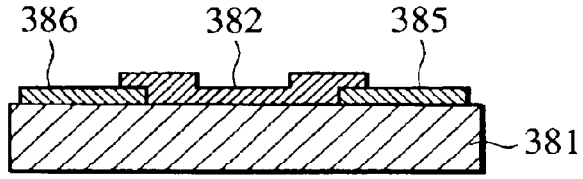
Figure 38C:
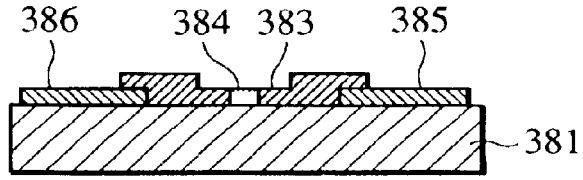
Figure 38D:
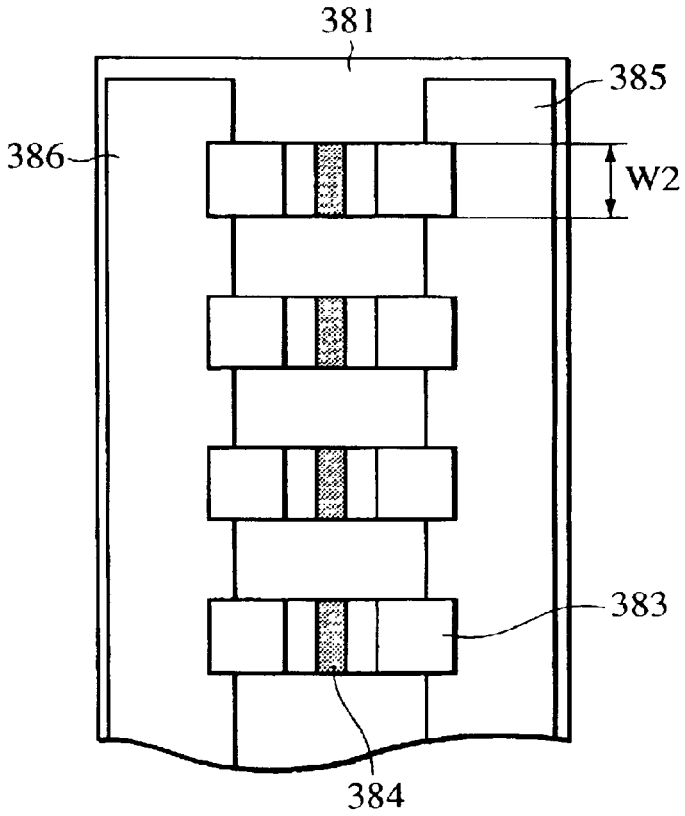

A Ni thin film with a thickness of 1,000 Å was formed by vacuum deposition on a substrate 381 that was a cleaned soda lime glass plate and covered with a silicon oxide layer with a thickness of 0.5 $\mu$m formed by sputtering. The Ni thin film was etched by photolithography to form device electrodes (common wirings) 385 and 386, as shown in FIG. 38A. A 3% polyamic acid solution (solvents: N-methylpyrrolidone/triethanolamine) was applied over the gap between the common wirings 385 and 386 and parts of the common wiring 385 and 386 by an ink jet process so that the center of the coating corresponds to the center of the gap. The substrate 381 was baked at 350° C. under vacuum to form a circular polyimide film 382 with a diameter of 100 $\mu$m and a thickness of 300 nm, as shown in FIG. 38B. The substrate 381 was placed on a stage in an atmosphere. The polymer film 382 was irradiated with the second harmonic of a Q-switch pulse Nd: YAG laser (the pulse width: 100 nm, the repeated frequency 10 kHz, and the beam diameter: 10 $\mu$m). In this process, the stage was moved so that the 10-$\mu$m width in the center of the polymer film 382 was irradiated. A pyrolytic conductive region 383 was formed in the center of the polymer film 382.

Figure 39:
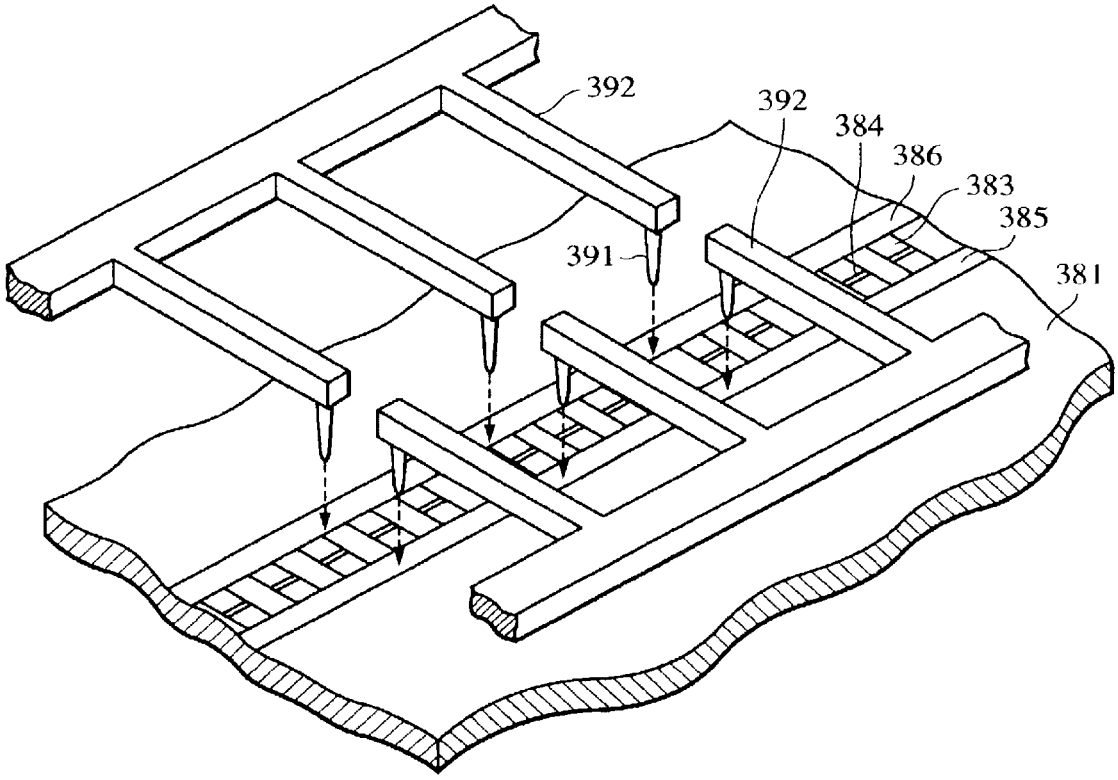
FIG. 39 is a perspective view illustrating electrical connection means for "forming" in the eighth embodiment of the present invention.

FIG. 39 is an isometric view illustrating energizing by electrical connection for the "forming" of electron sources arranged in a plurality of rows in this embodiment. In this embodiment, 1,000 device films (decreased-resistance films) 383 are arranged parallel, although for convenience, not all are shown. Ni common electrodes 385 and 386 apply energy to each device. In the drawing, 332 pairs of copper styluses 391 electrically connect with plural portions of the common electrodes 385 and 386, although, for convenience, not all styluses 391 are shown. Pure copper wirings 392 electrically connect the copper styluses 391 to a "forming" power source (not shown in FIG. 39).

Each pair of copper stylus 391 is allocated to every three devices. These copper styluses 391 are brought into close contact with the common electrodes 385 and 386, and a voltage necessary for the "forming" of the devices is applied to the common electrodes 385 and 386 through the "forming" power source to form gaps (cracks) 384 functioning as electron emitting sections in the device films 383 (see a cross-sectional view shown in FIG. 38C and a plan view shown in FIG. 38D). The cross-section of each pure copper wiring 392 is at least 1 mm square so that the resistance between two terminals is 1/1000 or less of that of the common electrodes 385 and 386.

A "forming voltage" was applied to the devices using the "forming" apparatus in this embodiment. The variation in voltage at contact portions of the copper styluses 391 was 0.001 V or less. The variation in electron emitting efficiency between the devices was 3% or less.

Ninth Embodiment

An image forming apparatus using an electron source substrate prepared in the process of the eighth embodiment, but which is not subjected to a "forming process" will now be described with reference to FIGS. 40 and 41.

Figure 40:
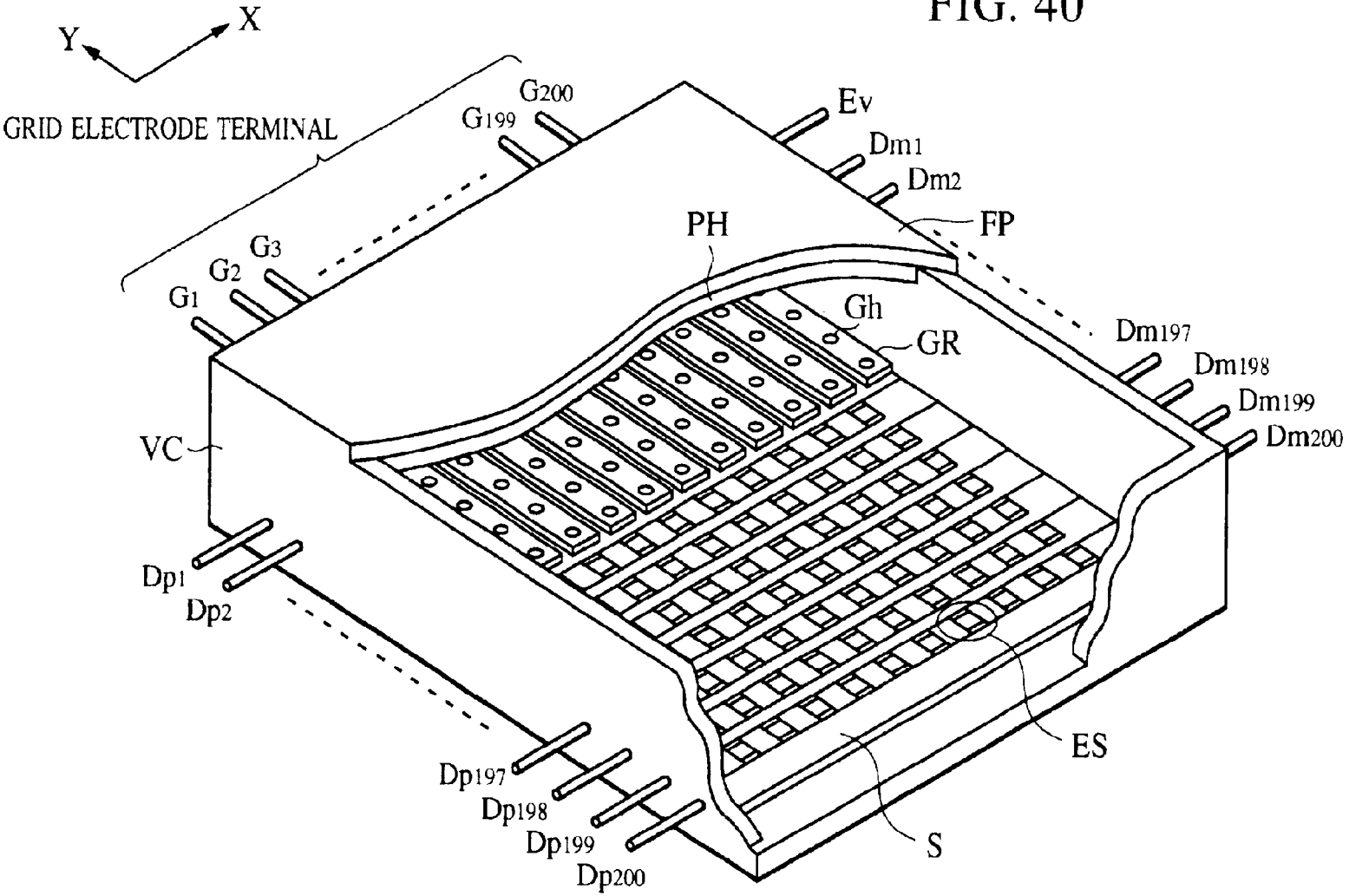
FIG. 40 is a drawing showing the panel structure of an image forming apparatus comprising a ladder arrangement electron source according to a ninth embodiment of the present invention.

FIG. 40 shows a panel structure of the image forming apparatus including a multiple electron source having a ladder arrangement in this embodiment. This panel structure has a glass vacuum container VC that has a faceplate FP at the display side. On the inner face of the faceplate FP, a transparent electrode composed of, for example, ITO is formed, and red, green, and blue fluorescent materials are applied into a striped pattern on the transparent electrode. For simplicity of the drawing, a combination of the transparent electrode and the fluorescent materials (phosphors) is denoted by symbol PH. A black matrix or black stripe, which is known in the CRT field, may be provided between the fluorescent materials. A known metal back layer may be formed on the fluorescent materials. The transparent electrode is electrically connected to an exterior of the vacuum container through a terminal EV that applies an acceleration voltage for electron beams. A high voltage of 4 kV was applied in this embodiment.

A multi-electron source substrate (electron source substrate) S is fixed to the bottom face of the vacuum container VC in which electron emitting devices are arranged, as described above. The electron source substrate S, in an embodiment of this invention, subjected to the "forming" by electrical connection as in the eighth embodiment, and is fixed to the vacuum container VC.

The electron source substrate S preferably has 200 device columns, each column including 200 devices, although, for convenience, not all 200 devices are shown. Two wiring electrodes (common wirings) are alternatively connected to electrode terminals Dp1 to Dp200 and Dm1 to Dm200 provided on two panel sides so that driving electrical signals can be applied from the exterior of the vacuum chamber VC.

Between the electron source substrate S and the faceplate FP, 200 striped grid electrodes GR are provided in the Y direction perpendicular to the device columns. Each surface conductivity type electron emitting device ES has an opening Gh. Instead of a circular opening, a mesh having many pores may be provided in some embodiments. These grid electrodes GR are electrically connected to the exterior of the vacuum container VC through electrode terminals G1 to G200. The shape and position of the grid electrode GR is not limited to those shown in FIG. 40 as long as the grid electrode GR can modulate electron beams emitted from the surface conductivity type electron emitting device. For example, the grid electrode GR can be disposed nearer to the electron emitting devices.

The display panel according to this embodiment preferably includes a 200×200 XY matrix of the electron emitting device rows and grid electrode columns. Modulation signals corresponding to one row of an image are simultaneously applied to each grid electrode column in synchronization with driving (scanning) of the corresponding device rows such that the intensity of the electron beam incident on the fluororescent material is controlled for each device. One row of an image is thereby displayed.

Figure 41:
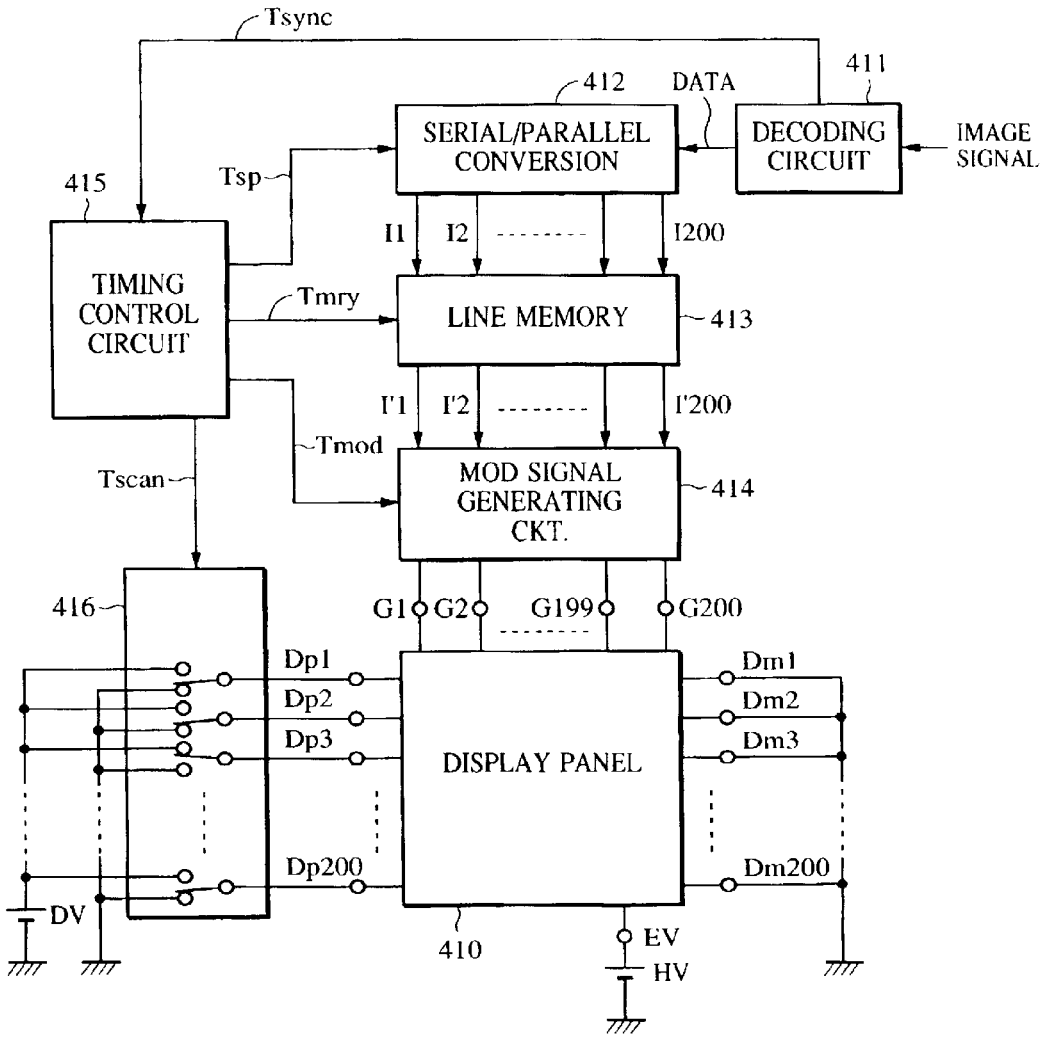
FIG. 41 is a block diagram showing the driving circuit of a display panel comprising the ladder arrangement electron source according to the ninth embodiment.

FIG. 41 is a block diagram of an electrical circuit for driving a display panel 410, such as that shown in FIG. 40. The circuit includes display panel 410, a decoding circuit 411 for decoding combined image signals input from the exterior, a serial/parallel conversion circuit 412, a line memory 413, a modulation signal generating circuit 414, a timing control circuit 415, and a scanning signal generating circuit 416. Electrode terminals of the display panel 410 are connected to the corresponding electrical circuits: A terminal EV is connected to a power source HV generating an acceleration voltage of 10 kV, terminals G1 to G200 to the modulation signal generating circuit 414, terminals Dp1 to Dp200 to the scanning signal generating circuit 416, and terminal Dm1 to Dm200 to ground.

The functions of these circuits will now be described. The decoding circuit 411 decodes combined image signals input from the exterior, for example, NTSC television signals. The combined image signals are decomposed into a brightness signal (DATA signal) component and a synchronization signal (Tsync signal) component that are output to the serial/parallel conversion circuit 412 and the timing control circuit 415, respectively. More specifically, the decoding circuit 411 sequentially outputs brightness signals of RGB color components corresponding to the color pixel array of the display panel 410, to circuit 412. Also the decoding circuit 411 extracts vertical synchronization signals and horizontal synchronization signals and outputs them to the timing control circuit 415.

The timing control circuit 415 generates various timing signals for operation timing matching of various circuits based on the synchronization signal Tsync: The timing control circuit 415 outputs a timing signal Tsp to the serial/parallel conversion circuit 412, a memory timing signal Tmry to the line memory 413, a timing control signal Tmod to the modulation signal generating circuit 414, and a timing control signal Tscan to the scanning signal generating circuit 416.

The serial/parallel conversion circuit 412 sequentially collects brightness signals DATA from the decoding circuit 411 in synchronous with the timing signal Tsp, and outputs 200 parallel signals I1 to I200 to the line memory 413. The timing control circuit 415 outputs memory timing signal Tmry to the line memory 413 after one-line data is serial/parallel-converted.

The line memory 413 stores data of the parallel signals I1 to I200 upon the memory timing signal Tmry received and outputs parallel signals I'1 to I'200 (corresponding to I1 to I200) to the modulation signal generating circuit 414 upon the input of the subsequent memory timing signal Tmry.

The modulation signal generating circuit 414 generates modulation signals that are applied to the grid electrodes of the display panel 410 according to one line of brightness data, and outputs the modulation signals to the terminals G1 to G200 in synchronous with the timing control signal Tmod from the timing control circuit 415. The modulation signals may be of a modulation voltage type in which the voltage varies in response to the image brightness data, or may be of a pulse width modulation type in which the width of the voltage pulses varies in response to the brightness data.

The scanning signal generating circuit 416 generates voltage pulses for driving electron emitting device rows of the display panel 410. This circuit operates a switching circuit therein in synchronization with the timing control signal Tscan from the timing control circuit 415 to apply either a driving voltage VE [V] higher than the threshold value of the electron emitting devices or a ground level (0 [V]) to the terminals Dp1 to Dp200, the driving voltage being generated in a constant-voltage source DV.

Driving signals at a predetermined time interval are thereby applied to the display panel 410. More specifically, Voltage pulses with an amplification VE [V] are sequentially applied to the individual terminals Dp1, Dp2, Dp3, . . . Dp200, one at a time for displaying a one-line image. Since the terminals Dm1 to Dm200 are always connected to the ground level (0 [V]), the device rows are sequentially driven from the first row on in response to the voltage pulses. In synchronization with the driving, the modulation signals corresponding to one image line are applied to the terminals G1 to G200. In synchronization with the switching of the scanning signals, the modulation signals are switched so that the next image line is displayed. A television moving image is displayed by repeating this operation.

The image forming apparatus prepared according to this embodiment had uniform device characteristics, thereby contributing to the display of images with uniform brightness, since the "forming" of many devices having a parallel ladder arrangement was successful.

Tenth Embodiment

In this embodiment, a "forming" treatment was performed using an electrically connecting means having two pure-copper terminals, which correspond to an integration of copper styluses shown in the eighth embodiment.

Figure 42:
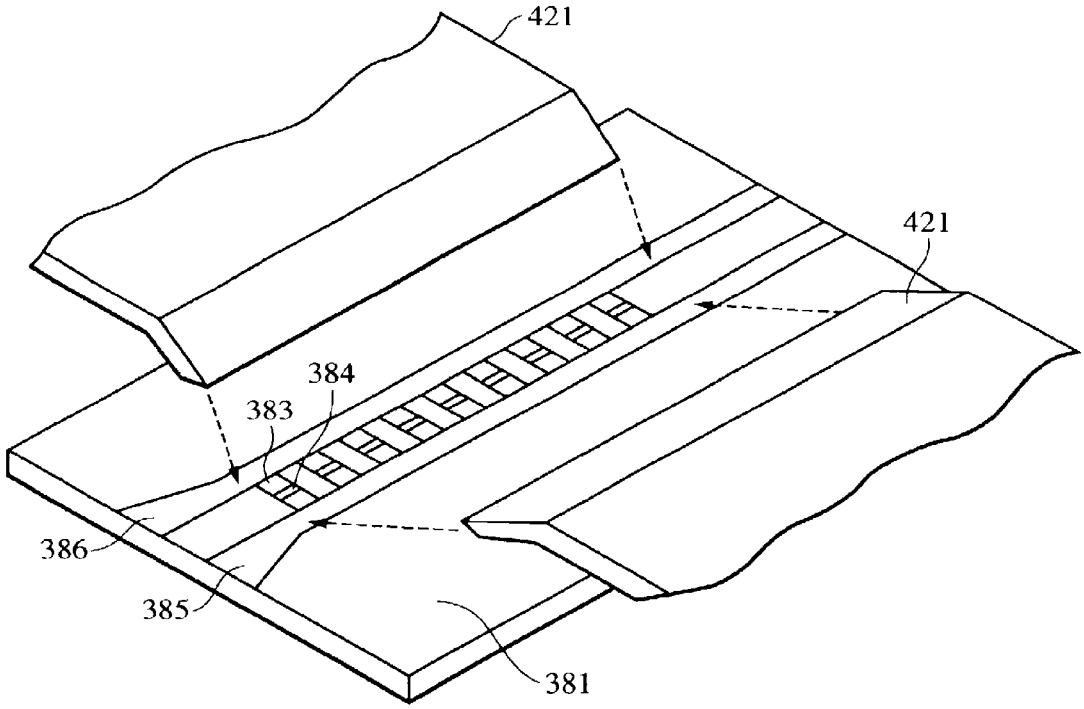
FIG. 42 is a perspective view illustrating electrical connection means for "forming" in a tenth embodiment of the present invention.

FIG. 42 is an isometric view of the electrically connecting means according to this embodiment. The electrically connecting means has wide connecting terminals 421, each having a knife-edge. This configuration eliminates almost all of the resistance between the electrically connecting terminals in the eighth embodiment and reduces the interconnection resistance between devices to a negligible level. Thus, a more uniform voltage can be applied to the entire devices during the energizing treatment.

The electron source substrate 381 used in the eighth embodiment was subjected to "forming" using the electrically connecting means of this embodiment. The variation in voltage applied to the devices during the "forming" treatment was 0.0001 V or less in this embodiment while 0.001 V in the eighth embodiment.

The variation in electron emitting efficiency (1%) between the devices was suppressed to 3% or less. An image forming apparatus was prepared as in the ninth embodiment. Uniform "forming" could be achieved for many electron emitting devices, and unevenness in brightness of the displayed image was 3% or less.

Eleventh Embodiment

Figure 43A:
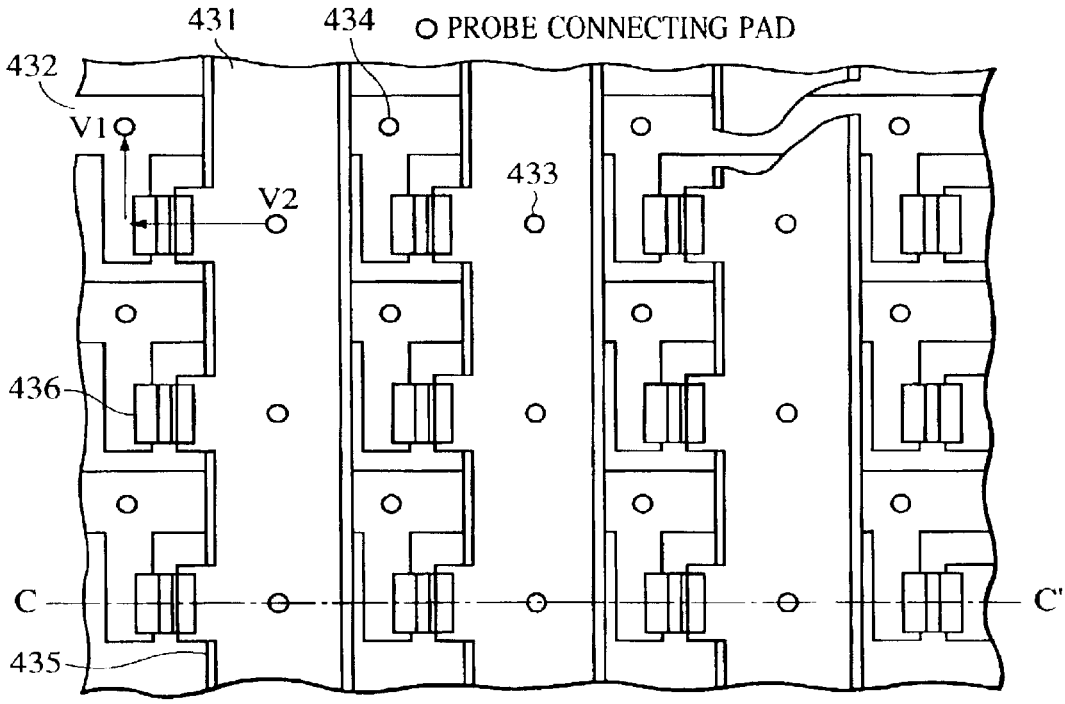
FIG. 43, consisting of FIGS. 43A to 43C, is a diagram illustrating a "forming" method in an eleventh embodiment of the present invention.
Figure 43B:
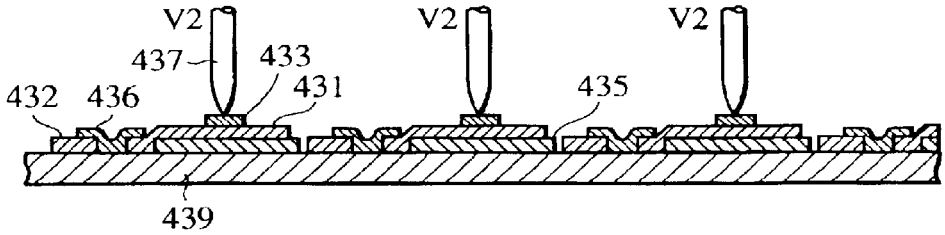
Figure 43C:
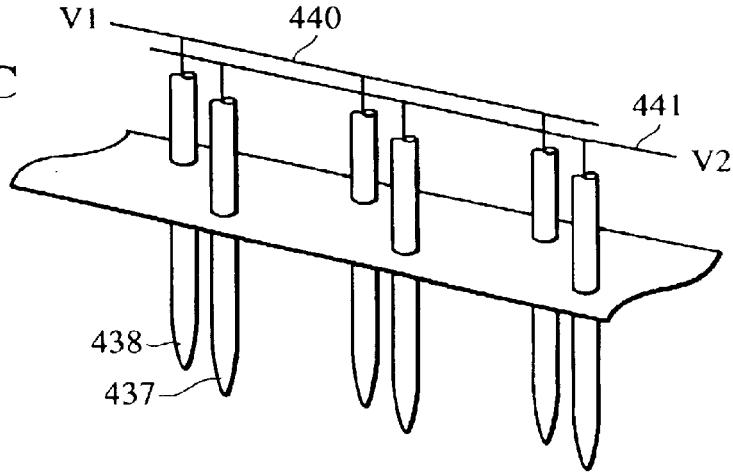

In this embodiment, a multielectron source having a two-dimensional simple matrix array of 100×100 is subjected to the "forming" treatment according to the means (B-1). The wiring configuration and the electron emitting devices are formed as in the first embodiment. FIGS. 43A to 43C show the steps of the "forming" treatment by connecting an electron source substrate having the electron emitting devices in the matrix with the electrically connecting means (B-1).

In FIG. 43A, the multielectron source is viewed from a perspective looking down thereon. Device films 436 are provided on a glass substrate and connected to either wiring 435 or 431. The wiring 435 and the corresponding device film 436 are connected with an extraction electrode 432. In this embodiment, a voltage is applied to device films 436 through stylus terminals (hereinafter probes). The probes are connected to wirings 435 and 436 through electrode pads 434 and 433.

FIG. 43B is a cross-sectional view taken along line C–C' in FIG. 43A and shows energizing of the device films by the probes 437. The extraction electrode 432, and the wirings 435 and 431 are formed (at least in part) on the glass substrate 439, and the wiring 431 is connected to the probe 437 with the electrode pad 433. The other wiring 435 is also connected, although the connection is not depicted in the drawing to the probe 437 through the pad 433.

Referring to now FIG. 43C, using the electrically connecting means, i.e., probes 437 and 438 that are alternately arranged in two lines, a pair of probes 437 and 438 is connected to one device. The pair of probes 437 and 438 is also connected to low-resistance wirings 440 and 441 near both ends of the devices in one line and potentials V1 and V2 are applied to the probes 437 and 438. A load of several tens of grams is applied to each pin by a force of a tungsten spring (not shown) such that the contact resistance of each pin is 0.01 Ω or less. In this embodiment, the tip of each spring and the tip 433 of the probe in contact with the corresponding wiring preferably are coated with gold to decrease the contact resistance to 0.01 Ω or less. The probes are connected to a power source (not shown) that generates "forming" pulses.

The "forming" pulse had a waveform as shown in FIG. 16, wherein T1 was about 1 millisecond, T2 was about 10 milliseconds, and the peak voltage was about 4 V. After "forming" of one line of devices, the probes were connected to a next line, and "forming" of the next line was performed. This operation sequence was repeated until the "forming" of all lines (columns or rows) was completed. The "forming" voltage was applied using the "forming" apparatus of this embodiment. The variation in voltage at the contact section of the spring pin (not shown) was 0.01 V or less, and the variation in electron emitting efficiency (1%) between the devices was 4% or less.

A pair of probes 437 and 438 is connected for every electron emitting device in this embodiment. The pair of probes 437 and 438 may be connected for every several electron emitting devices in view of the wiring resistance and device resistance.

In this embodiment, each probe is in contact with an exposed surface of the wiring. If the surface of the wiring is not exposed, that is, if the wiring is covered with an insulating layer, the insulating layer is removed at portions in contact with probes before "forming".

Twelfth Embodiment

In this embodiment, an image forming apparatus is provided which includes an electron source substrate prepared as in the eleventh embodiment and is not subjected to "forming".

Referring to FIG. 32, films 6' on the electron source substrate 1 are subjected to the "forming" described and shown in the eleventh embodiment. Next, the electron source substrate 1 is fixed to a rear plate 321. The image forming apparatus is prepared as in the second embodiment.

Scanning signals and modulation signals are applied to the surface conductivity-type electron emitting devices of the image forming apparatus from signal generating means (not shown in the drawing) through external terminals Dox1 to Doxm and Doy1 to Doyn, while a high voltage of 5 kV is applied from a high-voltage terminal Hv to display an image. In this embodiment of the invention, "forming" treatment of the surface conductivity-type electron emitting devices can be successfully completed, and thus the displayed image has a uniform brightness.

Thirteen Embodiment

Figure 44:
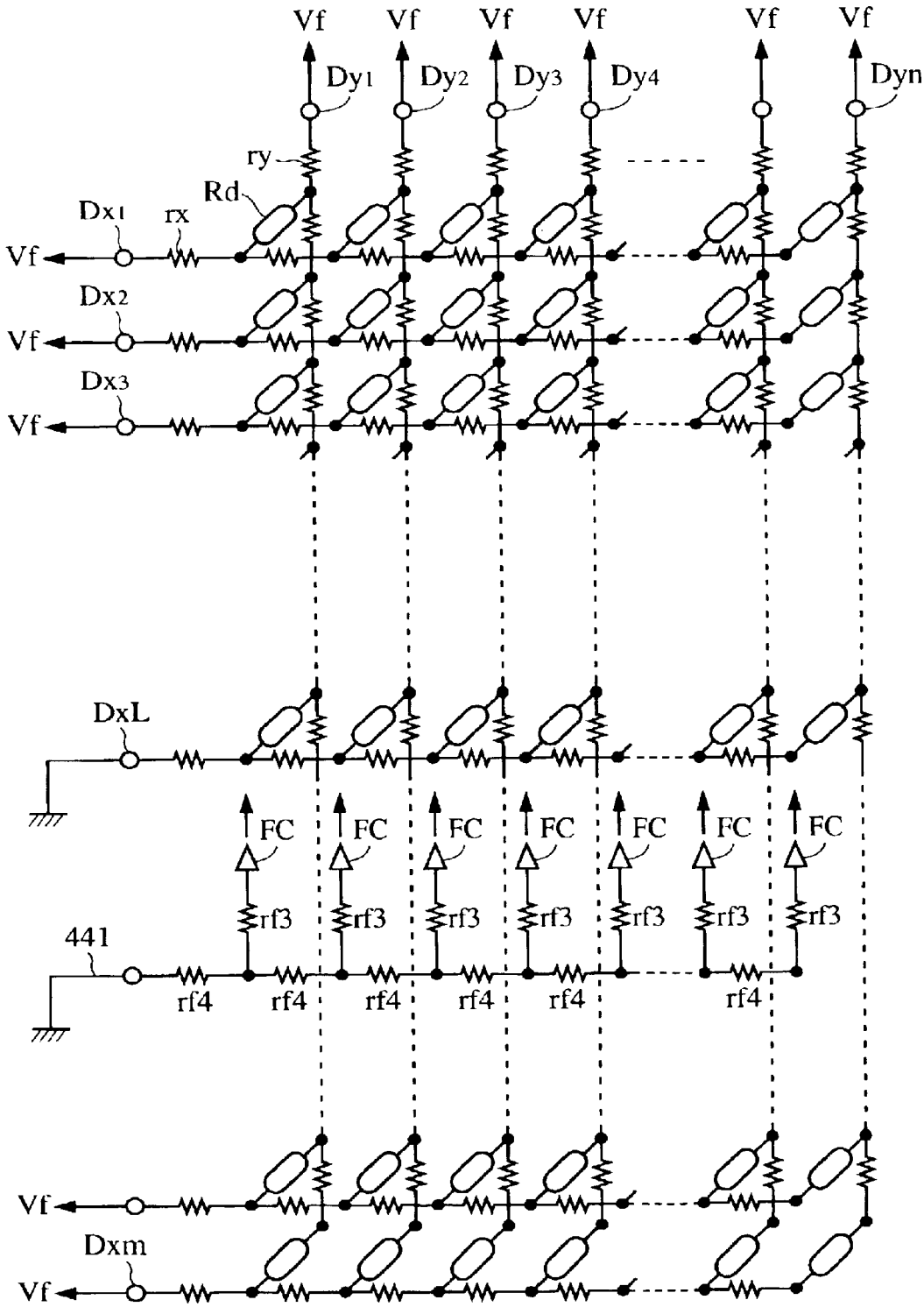
FIG. 44 is a diagram illustrating a "forming" method in a thirteenth embodiment of the present invention.

In this embodiment of the invention, a "forming" method using the above means (B-1) is applied to surface conductivity-type electron emitting devices interconnected by a simple matrix wiring. The electrically connecting means is provided for either rows or columns. The wiring configuration and the electron source substrate having the electron emitting devices are the same as those in the first embodiment. FIG. 44 represents a step of the "forming" treatment of the electron source substrate, which is connected to current input terminals.

The devices are energized by two pairs (a positive pair and a negative pair) of electrically connecting means in the eighth embodiment. In contrast, devices on one horizontal line (row) are subjected to the "forming" treatment as in the first embodiment. In FIG. 44, devices are shown on the L-th row in a wiring matrix of m rows and n columns (m=n=1,000) as in the first embodiment. An end of the common wiring for the selected row (row DxL in FIG. 44) is grounded, and the electrically connecting means shown in FIG. 8 is connected at contact portions of the wiring and the selected devices, and is grounded. The wiring columns (Dy1 to Dyn) and the wiring rows other than the DxL rows (Dx1 to Dxm excluding DxL) are connected to a "forming" power source (not shown) of a potential Vf. The same potential is applied to the unselected wiring rows so that no current flows in the unselected rows.

In this embodiment, current from probes FC suppresses a voltage drop in the L-th row. Although a voltage can be selectively supplied to the L-th row without using the probes FC, the voltage may not reach a desired level if the wiring resistances rx and ry are large. This embodiment solves such a problem: the currents from the probes suppress such a voltage drop due to the row wiring resistance rx and the column wiring resistance ry.

A resistance rf4 is provided for compensating for the voltage drop in each wiring row, and a resistance rf3 is provided for compensating for the voltage drop in each wiring column. The supplied currents are controlled according to simulation of the voltage drop in the wiring rows and columns.

An electron source substrate (m=n=1,000) was subjected to "forming". The variation in potential at the contact section of the spring pin was 0.01 V or less, and the variation in electron emitting efficiency (1%) between devices was 4% or less.

An image forming apparatus prepared as in the twelfth embodiment using the electron source substrate prepared in this embodiment was subjected to "forming". Uniform "forming" of the devices interconnected by a simple matrix wiring was successfully completed. The variation in brightness of the displayed image was 4% or less because of uniform device characteristics.

In this embodiment, an electrically connecting means is provided for each selected device. Alternatively, the variation in applied voltage can be reduced by one connection point. For example, the two ends of the wiring row DxL are grounded and one electrically connecting means is connected to the center of the wiring row. The variation in electron emitting efficiency between the resulting devices is also reduced.

Fourteenth Embodiment

Figure 45:
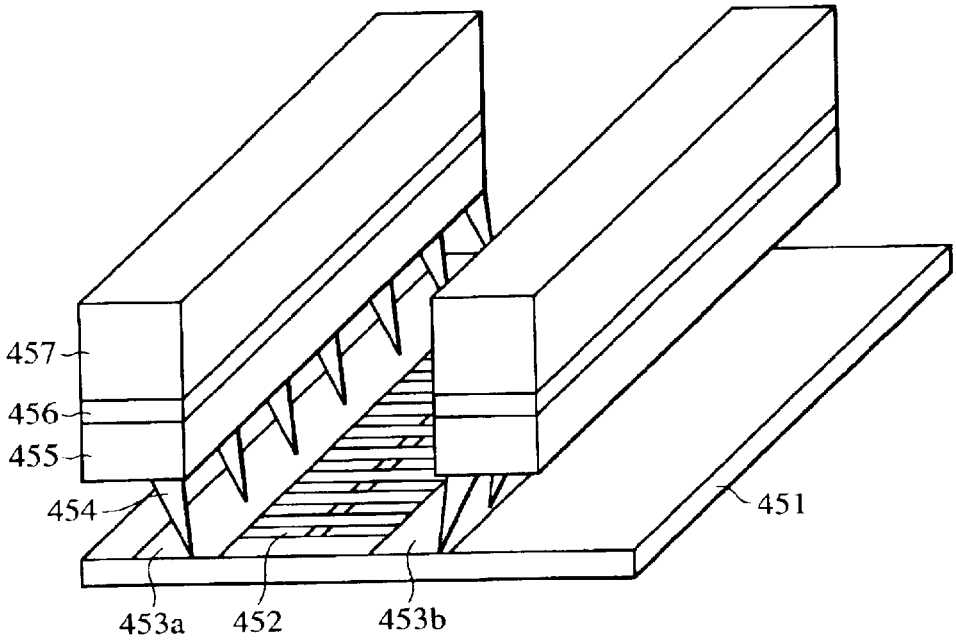
FIG. 45 is a perspective view showing a "forming" apparatus in a fourteenth embodiment of the present invention.
Figure 46:
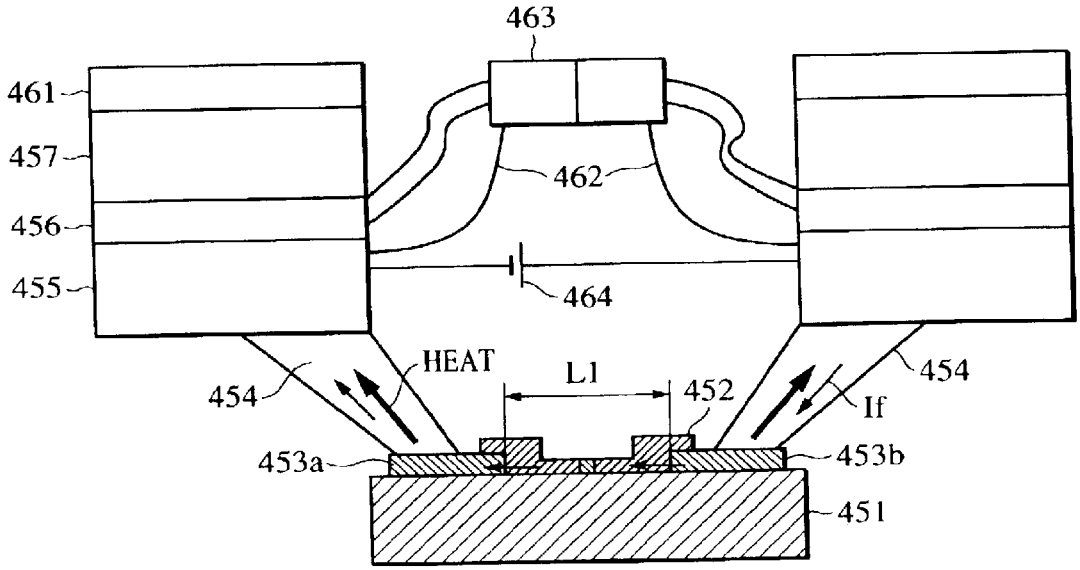
FIG. 46 is a block diagram illustrating the outline of the "forming" apparatus in the fourteenth embodiment of the present invention.

In this embodiment, heating/cooling units having a high heat capacity are provided at copper terminals (electrically connecting means) shown in FIG. 8. FIG. 45 is an isometric view of an apparatus according to this embodiment and FIG. 46 is a block diagram illustrating an outline of the apparatus. Films (decreased-resistance films) 452 are prepared on a glass substrate 451 by the method shown of the eighth embodiment. Ni electrodes (common wirings) 453*a* and 453*b* are disposed at an electrode interval L1 of 20 μm. In this embodiment, 1,000 devices are arranged in one line. A pair of copper styluses 454 for supplying a "forming voltage" is provided for every three devices; thus, 332 pairs of copper styluses 454 are arranged. Pure-copper conductors 455 having a cross-section of 5 mm×20 mm electrically and thermally connect with the respective copper styluses 454. A Peltier device (heating/cooling device) 456 is provided on each copper conductor 455, and a copper bar 457 having a cross-section of 20 mm×20 mm is provided on the Peltier device 456. The copper bar 457 is a conductor having a large heat capacity. A radiator 461 is provided on the copper bar 457. Temperature transducers 462, such as thermo couples, detect the temperature of the copper conductors 455. A temperature controller 463 drives the heating/cooling units 456. The copper conductors 455 are connected to a "forming" power source 464.

In this configuration, the copper styluses 454 are brought into contact with the common wirings 453*a* and 453*b*, and a "forming voltage" is applied to the common wirings 453*a* and 453*b* from the "forming" power source 464 to form a gap (crack) that functions as an electron emitting section in each device film. The resistance of pure-copper conductor 455 between two adjacent terminals is 1/1000 or less than those of the common wirings 453*a* and 453*b*; hence, a uniform "forming voltage" is applied to each device, as described in the eighth embodiment.

Since the heat capacity of the copper conductors 455 is extraordinarily larger than that of the copper styluses 454 and that of the common wirings 453*a* and 453*b*, contact portions of the common wirings 453*a* and 453*b* with the copper styluses 454 can be maintained substantially at a constant temperature. The thermocouples 462 monitor heating of the devices by Joule heat during "forming" and the temperature controller 463 controls the Peltier device 456 to cool the copper conductors 455. As a result, the multielectron source is maintained substantially at a constant temperature. Furthermore, the electrodes (common wirings 453*a* and 453*b*) can be maintained at a low temperature over the entire device range; hence, each device film 452 has a steep temperature profile during the "forming". Thermal destruction occurs in a narrow range of the device film 452 and the relative position of this range is substantially the same in the entire device films 452; hence, variations in the position and shape of gaps are suppressed at low levels.

Using the "forming" apparatus of this embodiment, a "forming voltage" was applied to an electron source substrate shown in the eighth embodiment. The variation in voltage at the contact portions of the copper styluses 454 was 0.01 V or less and the variation in temperature between the devices was 1° C. or less. As a result, the variation in electron emitting efficiency between the devices was suppressed, despite an increased electrode distance L1 of 20 μm.

Using the "forming" apparatus of this embodiment, uniform "forming" of the devices in the image forming apparatus prepared in the twelfth embodiment could be successfully achieved. As a result of uniform device characteristics, a displayed image had uniform brightness.

Fifteenth Embodiment

This embodiment relates to an apparatus performing "forming" by the above means (B-1). An electron source substrate having the same wiring configuration and devices as those in the first embodiment is prepared. A "forming" mechanism has a plurality of electrically connecting means. Each electrically connecting means is brought into contact with each wiring along which 300 devices are disposed in one row, for "forming".

The electron source substrate in this embodiment has 200 device columns. If "forming" is repeated for each column, the "forming process" must consume many hours, which is disadvantageous in commercial production. Thus, a plurality of "forming" mechanisms that are arranged in parallel are provided and are simultaneously driven for reducing the process time.

Figure 47:
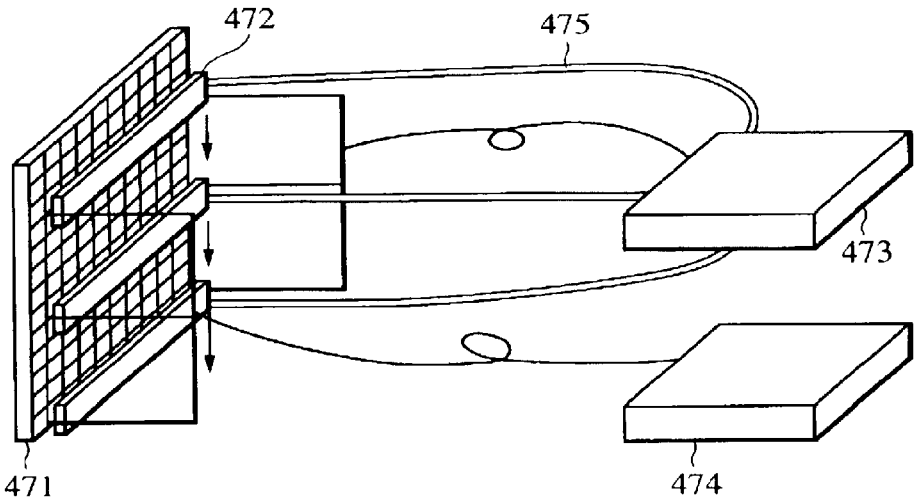
FIG. 47 is a perspective view showing a "forming" apparatus in a fifteenth embodiment of the present invention.

FIG. 47 is an isometric view of the "forming" apparatus used in this embodiment. The "forming" apparatus includes a multielectron source 471 having devices interconnected by a simple matrix wiring, "forming" mechanisms 472 having three electrically connecting means arranged in parallel, a temperature controller 473, a "forming" power source 474, and a temperature detector 475. The number of electrically connecting means employed can be determined in view of the spatial area of on the multielectron source 471 and the allowable current of the "forming" power source 474. A larger number is preferred to reduce the processing time.

"Forming" was performed as in the twelfth embodiment in this configuration. The variation in electron emitting efficiency between surface conductivity-type electron emitting devices was 5% or less. The "forming" time was one-third of that in a one-column "forming process".

In the description of the eighth to fifteenth embodiments, ladder-type multielectron sources and simple matrix two-dimensional multielectron sources were described. The described energizing methods using the electrically connecting means also can be applied to other general wiring patterns than that described herein, as well.

Sixteenth Embodiment

Figure 48:
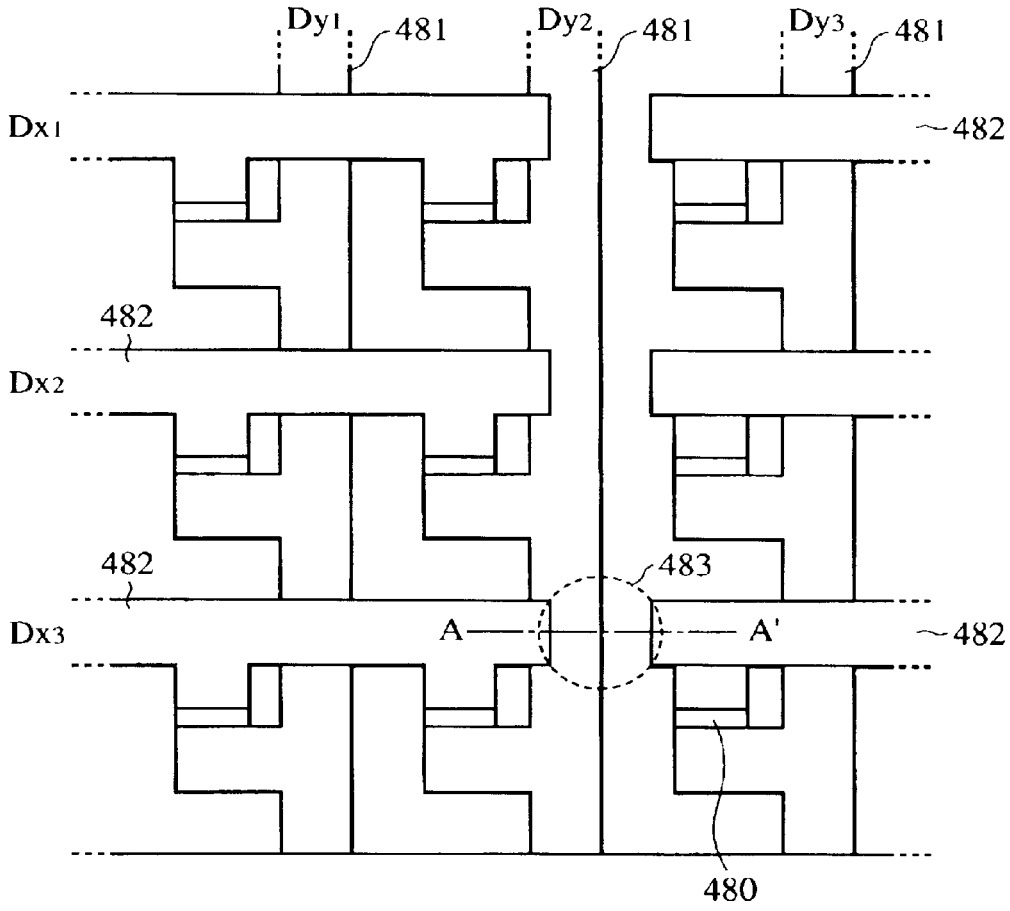
FIG. 48 is a diagram showing the wiring pattern of a simple matrix arrangement electron source according to a sixteenth embodiment of the present invention.

This embodiment relates to "forming" by the means (B-2). A simple matrix wiring pattern as shown in FIG. 48 is prepared as in the first embodiment. The wiring pattern includes wiring columns 481, wiring rows 482, and device films (polymer films) 480. Each of the wiring rows 482 has a gap 483.

Figure 49A:
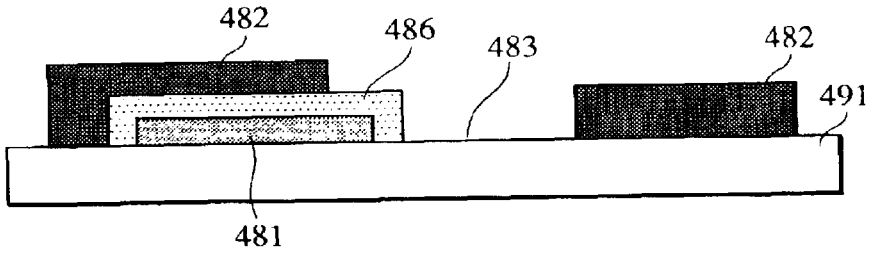
FIG. 49, consisting of FIGS. 49A to 49D, is a drawing illustrating a process for manufacturing the electron source of the sixteenth embodiment of the present invention.

Steps of connecting the gap 483 by high-impedance wiring will now be described with reference to FIGS. 49A to 49D. FIG. 49A is a cross-sectional view taken along line A–A' in FIG. 48. The wiring column 481 and the wiring row 482 are formed on a glass substrate 491. An insulating film 486 is formed on the wiring column 481 to insulate the wiring column 481 and the wiring row 482. The gap 483 of the wiring row 482 is formed.

Figure 49B:
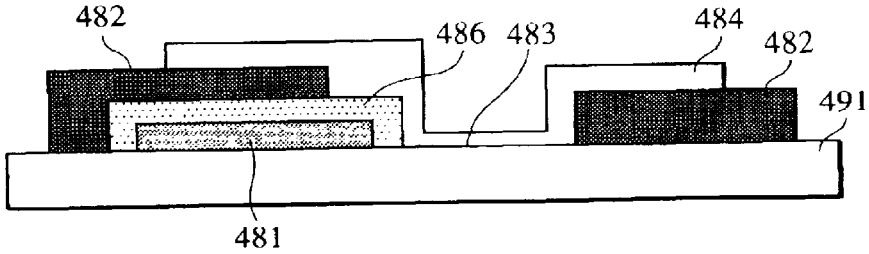

A nickel-chromium alloy is deposited into a thickness of about 2,000 Å by a sputtering process, and the resulting layer is selectively etched by photolithography to form a high-impedance portion 484 at least partially in the gap 483 (FIG. 49B).

Figure 49C:
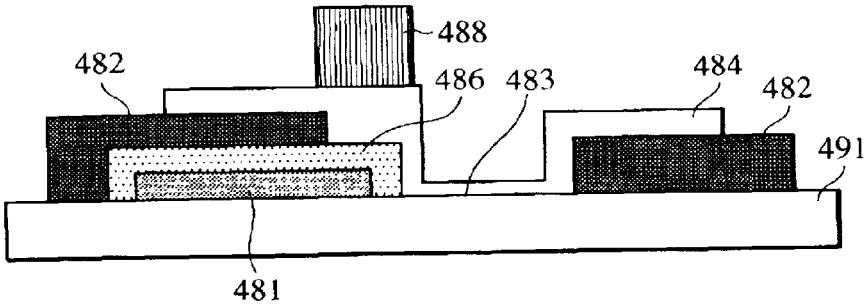
Figure 50:
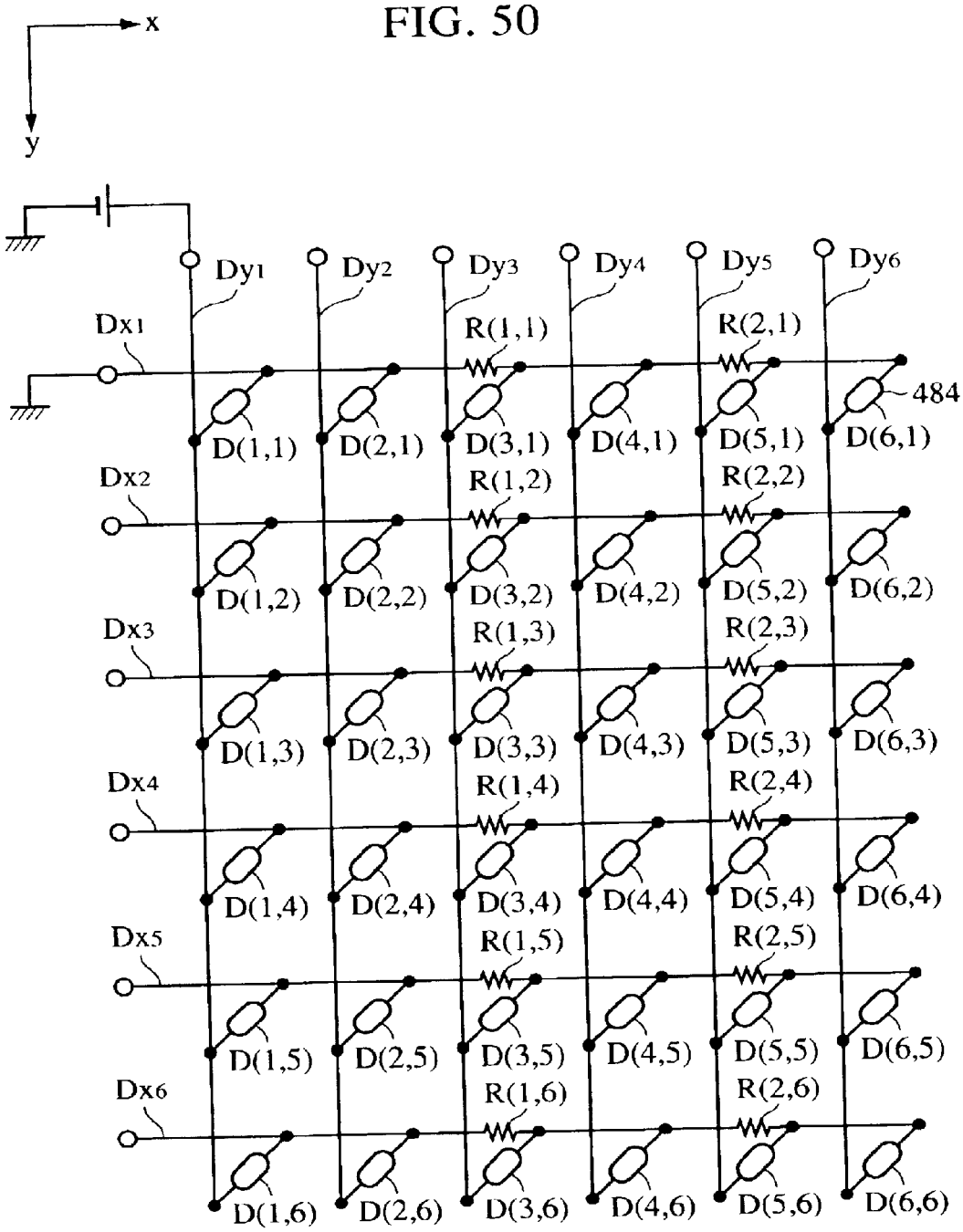
FIG. 50 is a circuit diagram illustrating an intermediate state for manufacturing the electron source of the sixteenth embodiment of the present invention.

A gold-lead paste 488 is applied, on one side of the gap 483, by a microdispenser (FIG. 49C). FIG. 50 is a circuit diagram illustrating the state shown in FIG. 49C. Although, for convenience, an electron source having only 6×6 devices is shown in FIG. 50, the actual electron source in this embodiment preferably has 1,000×1,000 devices, and each of lines Dx1 to Dx1000 has ten high-impedance portions (separated portions), each provided for every 100 devices. In the drawing, the high-impedance portions R(1,1) to R(1,6) and R(2,1) to R(2,6) are depicted only for every two devices, for simplicity, although more of those portions may be provided.

Each of the devices D(1,1) to D(1,6) and D(2,1) to D(2,6) that are disposed closer to a feeding portion than the high-impedance portions R(1,1) to R(1,6) is subjected to "forming" in sequence. FIG. 50 shows a state that a voltage is applied between the wirings Dx1 and Dy1 for "forming" of the device D(1,1). The pulsed voltage shown in the eighth embodiment was applied in this embodiment. The "forming" voltage was 5 V, and the corresponding current was one-fourth of a current applied when no high-impedance portion was provided.

Figure 49D:
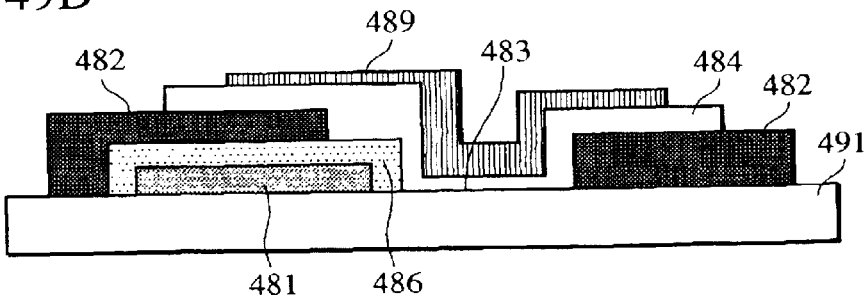

The rear face of the glass substrate 491 is irradiated with a laser beam for heating nickel-chromium thin films 484 at the high-impedance portions R(1,1) to R(1,6). As shown in FIG. 49D, the gold-lead paste 488 is melted by the heat to form a melt portion 489. The separated portions in FIG. 50 in each X line, i.e., the high-impedance portions R(1,1) to R(1,6), are connected by low-resistance conductors.

Figure 51:
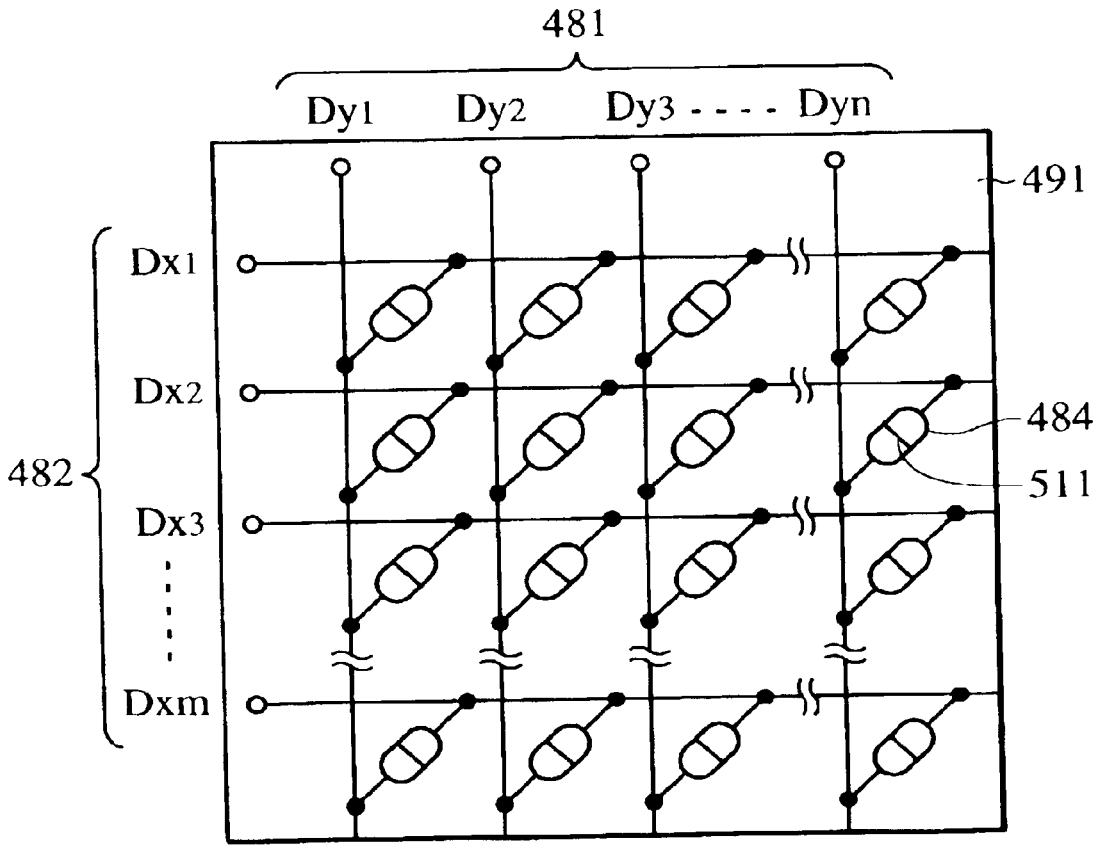
FIG. 51 is a drawing showing the electron source comprising surface conduction type electron emitting devices arranged in a simple matrix in the sixteenth embodiment of the present invention.

Similarly, the devices D(3,1) to D(3,6) and D(4,1) to D(4,6) are subjected to the "forming", and the separated portions R(2,1) to R(2,6) are subjected to low-resistance treatment. The process is repeated until the "forming" of all the devices is completed. As shown in FIG. 51, a gap (electron emitting section) 511 is formed in each device film (decreased-resistance film) 480 (FIG. 48). An electron source having surface conductivity type electron emitting devices that are interconnected by a simple matrix wiring is thereby prepared.

The electron emitting characteristics of the electron source were measured using the measuring apparatus shown in FIG. 6. The electron emitting efficiency $\eta = Ie/If$ (%) was 1%. The variation of the efficiency was very low over the entire panel.

In this embodiment, the "forming" was sequentially performed for each device in the separated portion of the high-impedance portion. Alternatively, devices in a single line at a time may be simultaneously subjected to "forming" as in the first embodiment. The variation of the electron emitting efficiency in such a manner was also low over the entire substrate.

Seventeenth Embodiment

In this embodiment, an image forming apparatus including an electron source substrate that is prepared as in the sixteenth embodiment and is not subjected to "forming" will be described with reference to FIG. 32.

After the "forming" was performed in air or a nitrogen atmosphere as in the sixteenth embodiment, the electron source substrate 1 was fixed onto a rear plate 321 to form an image forming apparatus. Scanning signals and modulation signals were applied from signal generating means (not shown in the drawing) to electron emitting devices through external terminals Dox1 to Doxm and Doy1 to Doyn, while a high voltage of 5 kV was applied through a high-voltage terminal Hv to display an image.

Uniform "forming" was achieved for the devices interconnected by a simple matrix wiring of the image forming apparatus according to this embodiment, and the variation in brightness of a displayed image was 3% or less because of uniform device characteristics.

In this embodiment, the electron source substrate 1 is fixed to the rear plate 321 after the "forming". An image forming apparatus including an electron source substrate 1 not subjected to "forming" may be subjected to "forming" by applying a voltage through the external terminals Dox1 to Doxm and Doy1 to Doyn, and low-resistance treatment of the high-impedance portions may be performed by heating with a laser beam (not shown) through the rear plate 321. In such a manner, the variation in device characteristics was also suppressed to 5% or less.

Eighteenth Embodiment

Figure 52:
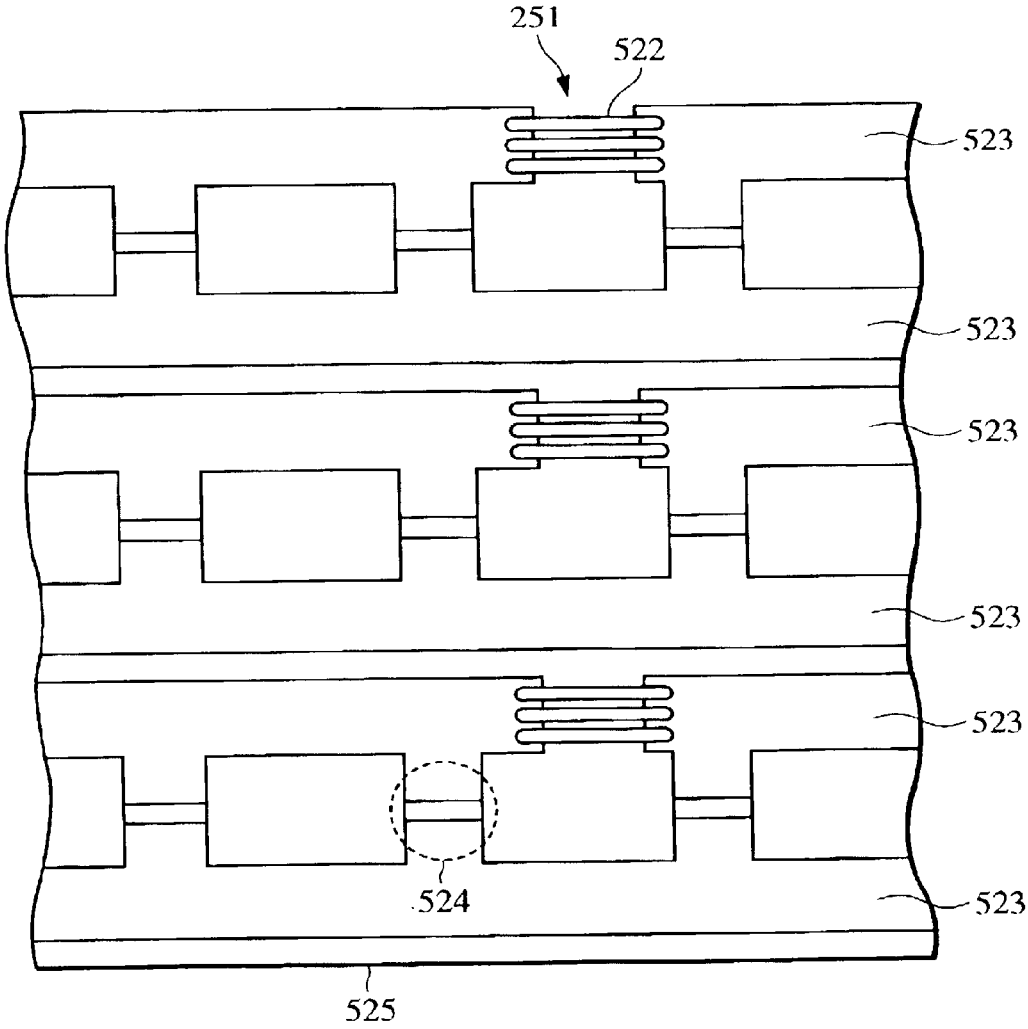
FIG. 52 is a plan view showing a ladder arrangement electron source according to a seventeenth embodiment of the present invention.

This embodiment is another embodiment according to the "forming" by the means (B-2). FIG. 52 is a plan view of an electron source according to this embodiment. Electron-emitting devices 524 are one-dimensionally connected into a ladder shape, and gaps 251 are provided in each wiring 523. FIG. 25 is a circuit diagram of wirings with gaps. For simplicity of the drawing, 6×6 pixels are depicted and each block includes two devices in each row. However, the electron source actually used in the eighteenth embodiment includes 1,000 device column and 1,000 device rows, although other numbers of devices also may be employed. The 1,000 devices on one row are divided into 10 blocks, each including 100 devices. The step for preparing wirings with gaps is substantially the same as that in the sixteenth embodiment.

Figure 53A:
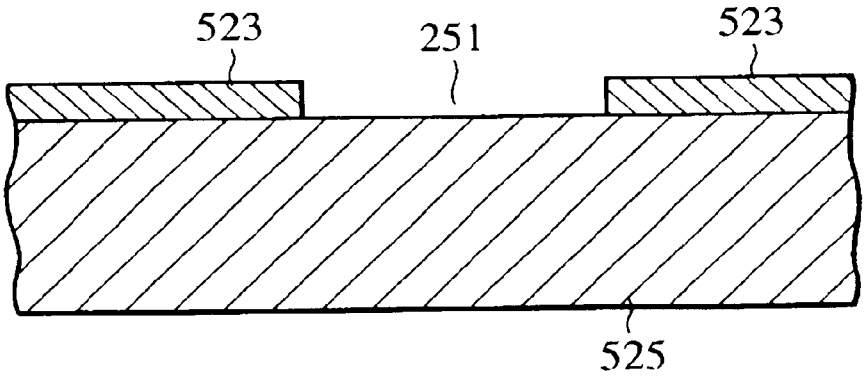
FIG. 53, consisting of FIGS. 53A and 53B, is a drawing illustrating a process for manufacturing the electron source of the seventeenth embodiment of the present invention.
Figure 53B:
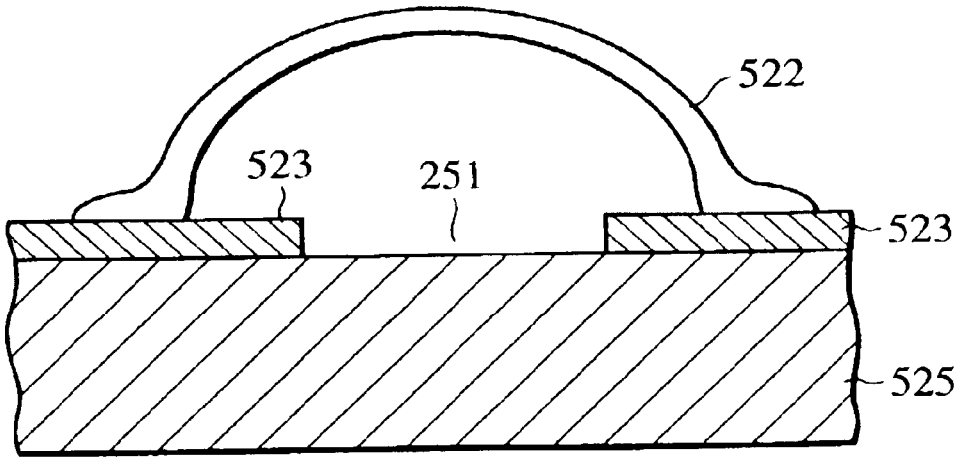
Figure 54A:
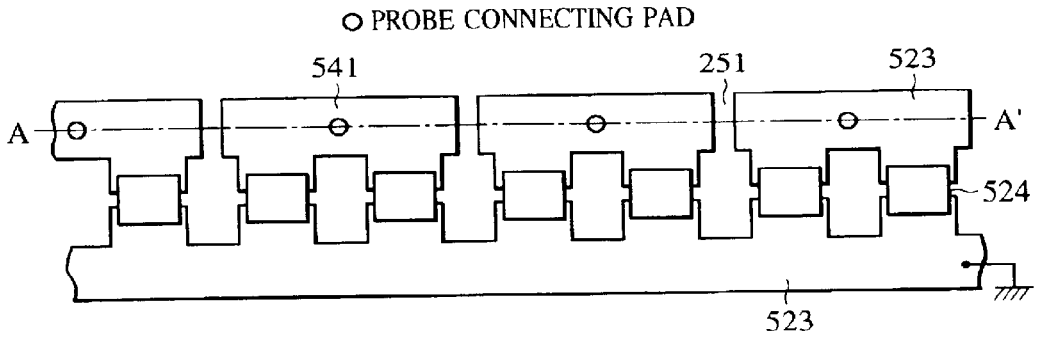
FIG. 54, consisting of FIGS. 54A and 54B, is a drawing illustrating the process for manufacturing the electron source of the seventeenth embodiment of the present invention.

The "forming" and connection of each gap 251 in this embodiment will now be described with reference to FIGS. 52, 53A, 53B, 54A, and 54B. FIG. 53A is a cross-sectional view of the gap 251 and its vicinity before "forming", and FIG. 53B is a cross-sectional view of connection of the wiring 523 at the gap 251 after "forming". FIG. 54A is a plan view illustrating "forming" treatment of a ladder device line, and FIG. 54B is a cross-sectional view taken along line A–A' in FIG. 54A.

Figure 54B:
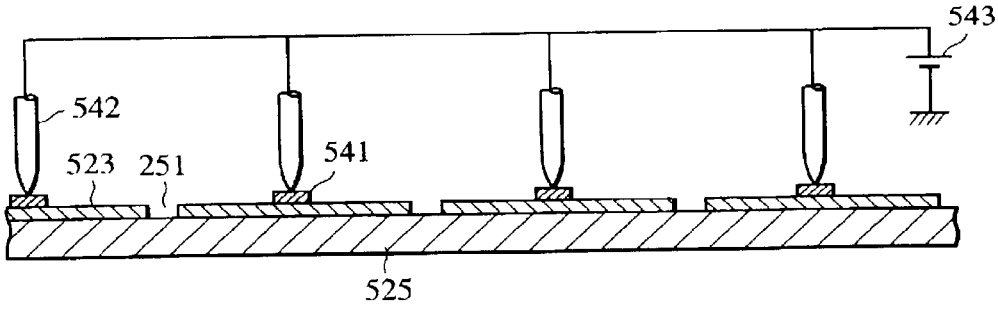

Each of the multiprobes 542 used in the eighth embodiment is connected to the corresponding connection point 541 shown in FIG. 54B. A "forming" power source 543 is connected so that devices in a same line are simultaneously subjected to "forming". A voltage is applied as shown in FIG. 47. The "forming" voltage was 5 V, and the corresponding current for each block (100 devices) was about 0.3 A, which was one-tenth of a current applied when no gap was provided.

Referring to FIG. 53B, the wiring 523 is bonded with three gold wires 522 having a diameter of 30 $\mu$m at each gap 251 to complete the multielectron source substrate.

The configuration of, the material for, and the process for making the devices are not limited to those of this embodiment, and the size of the separation may be determined in view of a "forming" current for one device.

The device characteristics of the electron source of this embodiment were measured as in the sixteenth embodiment. The electron emitting efficiency $\eta$=Ie/If (%) was 1% on average. The variation in the efficiency was very low over the entire panel.

Uniform "forming" was achieved for the surface conductivity type electron emitting devices interconnected by a simple matrix wiring of the image forming apparatus according to this embodiment, and the variation in brightness of a displayed image was 3% or less because of uniform device characteristics.

Nineteenth Embodiment

In this embodiment, an electron source including electron emitting devices interconnected by a simple matrix wiring is prepared by "forming" by the means (B-3).

The electron source including device films that are not subjected to "forming" and interconnected by a simple matrix wiring is prepared as in the first embodiment. The simple matrix including 100×100 devices was prepared in this embodiment. Both the resistance of each device was about 1 kΩ before "forming", and the wiring resistance in the X direction (lower wiring) and the wiring resistance in the Y direction (upper wiring) were about 0.01 Ω. Two electron source substrates were prepared and were subjected to the following two "forming" treatments:

"Forming" Treatment 1 According to this Embodiment

Figure 55:
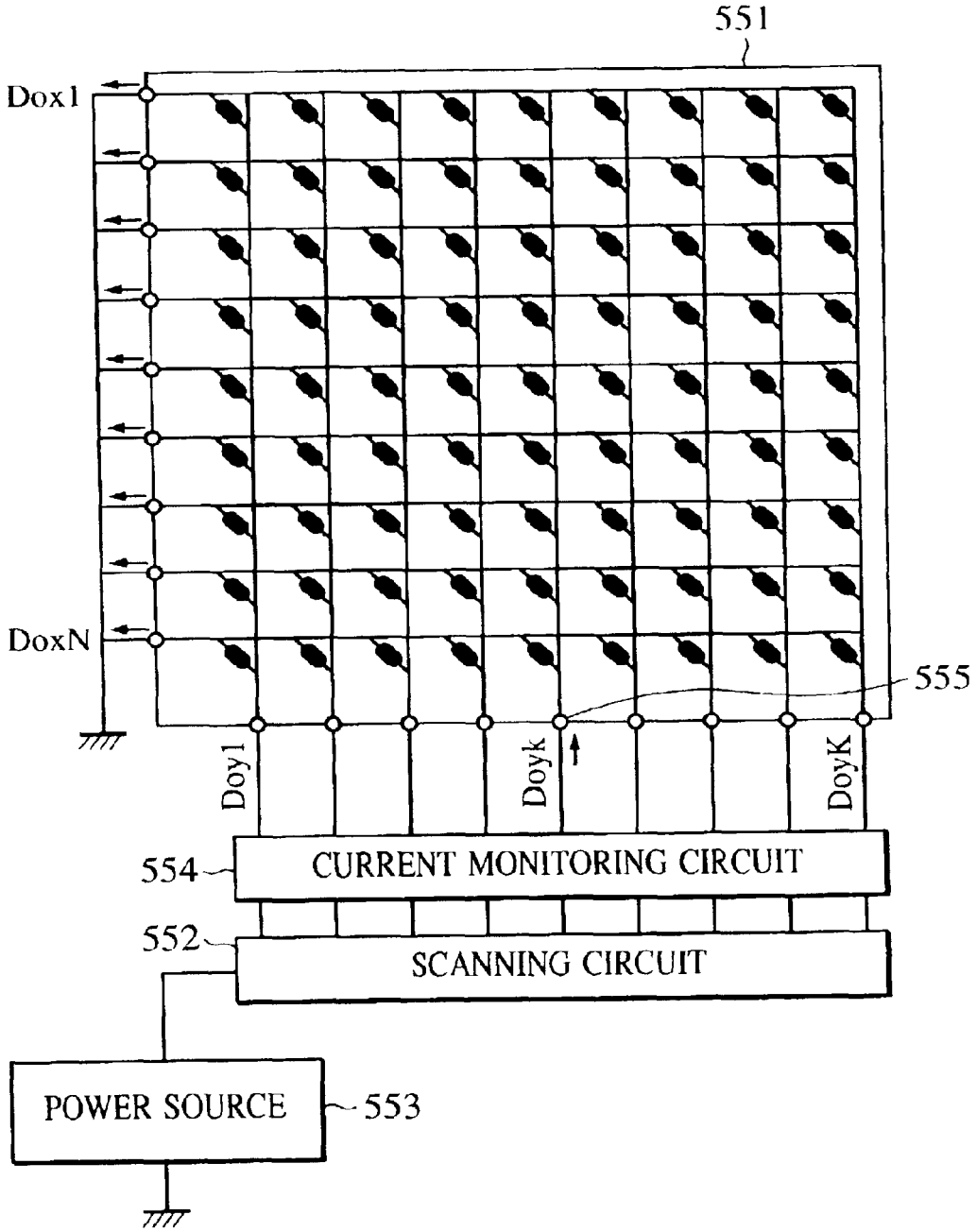
FIG. 55 is a drawing illustrating a process for manufacturing an electron source of a nineteenth embodiment of the present invention.

The "forming" treatment will now be described with reference to FIG. 55. One electron source substrate 551 of the prepared electron source substrates was connected to a power source 553 through an external scanning circuit 552 so that connection terminals Doy1 to DoyK connecting Y-direction wirings were sequentially a power feeding portion 555 (the power feeding portion is the connection terminal Doyk in the drawing), whereas connection terminals Dox1 to DoxN connecting X-direction wirings were grounded. The current flowing in the feeding portion was monitored by a current monitoring circuit 554 that detected the impedance of one line to be treated.

Figure 56A:
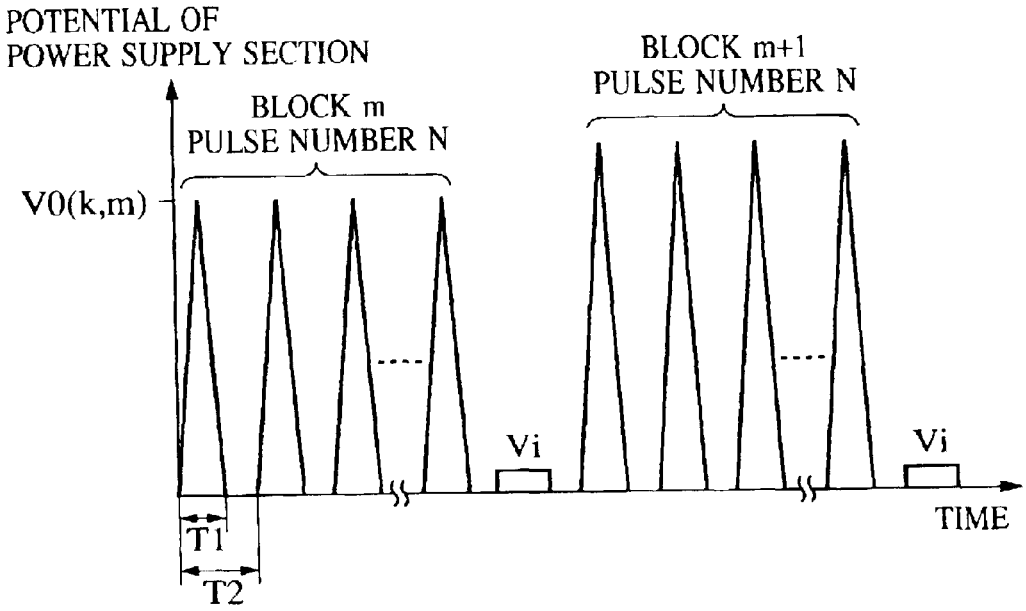
FIG. 56, consisting of FIGS. 56A 56B, is a diagram illustrating a "forming step" in the nineteenth embodiment of the present invention.

"Forming" pulse voltages shown in FIG. 56A were applied, wherein T1 was about 1 millisecond, T2 was about 10 milliseconds, and N was about 10. The number of blocks of devices to which pulsed "forming" voltages are applied was 10. The (peak) voltage applied to the feeding portion Doyk was as follows:

$$V0(k,m)=8.5\times\{1+k/10000+0.05m-0.001m\times m\}$$

wherein m=1 to 10.

Figure 56B:
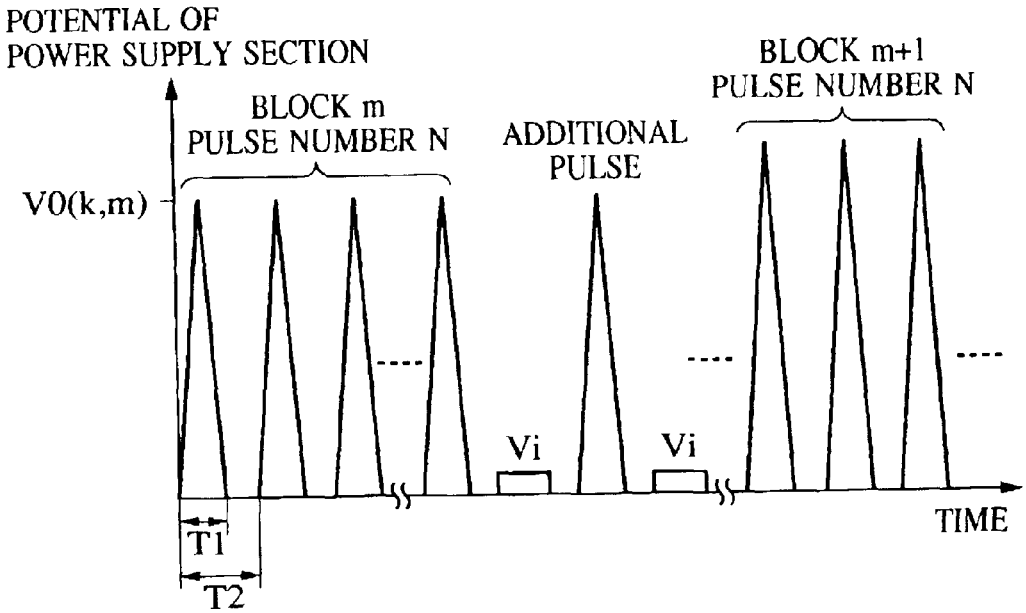

After N "forming" pulses shown in FIG. 56A were applied, voltage V1 that was lower than the applied voltage V0(k,m) was applied to measure the impedance without affecting devices that were not subjected to "forming" treatment. When the measured impedance at the kth line and mth block was lower than the threshold value of the "forming" treatment, additional "forming" pulses shown in FIG. 56B were applied to complete the "forming" treatment.

"Forming" Treatment 2 for Reference

Another electron source substrate was connected to the circuit use in "Forming" Treatment 1, except that the current monitoring circuit 554 was not operated. Pulsed voltages shown in FIG. 16 were simultaneously applied to all the devices wherein T1 was about 1 millisecond, T2 was about 10 milliseconds, and the peak voltage was about 9.3 V.

Characteristics of individual electron emitting devices of the multielectron sources (prepared by "Forming" Treatments 1 and 2) were measured through the terminals Doxl to DoxN and Doy1 to DoyK as in the sixteenth embodiment. The electron emitting efficiency $\eta$=Ie/If according to "Forming" Treatment 1 of this embodiment was 1%, and the variation in the efficiency was 3% or less over the entire panel. In contrast, the electron emitting efficiency $\eta$=Ie/If according to "Forming" Treatment 2 was 1%, but the variation in the efficiency was 10% or more over the entire panel.

Figure 57A:
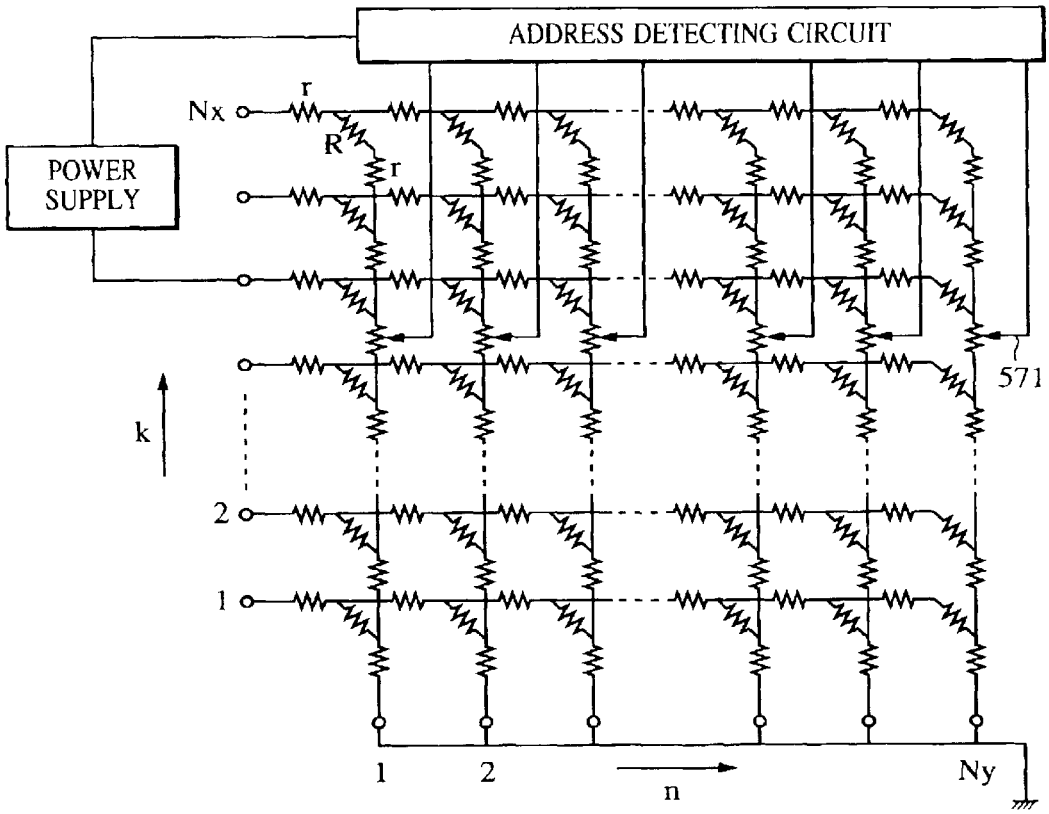
FIG. 57, consisting of FIGS. 57A 57B, is a diagram illustrating a method of detecting a device address in a method of manufacturing an electron source of the present invention.

In this embodiment, an address was detected by an impedance measurement. The method for detecting the address by the potential distribution of the wiring will now be described with reference to FIGS. 57A and 57B.

Figure 57B:
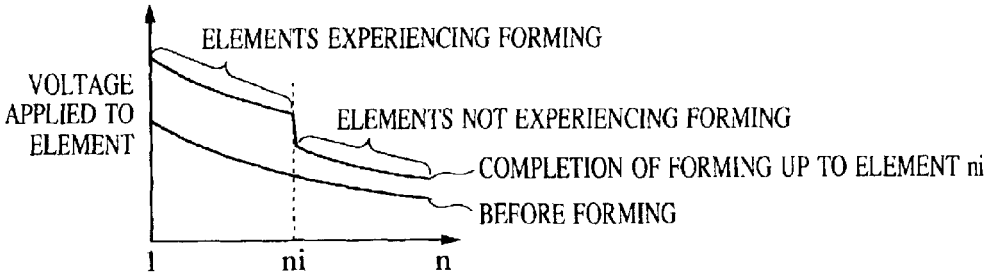

Since the impedance varies during the "forming" treatment, the potential of the wiring near the device after the "forming" treatment significantly varies as shown in FIG. 57B. A probe pin 571 is connected to the wiring and a change in the potential distribution of the wiring is detected. The address of the device after completion of the "forming" treatment can thereby be detected.

Twentieth Embodiment

In this embodiment, an image forming apparatus shown in FIG. 40 is prepared using a ladder-arranged electron source that is prepared by the "forming" treatment by the means (B-3).

Electron emitting devices (device films) were prepared on an insulating substrate 1 in this embodiment as in the eighth embodiment. The size of the device films before "forming" was the same as that in the eighth embodiment, except that the number of the devices on one line was 200 and the feeding section and the ground section were provided at both ends of the electrode. The equivalent circuit was the same as that shown in FIG. 22C.

Figure 58:
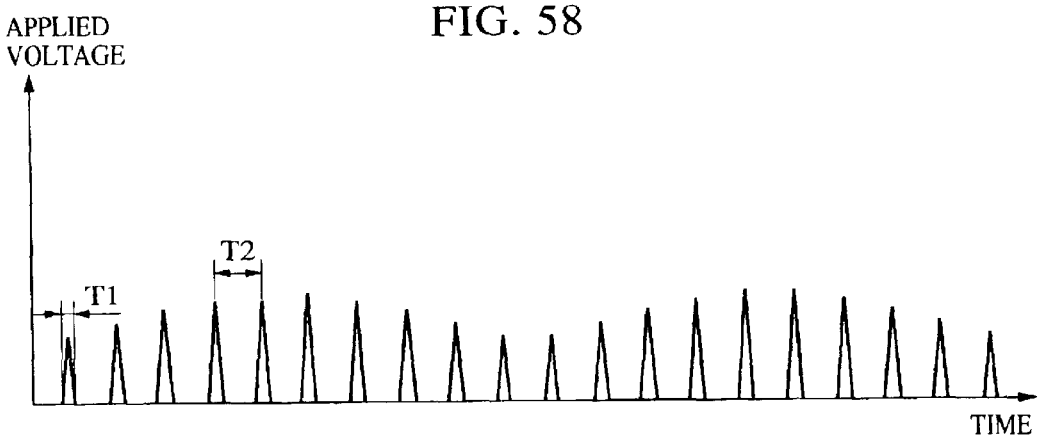
FIG. 58 is a diagram showing the pulse waveform used in a "forming step" in a twentieth embodiment of the present invention.

"Forming" pulses shown in FIG. 58 were applied to the electron source substrate 1. The peak value of these pulses gradually increased from 8 V to a maximum of 9 V and then gradually decreased to 8V. This cycle was repeated twice, wherein T1 was about 1 millisecond, T2 was about 10 milliseconds, and the total time of the entire cycles was about 5 seconds. These peak values were optimized based on various conditions. The variation in electron emitting efficiency between the devices was maintained at a low level. In this embodiment, simultaneous "forming" of the devices could be achieved without detecting devices of which "forming" had been completed.

The method for applying the voltage in this embodiment can also be applied in the first to nineteenth embodiments.

Twenty-first Embodiment

In this embodiment, a voltage is simultaneously applied to a plurality of wiring columns or rows of an electron source substrate having many devices connected in a matrix so that the devices are simultaneously subjected to "forming" treatment.

An electron source substrate 1 was prepared as in the first embodiment in which devices films (decreased-resistance films) were interconnected by a simple matrix wiring and were not subjected to "forming" treatment. The matrix included 1,024×3,072 devices. The untreated devices had a resistance of about 1 kΩ, and both the wiring resistance in the X direction and the wiring resistance in the Y direction for each device was about 0.01 Ω.

For applying a "forming" voltage, the 1,024 wirings in the X direction are divided into 16 groups, each including 64 wirings. The voltage is applied to one group, and a switch is operated. This operation is repeated until all the devices are subjected to the "forming" treatment.

Every sixteenth wiring in the X direction is allocated a respective one of plural groups. More specifically, for example, the first group includes X-direction wirings Dx1, Dx17, Dx33, Dx49, . . . , and Dx1009, and the second group includes X-direction wirings Dx2, Dx18, Dx34, Dx50, . . . , and Dx1010. Such allocation achieves uniform Joule heat generation during "forming" over the entire substrate 1. The uniform heat generation results in uniform gap formation in the device films and prevents damage of the substrate from thermal stress.

Figure 59:
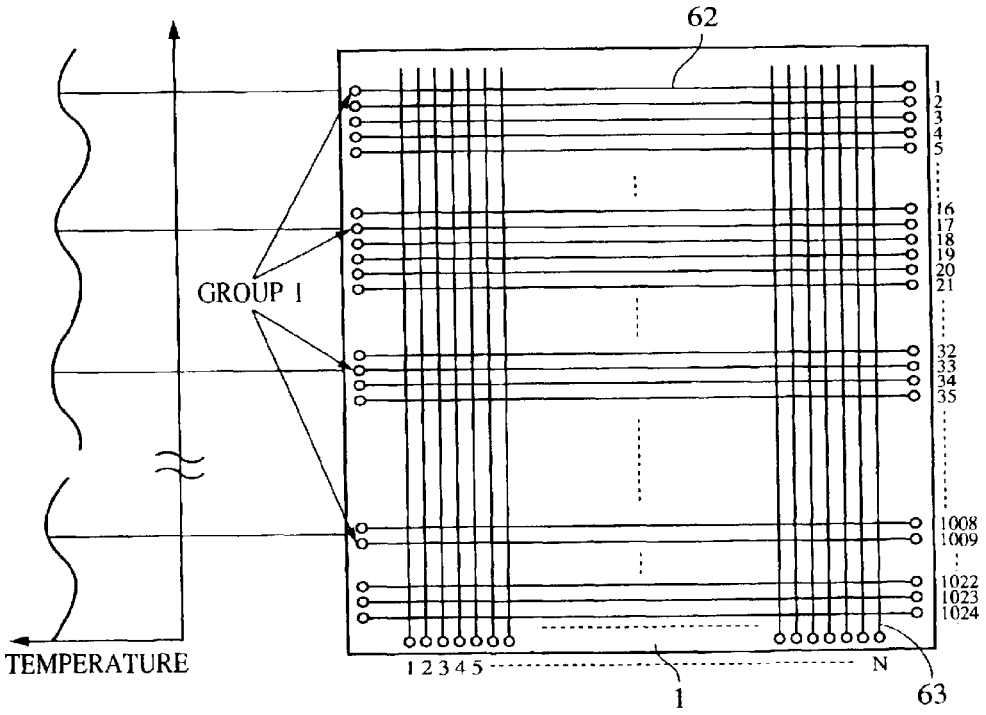
FIG. 59 is a schematic diagram showing a temperature distribution of a substrate during "forming" in a twenty-first embodiment of the present invention.

FIG. 59 is a schematic diagram showing the temperature distribution of the substrate 1 when a "forming" voltage is applied to the first group. In this embodiment, the distance between wirings that belong to a same group is substantially the same; however, in other embodiments, the distance need not be the same if the generation of Joule heat is substantially uniform.

The "forming" pulse has a waveform shown in FIG. 16. For example, the pulse width T1 is about 1 millisecond, and the pulse interval T2 is about 10 milliseconds. The peak voltage Vpf may be gradually increased. Alternatively, pulses with a peak voltage Vpf of 0.1 V are applied for every five pulses and the current is monitored to determine the end of the "forming" treatment for each group. For example, when the resistance per device exceeds 1 MΩ, the treatment for this group is completed, and a subsequent group is processed by switching the connection. This process is repeated in the same manner until all the devices are subjected to the "forming" treatment.

If the number of X-direction wirings is large, the "forming" time can be significantly decreased compared with that for a "forming" treatment of every X-direction wiring individually. In this embodiment, the number of the X-direction wirings belonging to one group is 64. This number may be changed according to design criteria of the electron emitting devices and wirings and predetermined operating criteria.

Figure 60:
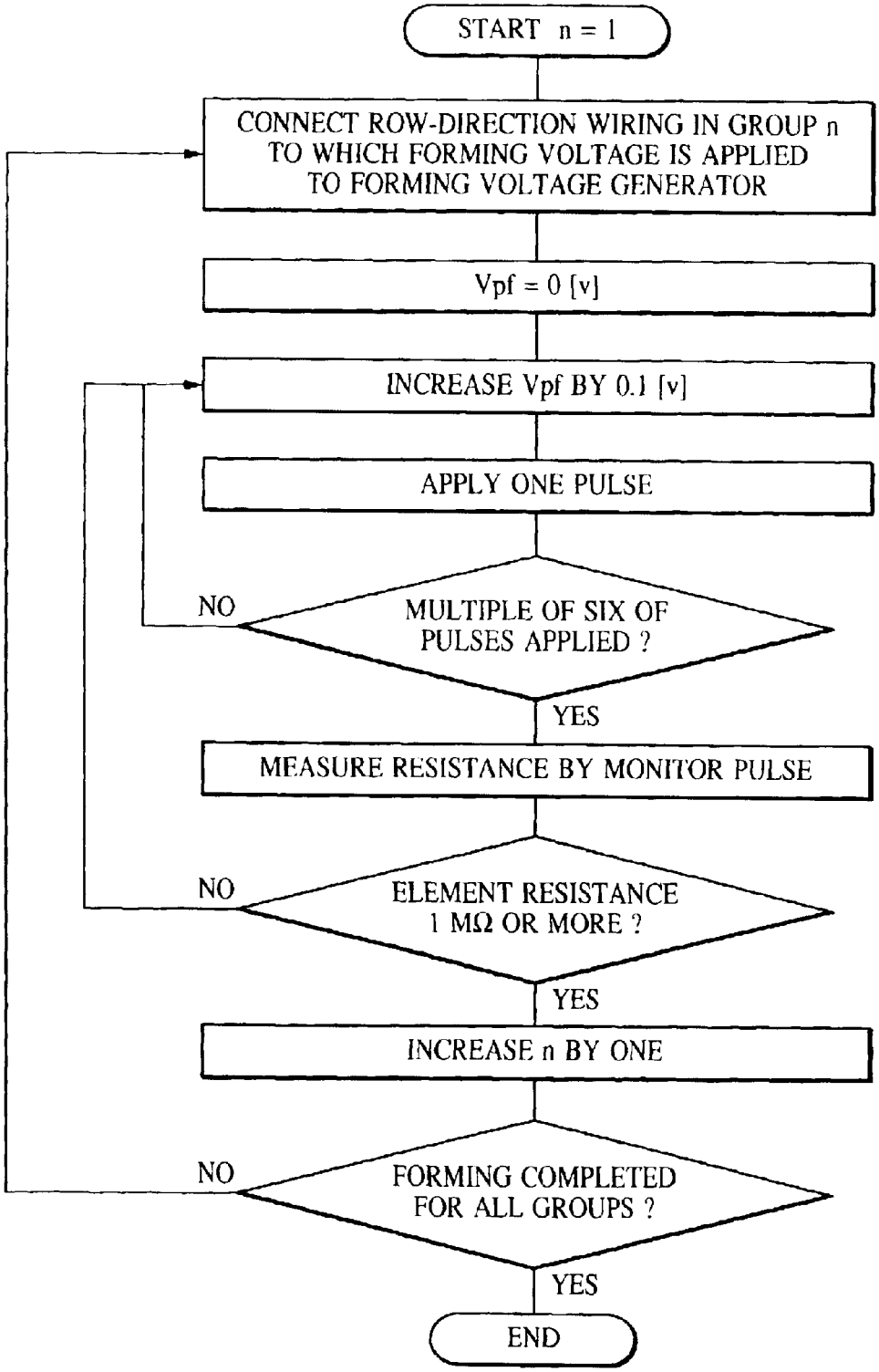
FIG. 60 is a flowchart showing a "forming step" in the twenty-first embodiment of the present invention.

FIG. 60 is a flow chart of the "forming" treatment in this embodiment. In this embodiment, a container (display panel) 328 shown in FIG. 32 is formed by sealing before the electron source is subjected to "forming".

Next, the container 328 is heated and evacuated to about $10^{-4}$ Pa through an exhaust tube. The exhaust tube (not shown) is sealed to an airtight container (not shown).

A display device was prepared according to the above process and was driven. A uniform image with a high brightness level was obtained.

Twenty-second Embodiment

In this embodiment, the X-direction wirings of the electron source of the twenty-first embodiment are divided into groups as in the twenty-first embodiment. A pulsed voltage is applied to each group by a "scrolling" process.

In the "scrolling" process, one voltage pulse is applied to a first X-direction wiring, and then one voltage pulse is applied to a subsequent X-direction wiring. This operation is repeated until one voltage pulse has been applied to all X-direction wirings, and one voltage pulse then is again applied to the first X-direction wiring, and so on. The operation is repeated until "forming" treatment for all device films (decreased-resistance films) has been completed.

Figure 61:
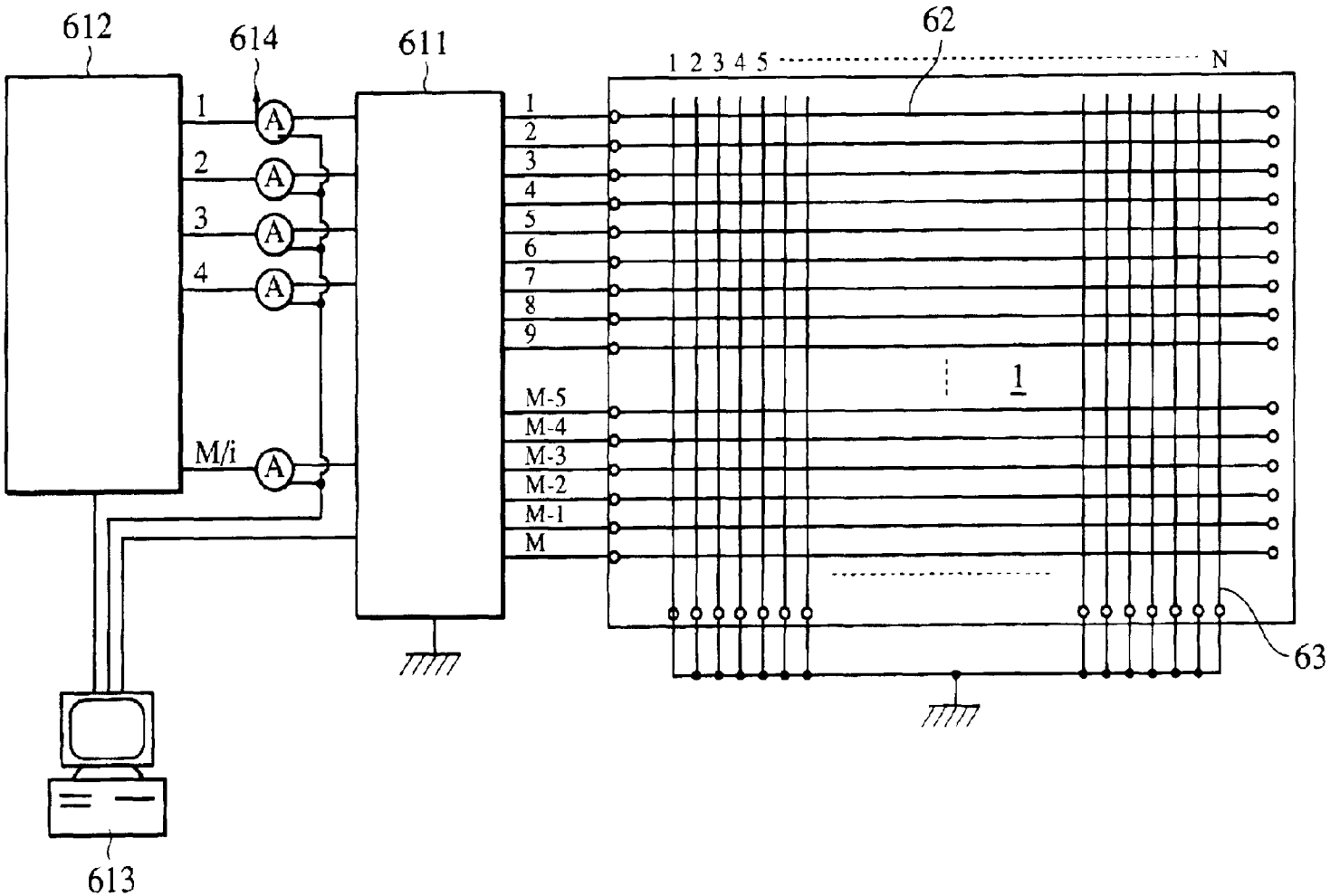
FIG. 61 is a schematic diagram showing an example of the construction of an apparatus used for a "forming step" in a twenty-second embodiment of the present invention.

FIG. 61 is a schematic diagram of a "forming" apparatus in this embodiment. A "forming" voltage generator 612 has 16 output terminals so that pulses are output to these terminals with a time lag. A wiring switch 611 connects an output terminal of the "forming" voltage generator 612 with X-direction wirings of one group, for example, an output terminal 1 of the "forming" voltage generator 612 with X-direction wirings 62 of a group 1 and an output terminal 2 of the "forming" voltage generator 612 with X-direction wirings 62 of a group 2.

This process may be achieved using the apparatus shown in the twenty-first embodiment; however, the wiring switch 611 must be operated at a very high rate in such a case. In this embodiment, although the "forming" voltage generator 612 must have a plurality of output terminals and must output pulses to these output terminals with a time lag, the operation rate of the wiring switch 611 is not required to be so high. Such a configuration is suitable for a wiring switch 611 including mechanical relay switches, although other types of relays, including non-mechanical relays, also may be employed.

Figure 62:
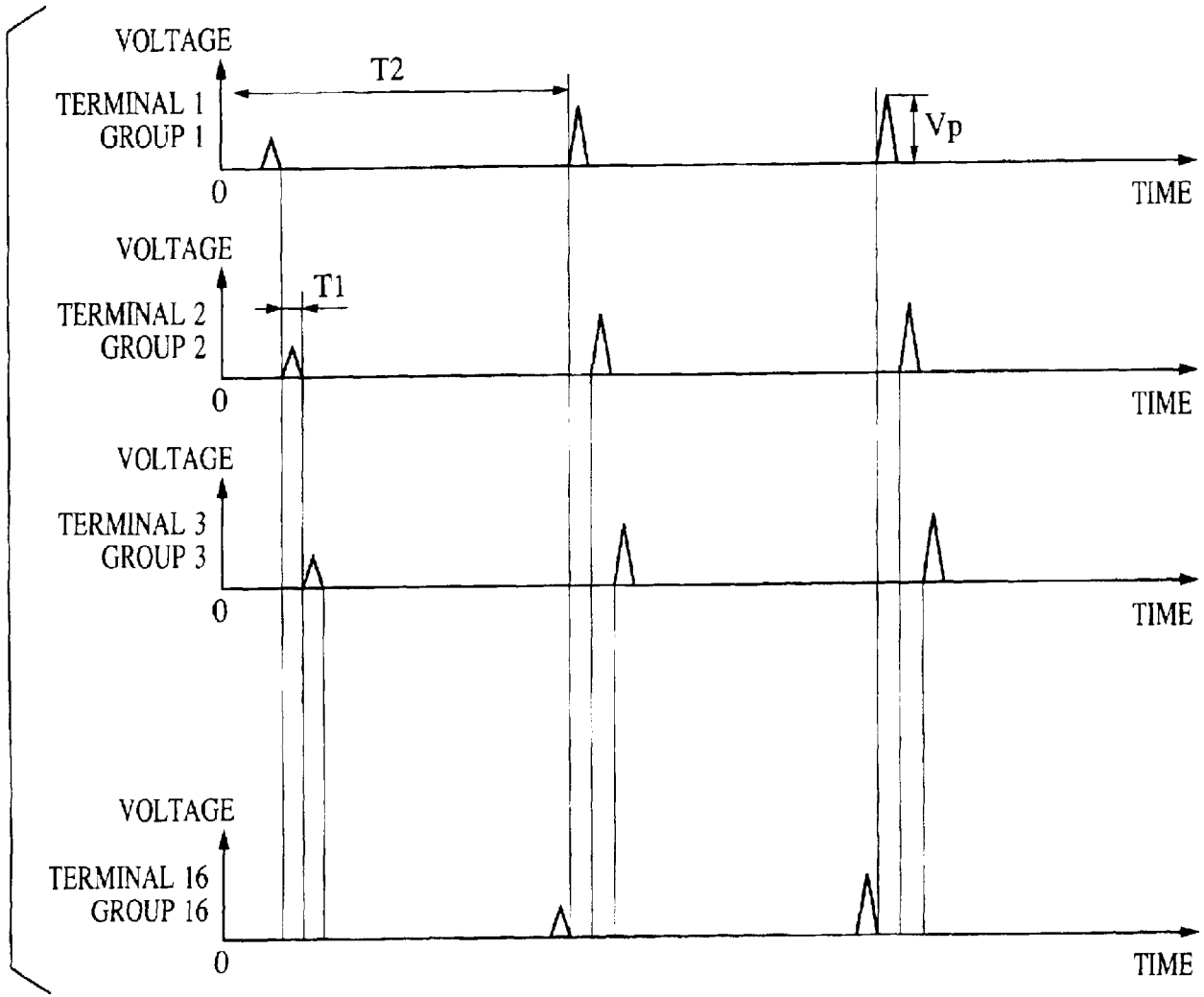
FIG. 62 is a diagram illustrating a method of applying pulses for "forming" in the twenty-second embodiment of the present invention.

In this embodiment, 1,024 X-direction wirings are divided into 16 groups, each group including 64 X-direction wirings, as in the twenty-first embodiment. Application of pulses to these groups will now be described with reference to FIG. 62.

One group is selected by the wiring switch 611 for applying one pulse generated in the "forming" voltage generator 612 to the group. After one pulse is applied to the group 1, the wiring switch 611 switches the connection of the "forming" voltage generator 612 to the group 2 and one pulse is applied to the group 2. The operation is then repeated for each following group up to and including the group 16 (first application session), and application of one pulse to the group 1 is then repeated, and so on (second application session). In the drawing (FIG. 62), the pulse height Vp is gradually increased at the beginning of each application session after the first operation session. The pulse width T1 and the pulse interval T2 have the following relationship: $T1 \leqq T2/N$ wherein N is the number of the groups. In this embodiment, $T1 \leqq T2/16$. For example, when T1=1 millisecond, T2 is equal to or larger than 16 milliseconds.

Figure 63:
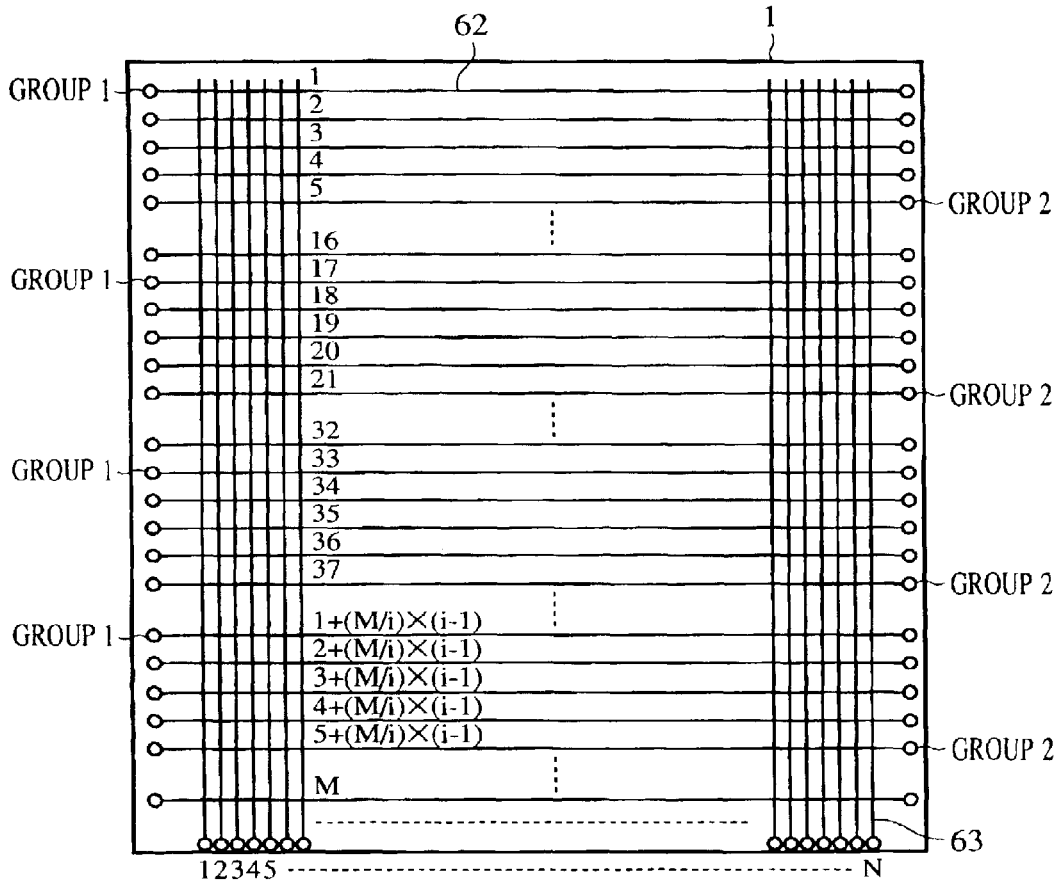
FIG. 63 is a diagram illustrating the "forming step" in the twenty-second embodiment of the present invention.

Referring to FIG. 63, in this embodiment, X-direction wirings that belong to each group are distant from other X-direction wirings that belong to a consecutively numbered group. Furthermore, X-direction wirings belonging to the group 1 are distant from X-direction wirings belonging to the group 2. More specifically, the group 1 includes X-direction wirings 1, 17, 33, 49, . . . , $1+(M/i)\times(i-1)$, the group 2 includes X-direction wirings 5, 5+16 (21), 5+32 (37), . . . , $5+(M/i)\times(i-1)$, and the group k includes X-direction wirings a(k), a(k)+16, a(k)+32 , . . . , $a(k)+(M/i)\times(i-1)$, wherein M is the total number of the X-direction wirings, that is, 1,024 in this embodiment, and i is the number of the groups, that is 16 in this embodiment. In this embodiment, a(k) values are 1, 5, 9, 13, 2, 6, 10, 14, 3, 7, 11, 15, 4, 8, 12, and 16 for k=1 to 16. This arrangement achieves uniform heat generation in the substrate 1. Any other arrangement that achieves uniform heat generation may be employed in the present invention.

In order to reduce the time required for the "forming", "forming" voltage pulses are applied to continuous groups at short time intervals. Since the X-direction wirings of consecutively numbered groups are distant from each other, heat generation caused by application of the "forming" voltage is substantially uniform on the substrate 1.

Such application of the "forming" voltage to each group causes increased heat generation per unit time on the electron source substrate 1. It is believed that damaging and deformation of the substrate 1 are caused by localized heat generation on the substrate 1, not by the amount of heat generated on the substrate 1. Thus, the method according to this embodiment does not cause damaging and deformation of the substrate 1 because of uniform heat generation.

The "forming process" according to this embodiment can reduce the "forming" time compared with the process shown in the first embodiment and prevents deformation and damaging of the electron source substrate 1 during the "forming" treatment.

Twenty-third Embodiment

Figure 64:
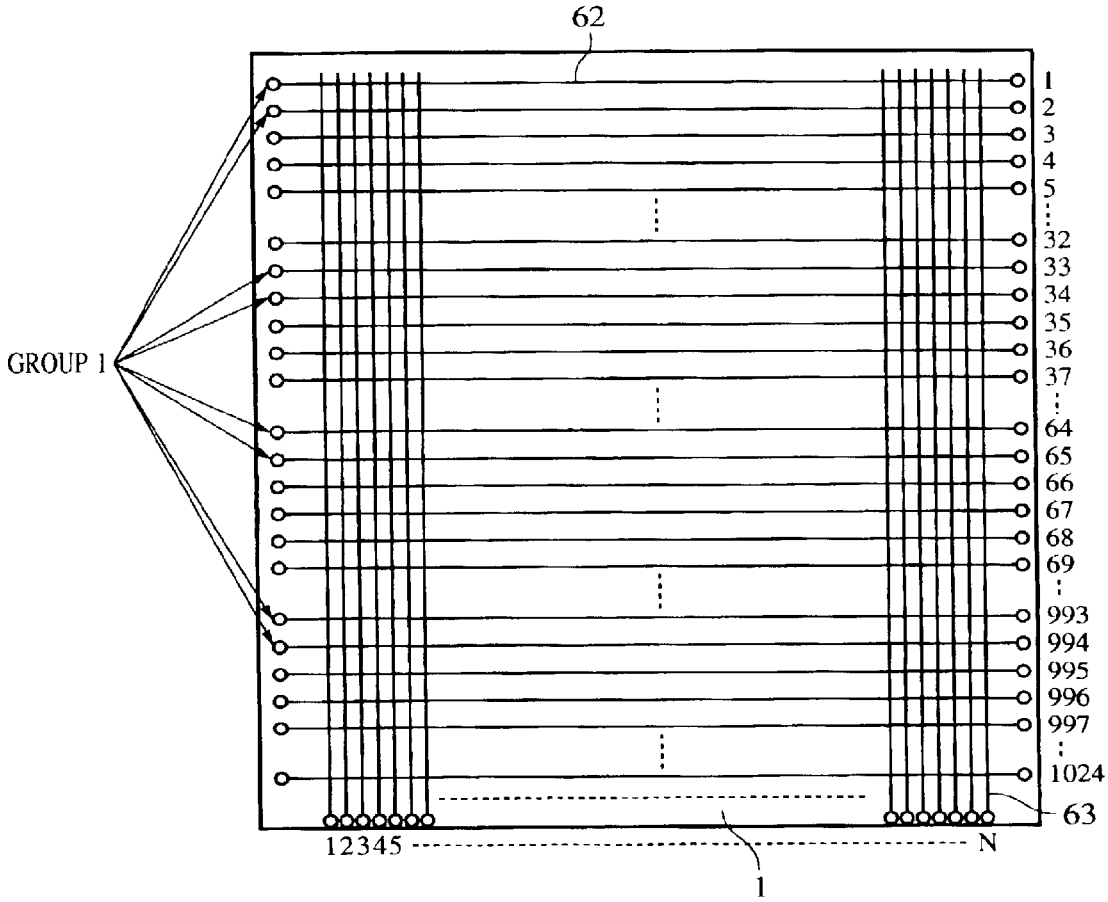
FIG. 64 is a diagram illustrating a "forming step" in a twenty-third embodiment of the present invention.
Figure 65A:
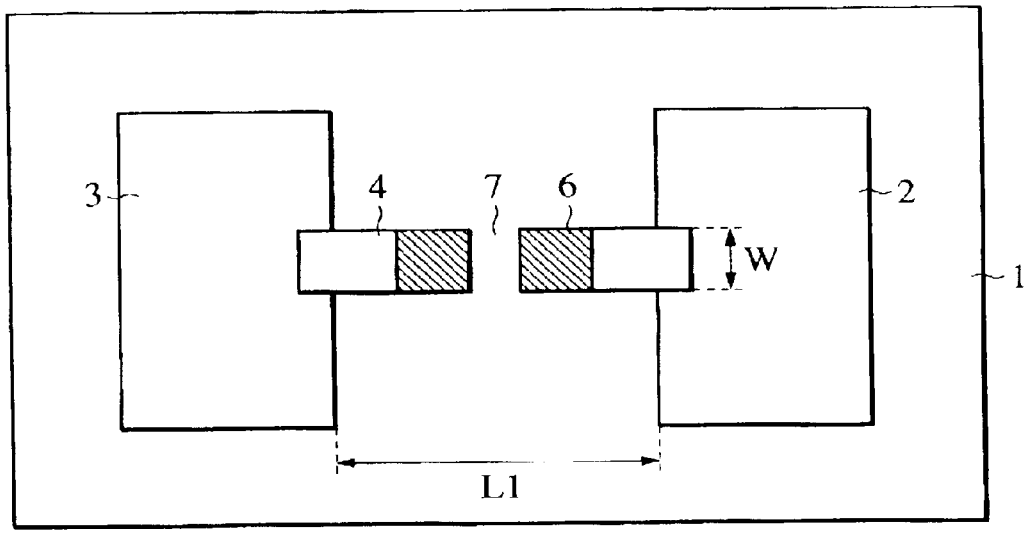
FIGS. 65A and 65B are respectively a plan view and a sectional view showing the construction of a surface conduction type electron emitting device.
Figure 65B:
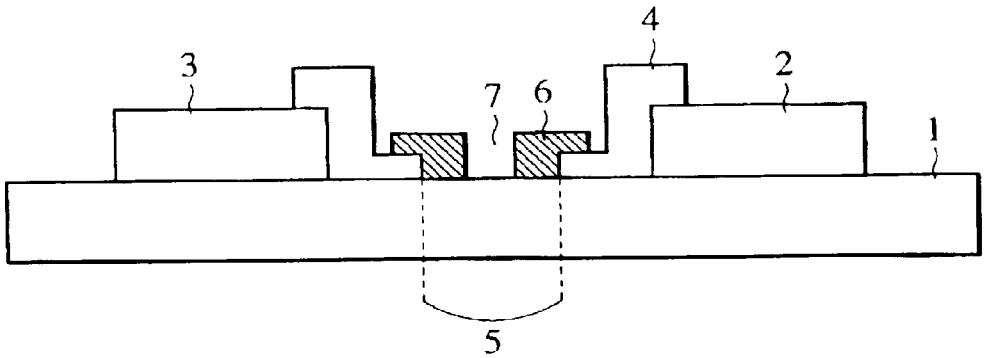
PRIOR ART FIG. 65B
Figure 66A:
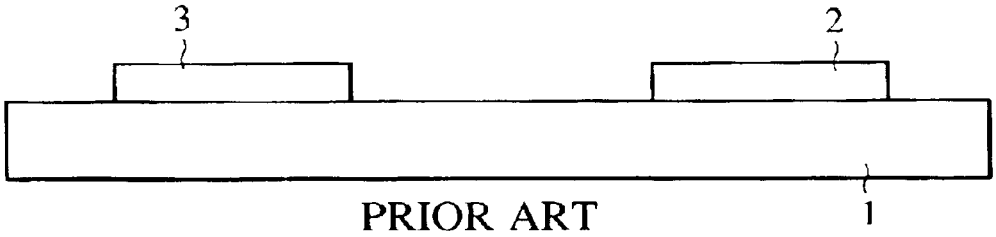
FIG. 66, consisting of FIGS. 66A to 66D, is a drawing illustrating a process for forming a conventional surface conduction type electron emitting device.
Figure 66B:
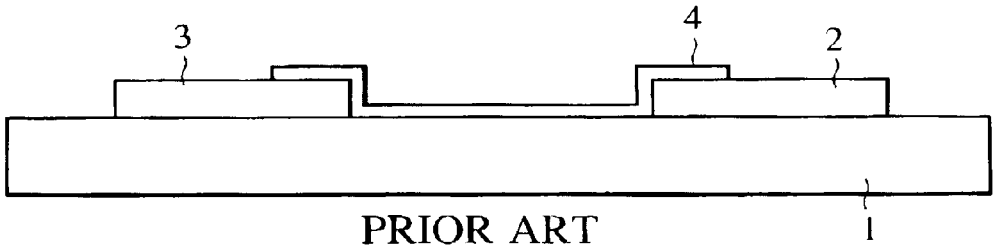
PRIOR ART FIG. 66B
Figure 66C:
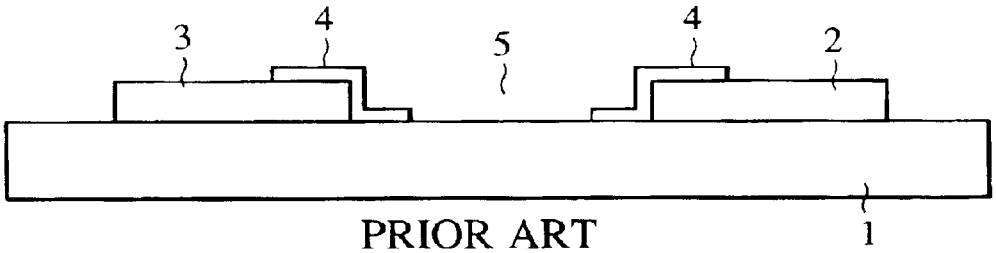
PRIOR ART FIG. 66C
Figure 66D:
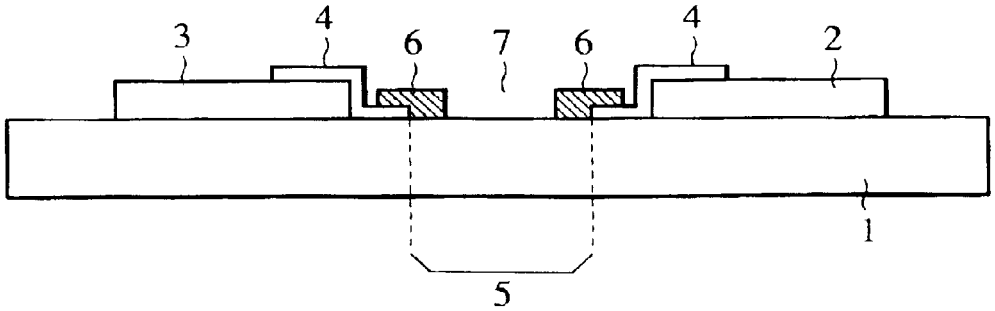
PRIOR ART FIG. 66D
Figure 67A:
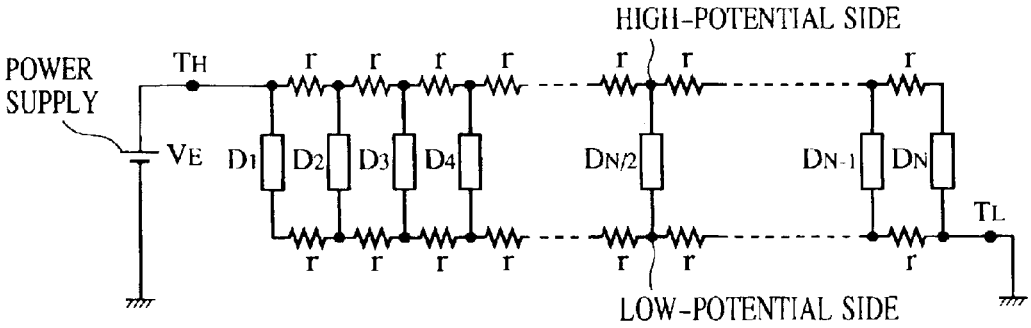
FIGS. 67A, 67B and 67C are diagrams for illustrating the problems of a conventional technique.
Figure 67B:
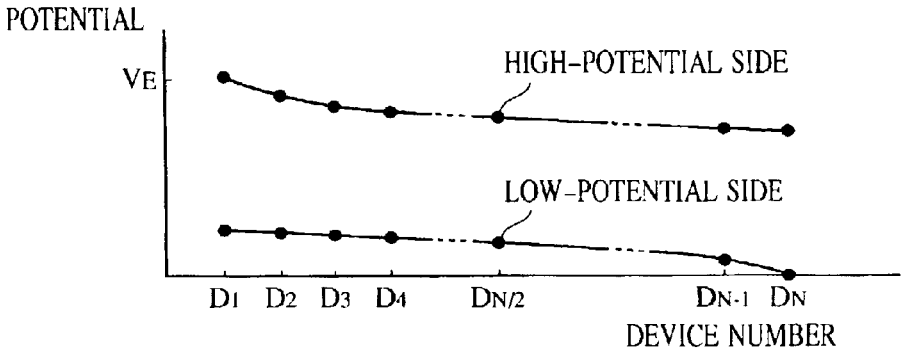
Figure 67C:
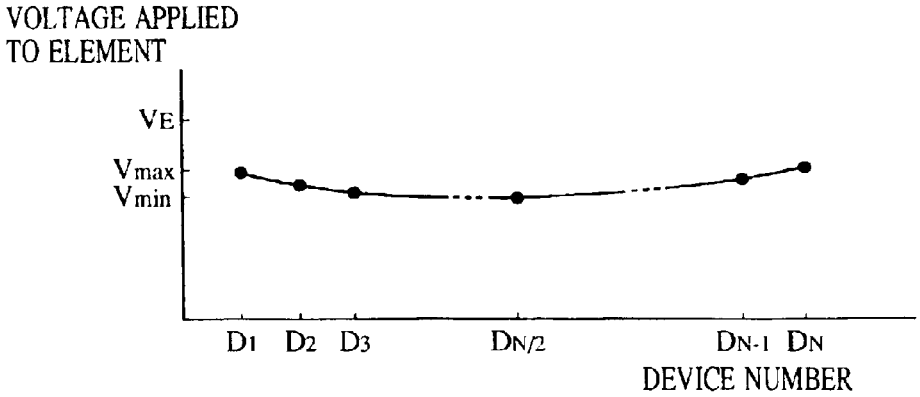
Figure 68A:
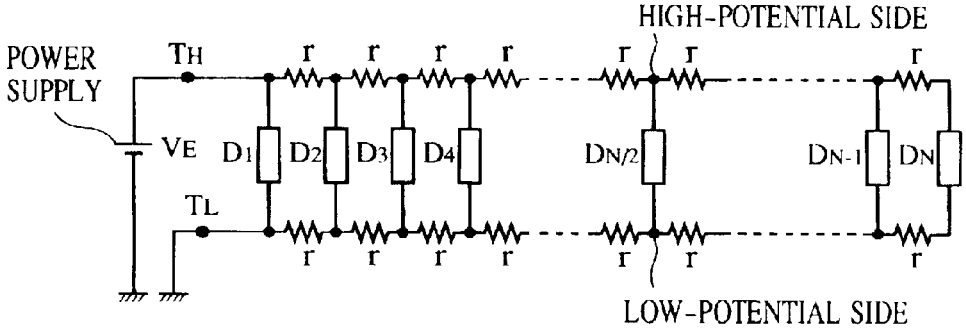
FIGS. 68A, 68B and 68C are diagrams for illustrating the problems of a conventional technique.
Figure 68B:
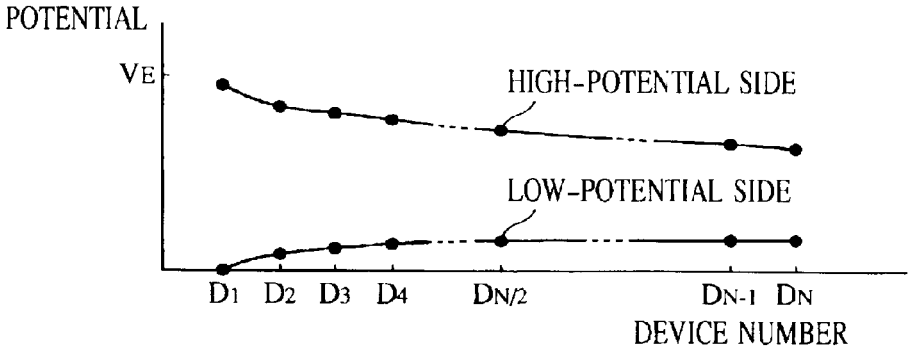
Figure 68C:
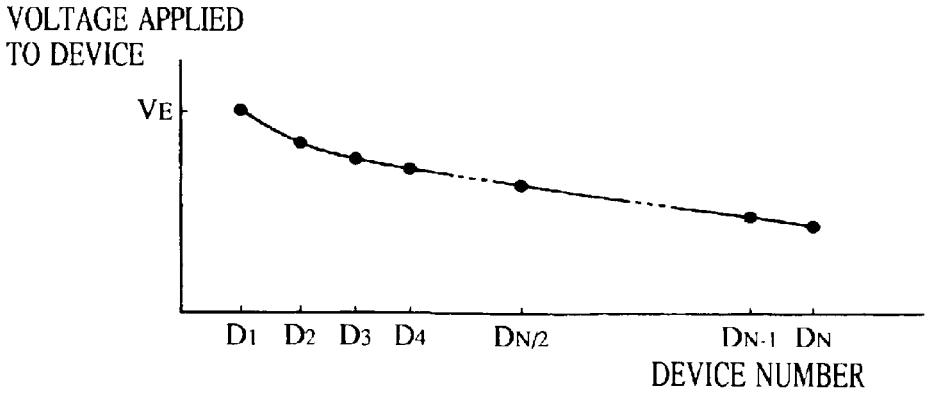
Figure 69:
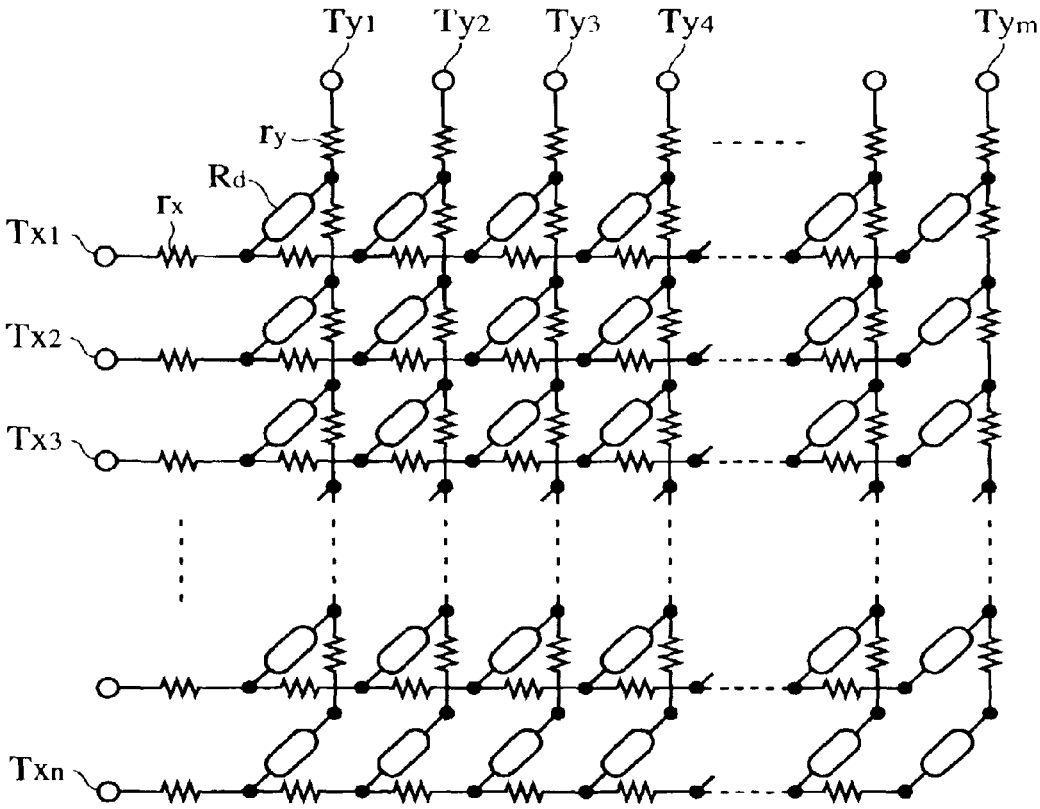
FIG. 69 is a diagram for illustrating the problems of a conventional technique.
Figure 69:
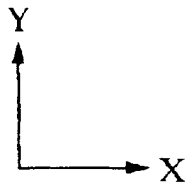

The configuration and the manufacturing method of the display panel in this embodiment is the same as those in the twenty-first embodiment. Referring to FIG. 64, in this embodiment, a group consists of i pairs of two adjoining X-direction wirings. The total number M of the X-direction wirings is 1,024.

In this embodiment, i is preferably 32; hence, the X-direction wirings are divided into $M/(2\times i)=16$ groups. Each group includes $((M/i)-2)=30$ X-direction wirings that are uniformly distributed in the X direction.

More specifically, a group 1 includes X-direction wirings 1, 2, 33, 34, . . . , $1+(m/i)\times(i-1)$, $2+(m/i)\times(i-1)$ and the group k includes X-direction wirings k, k+1, k+32, k+33, . . . , $k+(m/i)\times(i-1)$, $k;1+(m/i)\times(i-1)$.

The "forming" is performed using the apparatus used in the twenty-first embodiment. In this embodiment, two adjoining X-direction wirings belong to a same group; hence, uniformity of the temperature on the substrate 1 is slightly lower than that in the twenty-first embodiment, but still higher than that in a case in which all X-direction wirings adjoin in one group.

Twenty-fourth Embodiment

In this embodiment, grouping of the X-direction wirings is the same as that in the twenty-first embodiment, but the method for applying the "forming" voltage is different. The X-direction wirings are divided into a plurality of groups, each including substantially the same number of wirings. Each group is subjected to "forming" by a "scrolling" process. More specifically, each group includes 10 X-direction wirings: a group 1 includes Dx1, Dx103, Dx205, . . . ; and the group 2 includes Dx2, Dx104, Dx206, . . . . If the total number of the X-direction wirings is indivisible by ten, the remainder is allocated to any of the groups.

A pulsed voltage is applied to the group 1 by a "scrolling" process. That is, one pulse is applied from a "forming" voltage generator 612 to each of X-direction wirings Dx1, Dx103, Dx205, and the like in the group 1 by the operation of the wiring switch 611 (see FIG. 61). After the pulse is applied to all the X-direction wirings in the group 1, the same process is repeated for the group 1 until the "forming" of the group 1 is completed. The same treatment sequence is then performed to the group 2, and then the other groups in order.

In this method, the duty of the "forming" pulse is limited by the reciprocal of the number of the wirings belonging to one group. For example, for 10% of duty, the upper limit of the number of wirings belonging to one group is 10. Thus, the number of the groups inevitably increases and the "forming" time increases. However, a current flowing through the Y-direction wirings always is fed from one X-direction wiring; hence, this configuration moderates the effect of the resistance of the Y-direction wirings.

Twenty-fifth Embodiment

The configuration and the production method of the display panel in this embodiment is the same as those in the twenty-first embodiment, except that all the external terminals Doy1, Doy2, . . . , Doyn of the Y-direction wirings 63 in FIG. 32 are grounded, while the external terminals Dox1, Dox2, . . . , Doxn of the X-direction wirings 62 are connected to the connection switch for "forming" treatment.

In this embodiment, each group includes three adjoining X-direction wirings 62: For example, the group 1 includes X-direction wirings 1 to 3, the group 2 includes X-direction wirings 4 to 6, . . . , the group 80 includes X-direction wirings 238 to 240. A pulsed voltage is applied by a "scrolling" process as shown in the twenty-second embodiment.

An exhaust tube (not shown) of the package (display panel) 328 shown in FIG. 32 is connected to an evacuation system (not shown) and a vacuum system (not shown) provided with a gas inlet unit (not shown). The package 328 is evacuated at 50° C. When the pressure measured near a connection of the vacuum system and the exhaust tube reaches about $10^{-5}$ Pa, pulses are applied by the "scrolling"

process. The pulse is a rectangular pulse having a height of 10 V and a width of about 3 milliseconds. The pulse interval is about 11 milliseconds. The connection switch is operated every 11 milliseconds such that one pulse is applied to every group for 880 milliseconds. When viewed from each X-direction wiring, a pulse with a pulse width of 3 milliseconds and a pulse interval of 880 milliseconds is applied.

This image forming apparatus can display satisfactory images.

Twenty-sixth Embodiment

This embodiment is the same as the twenty-fifth embodiment except that an electron source prepared in this embodiment is larger than that in the twenty-fifth embodiment and has 480 X-direction wirings and 2442 Y-direction wirings.

Another "scrolling" process is employed. Specifically, each group includes six X-direction wirings, each wiring being selected to include every 80th wiring, respectively. A voltage is applied as in the twenty-fifth embodiment.

The number of wirings that are selected in one "forming" treatment in this embodiment is two times that in the twenty-fifth embodiment. If a voltage is simultaneously applied to the six selected wirings, the temperature will steeply increase. According to a preliminary test using a smaller electron source in which one group includes six adjoining wirings, electron emitting devices connecting with some wirings tend to show somewhat low emitting characteristics.

As the number of wirings selected for one "forming" step increases, the temperature significantly increases when adjoining wirings belong to a same group. Thus, it is preferable that one group include wirings which are distant from each other. The number of the wirings depends on the material used for the device films (decreased-resistance film) and the substrate temperature, and groupings of the X-direction wirings are determined in view of the above conditions.

An image forming apparatus according to this embodiment displayed satisfactory images as in the twenty-fifth embodiment.

In the first to twenty-fifth embodiments, some combinations of the above means are described. The present invention may also include any other combinations of those means.

During the "forming" treatment in these embodiments, rectangular or triangular pulses are applied between electrodes of each device. However, in other embodiments, any other waveform may be employed instead in the "forming" treatment. The pulse height and width and the pulse interval also are not limited as described herein in the present invention and may be optimized as deemed necessary to form satisfactory electron emitting regions (gaps) complying with applicable design criteria.

In the above embodiments, the electron emitting device is of a planar surface conduction type (a pair of device electrodes are disposed in a same plane). However, the present invention also can be applied to a vertical surface conduction type (a pair of device electrodes are disposed in different planes) of electron emitting device.

The method according to the present invention can also be applied to other devices requiring "forming" treatment, such as a MIM type of electron emitting device, in addition to the surface conductivity type.

The "forming" treatment according to the present invention may be performed using a system including a plurality of units or only one unit. The above-described programs for the "forming" treatment also can be applied to the system.

While the present invention has been described with reference to what are presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest reasonable interpretation so as to encompass all such modifications and equivalent structures and functions.

What is claimed is:

1. A method of manufacturing an electron source, comprising the steps of:

(A) forming a plurality of units on a substrate, each unit comprising a pair of electrodes and a polymer film for connecting the electrodes;

(B) forming a plurality of wirings so as to connect with the electrodes of the plurality of units;

(C) decreasing the resistances of all the polymer films of the plurality of units; and (D) applying a voltage to the films with a decreased resistance, through the wirings, to form a gap in each of the films with a decreased resistance;

wherein step (D) is performed after step (C).

2. A method of manufacturing an electron source according to claim 1, wherein step (C) comprises irradiating the polymer films with an electron beam to cause the decreasing.

3. A method of manufacturing an electron source according to claim 1, wherein step (C) comprises irradiating the polymer films with light to cause the decreasing.

4. A method of manufacturing an electron source according to claim 1, wherein step (C) comprises irradiating the polymer films with an ion beam to cause the decreasing.

5. A method of manufacturing an electron source according to claim 1, wherein the plurality of wirings comprise matrix wirings comprising row-direction wirings and column-direction wirings.

6. A method of manufacturing an electron source according to claim 5, wherein step (D) is performed for the units, in sequence.

7. A method of manufacturing an electron source according to claim 5, wherein step (D) comprises applying an electrical potential V1 to either all of the row-direction wirings or all of the column-direction wirings, applying an electrical potential V2 different from the electrical potential V1 to at least some other ones of the wirings, and applying the electrical potential V1 to remaining one of the wirings.

8. A method of manufacturing an electron source according to claim 5, wherein step (D) comprises applying an electrical potential V1 to at least some of the row-direction wirings, applying an electrical potential V2 different from electrical potential V1 to remaining one of the row-direction wirings, applying an electrical potential V1 to at least some of the column-direction wirings, and applying an electrical potential V2 different from electrical potential V1 to remaining one of the column-direction wirings.

9. A method of manufacturing an electron source according to any one of claims 1 to 6, wherein step (D) comprises supplying a current to the films with a decreased resistance from electrical connection means in contact with the wirings.

10. A method of manufacturing an electron source according to claim 9, wherein the electrical connection means is in contact with a plurality of portions of the wirings.

11. A method of manufacturing an electron source according to claim 9, wherein the wirings in contact with the electrical connection means are lower wirings coated with an insulating material, and a contact hole is formed in the insulating material so as to connect the electrical connection means and the lower wirings.

12. A method of manufacturing an electron source according to any one of claims 1 to 6, wherein the plurality of units originally are electrically disconnected, but become electrically connected by short-circuiting after step (D) is performed.

13. A method of manufacturing an electron source according to any one of claims 1 to 6, wherein the plurality of units are connected to each other through high-impedance portions, and the units are electrically short-circuited after step (D) is performed.

14. A method of manufacturing an electron source according to any one of claims 1 to 6, wherein step (D) comprises supplying substantially a same electric voltage to the films with a decreased resistance through the wirings.

15. A method of manufacturing an electron source according to claim 5, wherein step (D) comprises applying a voltage to the units, in sequence, each consisting of at least one of the films with a decreased resistance, connected to at least one of the row-direction wirings and column-direction wirings.

16. A method of manufacturing an electron source according to claim 15, wherein in step (D), the wirings connected to the electrodes of at least a first unit and the wirings connected to the electrodes of at least a second unit to which the voltage is next applied are arranged so that the wirings connected to the electrodes of other units are positioned between the first and second units.

17. A method of manufacturing an electron source according to claim 15, wherein step (D) comprises applying a first voltage to one of the units while a second voltage is applied to other remaining ones of the units.

18. A method of manufacturing an image forming apparatus, the apparatus comprising an electron source and an image forming member for forming an image by irradiation with an electron beam emitted from the electron source, the electron source comprising a substrate and a plurality of electron emitting devices disposed on the substrate, wherein the electron source is manufactured by a method comprising the steps of:

(A) forming a plurality of units on the substrate, each unit comprising a pair of electrodes and a polymer film for connecting the electrodes;

(B) forming a plurality of wirings so as to connect with the electrodes of the plurality of units;

(C) decreasing the resistance of all the polymer films of the plurality of units; and (D) applying a voltage to the films with a decreased resistance, through the wirings, to form a gap in each of the films with a decreased resistance, wherein step (D) is performed after step (C).

19. A method of manufacturing an electron source according to claim 18, wherein step (C) comprises irradiating the polymer films with an electron beam to cause the decreasing.

20. A method of manufacturing an electron source according to claim 18, wherein step (C) comprises irradiating the polymer films with light to cause the decreasing.

21. A method of manufacturing an electron source according to claim 18, wherein step (C) comprises irradiating the polymer films with an ion beam to cause the decreasing.

* * * * *

UNITED STATES PATENT AND TRADEMARK OFFICE

CERTIFICATE OF CORRECTION

PATENT NO. : 6,960,111 B2
APPLICATION NO. : 10/277921
DATED : November 1, 2005
INVENTOR(S) : Tsuyoshi Takegami et al.

It is certified that error appears in the above-identified patent and that said Letters Patent is hereby corrected as shown below:

ON THE TITLE PAGE ITEM [56] REFERENCES CITED:

Other Publications, "Appli d" should read --Applied--.

COLUMN 2:

Line 50, "mat" should read --may--.

COLUMN 13:

Line 29, "pate" should read --plate--; and
Line 33, "FIGS. 2A" should read --FIG. 2A--.

COLUMN 18:

Line 53, "resistances" should read --resistances of--.

COLUMN 20:

Line 32, "x-direction" should read --X-direction--.

COLUMN 21:

Line 35, "device" should read --devices--.

COLUMN 24:

Line 55, "$-P(N_x, N_y/2)\}P_{o\sim}$" should read -- $-P(N_x, N_y/2)\}P_o\sim$--.

COLUMN 26:

Line 45, "the all" should read --"forming" is performed successively for all of the--;
Line 46, "means 247 is" should read --means 247.--; and
Line 47, "successively performed "forming" for all devices." should be deleted.

COLUMN 29:

Line 35, "although" should be deleted.

UNITED STATES PATENT AND TRADEMARK OFFICE

CERTIFICATE OF CORRECTION

PATENT NO. : 6,960,111 B2
APPLICATION NO. : 10/277921
DATED : November 1, 2005
INVENTOR(S) : Tsuyoshi Takegami et al.

It is certified that error appears in the above-identified patent and that said Letters Patent is hereby corrected as shown below:

COLUMN 32:

Line 43, “an” should read --a--; and
Line 48, “device.” should read --devices.--

COLUMN 35:

Line 59, “en” should read --a-- and
“an” should read --a--.

COLUMN 36:

Line 3, “an” should read --a--; and
Line 10, “an” should read --a--.

COLUMN 38:

Line 5, “device” should read --devices--.

COLUMN 39:

Line 16, “stylus” should read --styluses--; and
Line 60, “subjected” should read --is subjected--.

COLUMN 40:

Line 65, “in synchronous” should read --synchronously--.

COLUMN 41:

Line 12, “in synchronous” should read --synchronously--.

COLUMN 49:

Line 44, “devices” should read --device--.

UNITED STATES PATENT AND TRADEMARK OFFICE

CERTIFICATE OF CORRECTION

PATENT NO. : 6,960,111 B2
APPLICATION NO. : 10/277921
DATED : November 1, 2005
INVENTOR(S) : Tsuyoshi Takegami et al.

It is certified that error appears in the above-identified patent and that said Letters Patent is hereby corrected as shown below:

COLUMN 52:

Line 48, "is" should read --are--.

Signed and Sealed this

Twenty-sixth Day of February, 2008

JON W. DUDAS
*Director of the United States Patent and Trademark Office*